United States Patent [19]

Hirai et al.

[11] Patent Number: 4,791,048

[45] Date of Patent: Dec. 13, 1988

[54] COLOR IMAGE FORMING PROCESS UTILIZING SUBSTANTIALLY WATER-INSOLUBLE BASIC METAL COMPOUNDS AND COMPLEXING COMPOUNDS

[75] Inventors: Hiroyuki Hirai; Yoshiharu Yabuki; Haruhiko Iwano, all of Kanagawa, Japan

[73] Assignee: Fuji Photo Film Co., Ltd., Kanagawa, Japan

[21] Appl. No.: 16,591

[22] Filed: Feb. 19, 1987

[30] Foreign Application Priority Data

| | | | |
|---|---|---|---|
| Feb. 19, 1986 | [JP] | Japan | 61-034895 |
| Mar. 14, 1986 | [JP] | Japan | 61-056477 |
| Mar. 28, 1986 | [JP] | Japan | 61-070055 |
| Oct. 29, 1986 | [JP] | Japan | 61-257463 |

[51] Int. Cl.[4] ..... G03C 5/24; G03C 7/16; G03C 7/40

[52] U.S. Cl. ..... 430/372; 430/214; 430/218; 430/222; 430/376; 430/377; 430/467; 430/470; 430/476; 430/491

[58] Field of Search ..... 430/372, 467, 470, 214, 430/218, 222, 491, 376, 377

[56] References Cited

U.S. PATENT DOCUMENTS

| | | | |
|---|---|---|---|
| 3,260,598 | 7/1966 | Yutzy et al. | 430/404 |
| 4,546,068 | 10/1985 | Kuse | 430/467 |
| 4,559,291 | 12/1985 | Neumann et al. | 430/212 |
| 4,596,765 | 6/1986 | Kurematsu et al. | 430/467 |

*Primary Examiner*—Mukund J. Shah

*Attorney, Agent, or Firm*—Sughrue, Mion, Zinn, Macpeak and Seas

[57] ABSTRACT

A color image is formed by subjecting a silver halide photosensitive material comprising at least a photosensitive silver halide, a two equivalent coupler, a binder, and a substantially water-insoluble basic metal compound on a support, to development with a processing solution comprising a complexing compound capable of complexing reaction with the metal in ionic form of said substantially water-insoluble basic metal compound in the presence of water to release a base.

13 Claims, No Drawings

COLOR IMAGE FORMING PROCESS UTILIZING SUBSTANTIALLY WATER-INSOLUBLE BASIC METAL COMPOUNDS AND COMPLEXING COMPOUNDS

BACKGROUND OF THE INVENTION

This invention relates to a process for forming color images using photosensitive silver halide materials.

Developing solution generally suffers from some problems that a very careful preparation is required because it contains reducing agents such as a developing agent and hydroxylamine in alkaline water, and a great volume of developing solution cannot be prepared at a time because it is liable to changes during shelf storage.

One solution is to incorporate a reducing agent such as a developing agent in a photosensitive material and treat the material with an alkaline bath generally known as activator bath. This approach, which in turn, undesirably deteriorates the shelf stability of the photosensitive material prior to the development, has not been commercially successful as a color image forming process.

For the purpose of overcoming these problems, it is desired to reduce the pH of developing solution as low as possible. However, low pH levels naturally bring out another problem of taking a long developing time.

U.S. Pat. No. 3,260,598 discloses an image forming process utilizing the mechanism wherein alkali-releasing agents, a very slightly water-soluble metal hydroxide and a compound XY are reacted to release hydroxyl ions to increase the pH wherein X represents a sodium or potassium ion, and Y represents a citrate ion, an oxalate ion, a fluoride ion, a ferricyanide ion, a tartrate ion, a sulfite ion, an ethylenedinitrilo tetraacetate ion, a 1,3-diamino-2-propanol tetraacetate ion, a trimethylamine triacetate ion, and other aliphatic nitrogenous polycarboxylate ions.

This patent discloses that the process finds predominant applications in black and white images forming processes, typically silver salt diffusion transfer process, but is silent about technical considerations required when the process is applied to color image forming processes. More specifically, insofar as our empirical runs are concerned, the treating process of the above-referred patent, which is successful in lowering the pH of developing solution, fails to accomplish a sufficient image density when conventional well known four equivalent couplers are used.

SUMMARY OF THE INVENTION

An object of the present invention is to provide a novel and improved process for forming color images with a sufficient density within a short processing time while improving the aging stability and safety of developing solution.

According to the present invention, there is provided a process for forming a color image, comprising subjecting a silver halide photosensitive material comprising at least a photosensitive silver halide, a two equivalent coupler, a binder, and a substantially water-insoluble basic metal compound on a support, to a development with a processing solution comprising a compound capable of water-mediated complexing reaction with the metal ion of the substantially water-insoluble basic metal compound to release a base.

DETAILED DESCRIPTION OF THE INVENTION

In the image forming process of the present invention, a substantially water-insoluble basic metal compound is contained in a silver halide photosensitive material and a compound capable of water-mediated complexing reaction with the metal ion of the substantially water-insoluble basic metal compound (to be referred to as complexing compound, hereinafter) contained in a processing solution, and both the compounds contact to give rise to complexing reaction to generate a base within a coating film of the photosensitive material.

The substantially water-insoluble basic metal compounds used in the present invention are those compounds having a solubility in water at 20° C. of up to 0.5 as expressed in grams of the compound dissolvable in 100 grams of water. They are represented by the general formula:

$$T_mX_n$$

wherein T is a transition metal such as Zn, Ni, Cu, Al, Co, Fe, Mn, etc. or an alkaline earth metal such as Ca, Ba, Mg, etc.; X is a member that can form in water a counter ion to M as will be described in conjunction with the complexing compound and exhibits alkaline nature, for example, a carbonate ion, phosphate ion, silicate ion, borate ion, aluminate ion, hydroxy ion, and oxygen atom; and m and n are such integers as to establish equilibrium between the valences of T and X.

Some preferred, non-limiting examples of the substantially water-insoluble basic metal compounds include calcium carbonate, barium carbonate, magnesium carbonate, zinc carbonate, strontium carbonate, magnesium calcium carbonate $CaMg(CO_3)_3$; magnesium oxide, zinc oxide, tin oxide, cobalt oxide; zinc hydroxide, aluminum hydroxide, magnesium hydroxide, calcium hydroxide, antimony hydroxide, tin hydroxide, iron hydroxide, bismuth hydroxide, manganese hydroxide, copper hydroxide; calcium phosphate, magnesium phosphate; magnesium borate; calcium silicate, magnesium silicate; zinc aluminate, calcium aluminate; basic zinc carbonate $2ZnCO_3.3Zn(OH)_2.H_2O$, basic magnesium carbonate $3MgCO_3.Mg(OH)_2.3H_2O$, basic nickel carbonate $NiCO_3.2Ni(OH)_2$, basic bismuth carbonate $Bi_2(CO_3)O_2.H_2O$, basic cobalt carbonate $2CoCO_3.3Co(OH)_2$, basic copper carbonate, and aluminum magnesium oxide. Most preferred among them are uncolored compounds.

The complexing compounds used in the present invention are capable of forming a complex salt with the metal component in ionic form of the substantially water-insoluble basic metal compounds, the complex exhibiting a stability constant of at least 1 as expressed in log K.

These complexing compounds are detailed in A. E. Martell & R. M. Smith, "Critical Stability Constant's, Vols. 1–5, Plenum Press, inter alia.

Illustrative examples of the complexing compounds include salts of aminocarboxylic acid analogs, iminodiacetic acid analogs, anilinecarboxylic acid analogs, pyridinecarboxylic acid analogs, aminophosphoric acid analogs, carboxylic acid analogs (including mono-, di-tri-, and tetracarboxylic acids, and their derivatives having a substituent such as phosphono, hydroxy, oxo, ester, amide, alkoxy, mercapto, alkylthio, and phosphino), hydroxamic acid analogs, polyacrylic acid analogs, and polyphosphoric acid analogs with alkali metals, guanidines, amidines, and quaternary ammonium.

Preferred, non-limiting examples of the complexing compounds are salts of picolinic acid, 2,6-pyridinedicarboxylic acid, 2,5-pyridinedicarboxylic acid, 4-dimethylaminopyridine-2,6-dicarboxylic acid, quinoline-2-carboxylic acid, 2-pyridylacetic acid, oxalic acid, citric acid, tartaric acid, isocitric acid, malic acid, gluconic acid, EDTA (ethylenediaminetetraacetic acid), NTA (nitrilotriacetic acid), CDTA (1,2-cyclohexanediaminetetraacetic acid), hexametaphosphoric acid, tripolyphosphoric acid, tetraphosphoric acid, polyacrylic acid, and acids of the following chemical formulae:

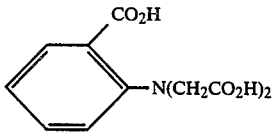

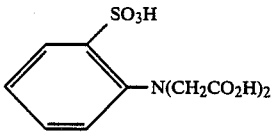

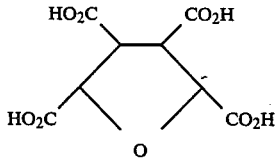

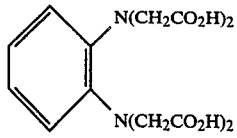

$HO_2CCH_2OCH_2CH_2OCH_2CO_2H$, $HO_2CCH_2OCH_2CO_2H$,

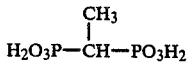

with alkali metals, guanidines, amidines, and quaternary ammonium.

Preferred among others are those aromatic heterocyclic compounds having at least one —COOM and containing one nitrogen atom in their ring wherein M is selected from ions of alkali metals, quanidines, amidines, and quaternary ammonium. The ring contained therein may be a single ring or a fused ring such as a pyridine ring and a quinoline ring. The position at which —COOM is attached to the ring is most preferably the α-position of the ring relative to the N atom.

Also included in the preferred compounds are those represented by the following formula:

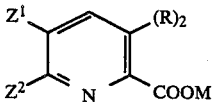

In the above formula, R represents an electron donative radical selected from hydrogen atom, aryl radicals, halogen atoms, alkoxy radicals, —COOM, hydroxycarbonyl radical, amino and substituted amino radicals, and alkyl radicals. The two R's may be the same or different. $Z^1$ and $Z^2$ are as defined for R and may be combined together to form a ring fused to the pyridine ring. M is as defined above.

Examples of the most preferred combinations of the substantially water-insoluble basic metal compounds and the complexing compounds are illustrated below. In the following formulae, M⊕ represents an alkali metal ion, substituted or unsubstituted quanidinium ion, amidinium ion, or quaternary ammonium ion.

| Substantially insoluble compound | Complexing compound |
|---|---|
| Calcium carbonate | 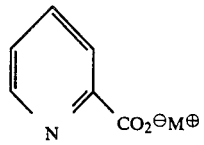  |
| Basic zinc carbonate | 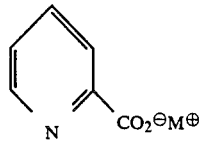  |
| Basic magnesium carbonate | 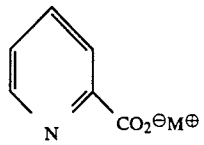  |
| Zinc oxide | 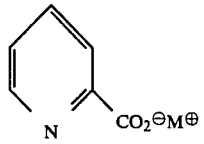  |
| Basic zinc carbonate | 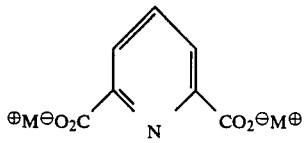  |
| Basic magnesium carbonate | 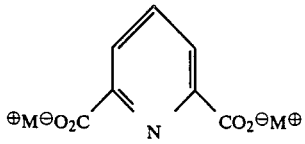  |
| Calcium carbonate | 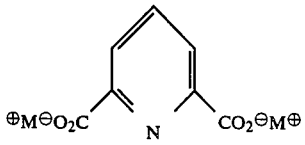  |
| Zinc oxide | 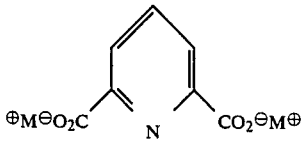  |

-continued

| Substantially insoluble compound | Complexing compound |
|---|---|
| Calcium carbonate | $^{\oplus}M^{\ominus}OOC-COO^{\ominus}M^{\oplus}$ |
| Calcium carbonate | 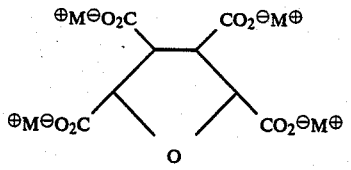 |
| Barium carbonate | $^{\oplus}M^{\ominus}OOC-COO^{\ominus}M^{\oplus}$ |
| Calcium carbonate | $M^{\oplus}$ salt of tripolyphosphoric acid |
| Calcium carbonate | $M^{\oplus}$ salt of citric acid |
| Calcium carbonate | $M^{\oplus}$ salt of polyacrylic acid |
| Calcium carbonate | 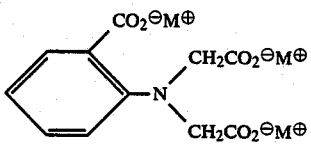 |
| Magnesium oxide | 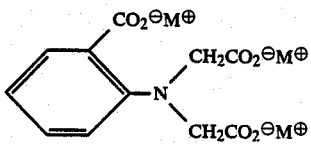 |
| Zinc hydroxide | 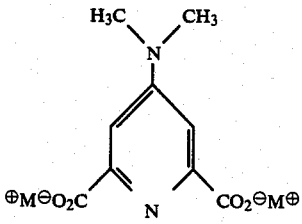 |
| Tin hydroxide | 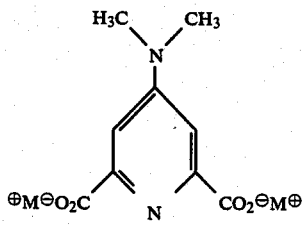 |
| Magnesium hydroxide | $M^{\oplus}$ salt of hexametaphosphoric acid |
| Calcium carbonate | 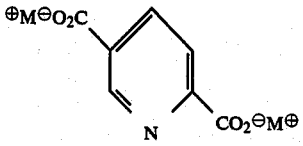 |
| Basic magnesium carbonate | $^{\oplus}M^{\ominus}OOC-COO^{\ominus}M^{\oplus}$ |
| Zinc hydroxide | $3M^{\oplus}$ salt of EDTA |
| Zinc hydroxide | $3M^{\oplus}$ salt of 1,2-CDTA |
| Aluminum hydroxide | 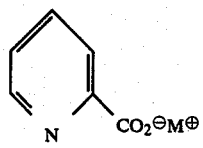 |

-continued

| Substantially insoluble compound | Complexing compound |
|---|---|
| Zinc hydroxide | 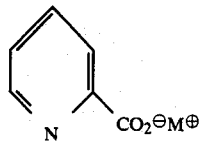 |
| Calcium carbonate | 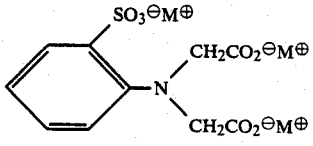 |
| Basic zinc carbonate | 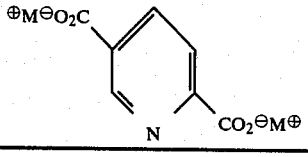 |

These combinations may be used alone or in admixture of two or more.

The mechanism of generating a base in a coating film of the photosensitive material according to the present invention will be described by referring to one exemplary combination of potassium picolinate with zinc hydroxide. Their reaction may be represented by the following scheme:

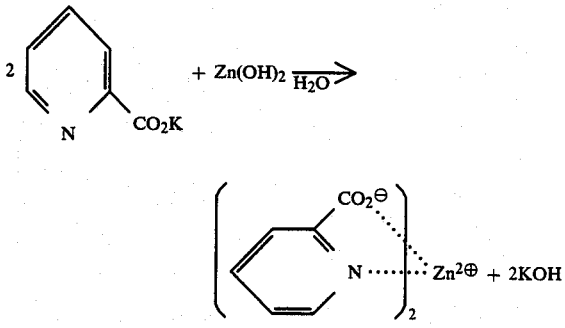

When potassium picolinate and zinc hydroxide are mediated by water in the processing solution, picolinate ions make a complexing reaction with zinc ions and the reaction proceeds according to the above-illustrated scheme, generating a base.

The process of this reaction is attributable to the stability of the resulting complexes. Picolinate ions ($L^{\ominus}$) and zinc ions ($M^{\oplus}$) form complexes ML, $ML_2$, and $ML_3$ having a very high stability constant as shown below, which well accounts for the progress of the reaction.

| | ML | $ML_2$ | $ML_3$ |
|---|---|---|---|
| logK | 5.30 | 9.62 | 12.92 |

It is desirable to incorporate the substantially water-insoluble basic metal compound as a fine particulate dispersion which may be prepared by the methods described in Japanese patent application Kokai Nos. 59-174830 and 53-102733. In such dispersions, the compounds preferably have an average particle size of 50 um or less, especially 5 um or less.

In the practice of the present invention, the basic metal compounds may be added to any desired layer of the photosensitive material including an emulsion layer, intermediate layer, protective layer, antihalation layer, white pigment layer, and backing layer. The compounds may be added to a single layer or two or more layers.

The amount of the basic metal compound added depends on the type and particle size of the compound, type and pH of processing solution, type of the complexing compound, processing temperature, and other factors. Preferably, the basic metal compounds are added in amounts of 0.01 to 20 grams per square meter, more preferably 0.1 to 5 grams per square meter although the amount is not generally limited thereto.

The amount of the complexing compound added to the processing solution depends on the type and pH of processing solution, type of the complexing compound, and other factors, but is preferably at least 1/10 mol per mol of the basic metal compound with which it reacts. Generally, the complexing compound is present in an amount of 0.01 to 5 mols per liter of the solution.

The present invention is predicated on the discovery that a treating process utilizing the above-described base generating mechanism can produce images with a high density within a short processing time by using a 2-equivalent coupler.

The term 2-equivalent coupler designates a coupler in which an active coupling position is replaced by a coupling split-off group other than a hydrogen atom.

The coupling split-off group of the 2-equivalent coupler (to be simply referred to as coupling-off group, hereinafter) is an aliphatic group, aromatic group, heterocyclic group, aliphatic, aromatic or heterocyclic sulfonyl group, aliphatic, aromatic or heterocyclic carbonyl group, halogen, atom, or aromatic azo group which is attached to the coupling active carbon via an oxygen, nitrogen, sulfur or carbon atom. The aliphatic, aromatic and heterocyclic groups contained in these coupling-off groups may be substituted or unsubstituted.

Illustrative examples of the coupling-off groups include halogen atoms such as fluorine, chlorine, and bromine; alkoxy groups such as ethoxy, dodecyloxy, methoxyethylcarbamoylmethoxy, carboxypropyloxy, and methylsulfonylethoxy groups; aryloxy groups such as 4-chlorophenoxy, 4-methoxyphenoxy, and 4-carboxyphenoxy groups; acyloxy groups such as acetoxy, tetradecanoyloxy, and benzoyloxy groups; aliphatic or aromatic sulfonyloxy groups such as methanesulfonyloxy and toluenesulfonyloxy groups; acylamino groups such as dichloroacetylamino and heptafluorobutyrylamino groups; aliphatic or aromatic sulfonamide groups such as methanesulfonamino and p-toluenesulfonamino groups; alkoxycarbonyloxy groups such as ethoxycarbonyloxy and benxyloxycarbonyloxy groups; aryloxycarbonyloxy groups such as a phenoxycarbonyloxy group; aliphatic-aromatic or heterocyclic thio groups such as ethylthio, phenylthio, and tetrazolylthio groups; carbamoylamino groups such as N-methylcarbamoylamino and N-phenylcarbamoylamino groups; 5- or 6-membered nitrogeneous heterocyclic groups such as imidazolyl, pyrazolyl, triazolyl, tetrazolyl, and 1,2-dihydr-2-oxo-1-pyridyl groups; imide groups such as succinimide and hydantoinyl groups; aromatic azo groups such as a phenylazo group, with all these groups being optionally substituted. Another class of the coupling-off groups attached via a carbon atom is bis-type couplers obtained by condensing 4-equivalent couplers with aldehydes or ketones. The coupling-off groups may further contain a photographically useful group such as a development restrainer and a development accelerator.

Preferred are the above-listed coupling-off groups other than the halogen atoms, the coupling-off group being attached to the coupling position via an oxygen, nitrogen, sulfur or carbon atom. Couplers having these coupling-off groups have such a high solubility in a coupler dispersing solvent that the amount of the coupler dispersing solvent used may be reduced, with the advantages of increased sharpness and more effective utilization of the base resulting from the present mechanism in the image forming reaction system.

Examples of the coupling-off groups other than the halogen atoms are disclosed in the following patent publications.

| | | |
|---|---|---|
| Japanese Patent Application Kokai Nos. | | |
| 47-26133 | 50-10135 | 50-117422 |
| 50-159336 | 51-3232 | 51-20826 |
| 52-20023 | 52-58922 | 52-90932 |
| 53-129035 | 55-32071 | 55-62454 |
| 55-161239 | 55-118034 | 56-1938 |
| 57-35858 | 58-95346 | 59-174839 |
| 59-178459 | 59-214854 | 59-228649 |
| 59-231538 | 60-23855 | 60-35730 |
| 60-49336 | 60-69653 | 60-91355 |
| Japanese Patent Publication Nos. | | |
| 48-25933 | 49-12660 | 49-13576 |
| 51-33410 | 54-21257 | 54-37822 |
| 56-5988 | 56-6539 | 56-7222 |
| 56-45135 | 57-37859 | |
| U.S. Pat. Nos. | | |
| 3,227,554 | 3,311,476 | 3,408,194 |
| 3,447,928 | 3,476,563 | 3,458,315, |
| 3,542,840 | 3,737,316 | 3,758,308 |
| 3,839,044 | 3,894,875 | 3,994,967 |
| 4,133,958 | 4,401,752 | |

Especially preferred coupling-off groups are those having the general formulae (I) to (IV) as given below.

General formula (I):

—SR1

In formula (I), R1 represents a straight chain or branched alkyl group having 1 to 22 carbon atoms which may be optionally substituted. Examples of the straight chain alkyl groups are methyl, ethyl, propyl, butyl, octyl, dodecyl, tetradecyl, octadecyl, and heptadecyl groups. Examples of the branched alkyl groups are iso-propyl and tert.-butyl groups. In addition, R1 may represent an aralkyl group such as a benzyl and 2-phenylethyl group; an alkenyl group such as a propenyl group; and an aryl group such as a phenyl group.

These alkyl, aralkyl, alkenyl, and aryl groups may be replaced with a substituent selected from the class consisting of halogen atoms, nitro, cyano, aryl, alkoxy, aryloxy, carboxy, alkylcarbonyl, arylcarbonyl, alkoxycarbonyl, aryloxycarbonyl, acyloxy, sulfamoyl, carbamoyl, acylamino, diacylamino, ureido, thioureido, urethane, thiourethane, sulfonamide, heterocyclic, arylsulfonyloxy, alkylsulfonyloxy, arylsulfonyl, alkylsulfonyl, arylthio, alkylthio, alkylsulfinyl, arylsulfinyl, alkylamino, dialkylamino, anilino, N-arylanilino, N-alkylanilino, N-acylanilino, and hydroxy groups.

General formula (II):

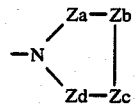

In formula (II), Za to Zd represent methine, substituted methine, and —N= groups. The nitrogeneous ring formed by Za to Zd may further form a fused ring, and Za to Zd may be the same or different. Preferred examples of these coupling-off groups include 1-imidazolyl, 2-methyl-1-imidazolyl, 2-methylthio-1-imidazolyl, 2-ethylthio-1-imidazolyl, 2,4-dimethyl-1-imidazolyl, 4-methyl-1-imidazolyl, 4-nitro-1-imidazolyl, 4-chloro-1-imidazolyl, 4-phenyl-1-imidazolyl, 4-acetyl-1-imidazolyl, 4-tetradecanamide-1-imidazolyl, 1-pyrrolyl, 3,4-dichloro-1-pyrrolyl, 2-isoindolyl, 1-indolyl, 1-pyrazolyl, 1-benzimidazolyl, 5-bromo-1-benzimidazolyl, 5-octadecanamide-1-benzimidazolyl, 2-methyl-1-benzimidazolyl, 5-methyl-1-benzimidazolyl, 2-imidazolyl, 1,2,4-triazol-4-yl, 1,2,3-triazol-4-yl, 1-tetrazolyl, 4-chloro-1-pyrazolyl, 3-methyl-1-pyrazolyl, 3,5-dimethyl-1-pyrazolyl, 4-bromo-1-pyrazolyl, 4-phenyl-1-pyrazolyl, 4-methoxy-1-pyrazolyl, and 4-acetylamino-1-pyrazolyl.

Particularly preferred among them are those represented by the following formulae (II-1) and (II-2):

(II-1)

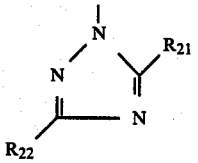

(II-2)

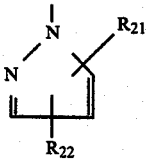

In these formulae, R21 and R22 are independently selected from hydrogen atom, halogen atom, carboxylate ester, amino, alkyl, alkylthio, alkoxy, alkylsulfonyl, alkylsulfinyl, carboxylate, sulfonate, substituted or unsubstituted phenyl, and heterocylic groups while they may be the same or different.

General formula (III):

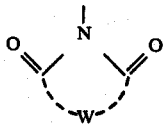

In formula (III), W1 represents a non-metallic atom or a linkage of non-metallic atoms necessary to form a four-, five- or six-membered ring with

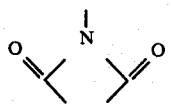

in the formula.

Particularly preferred among the groups of formula (III) are those of formulae (III-1) to (III-3) shown below.

(III-1)

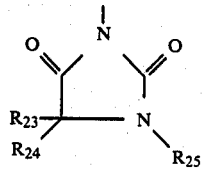

(III-2)

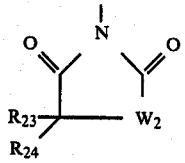

(III-3)

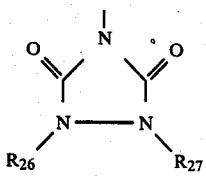

In these formulae, R23 and R24 are independently selected from hydrogen atom, alkyl, aryl, alkoxy, aryloxy, and hydroxyl groups; R25, R26, and R27 are independently selected from hydrogen atom, alkyl, aryl, aralkyl, and acyl groups; and W2 represents an oxygen or sulfur atom.

General formula (IV):

—OR2

In formula (IV), R2 represents an aryl, acyl or alkyl group which may be optionally substituted. Preferred examples of the aryl groups include phenyl, alkylsulfonylphenyl, arylsulfonylphenyl, N-alkylsulfamylphenyl, N,N-dialkylsulfamylphenyl, N-arylsulfamylphenyl, N-alkyl-N-arylsulfamylphenyl, sulfamylphenyl, nitrophenyl, acetamidephenyl, halophenyl, naphthyl, pyridyl, methoxyphenyl, hydroxyphenyl, sulfophenylazophenyl, carboxyphenyl, and sulfophenyl. The acyl group is prepresented by —COR28 wherein R28 is a substituted or unsubstituted alkyl group. Preferred examples of the alkyl groups represented by R28 and R2 are the same as listed for R1 in formula (I).

Among the 2-equivalent couplers are 2-equivalent yellow, magenta, and cyan couplers. Typical examples of the coupler nuclei of the 2-equivalent yellow couplers are described in U.S. Pat. Nos. 2,875,057; 2,407,210; 3,265,506; 2,298,443; 3,048,194; and 3,447,928. Preferred among these yellow couplers are acylacetamide derivatives such as benzoylacetanilide and pivaloylacetanilide. Then preferred yellow coupler residues (Cp) are those of general formulae (X) and (XI) shown below.

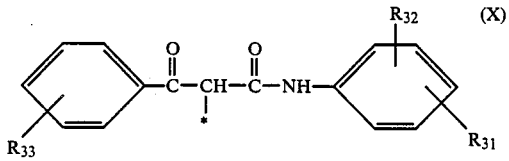

(X)

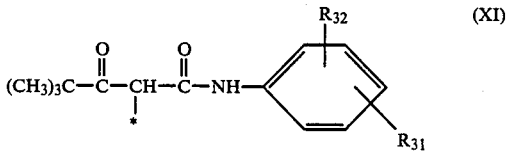

(XI)

In the formulae, asterisk (*) represents the position at which the coupling-off group of the 2-equivalent yellow coupler is attached. R31 represents a nondiffusing group having 8 to 32 carbon atoms in total when the coupling-off group is free of a nondiffusing group. R31 represents a hydrogen atom, a halogen atom or halogen atoms, a substituted or unsubstituted lower alkyl group, a substituted or unsubstituted lower alkoxy group, or a nondiffusing group having 8 to 32 carbon atoms in total when the coupling-off group has a nondiffusing group attached thereto (in the case of couplers as disclosed in British Pat. No. 2,083,640). R32 and R33 each represent a hydrogen atom, a halogen atom or halogen atoms, a substituted or unsubstituted lower alkyl group, a substituted or unsubstituted lower alkoxy group, or a nondiffusing group having 8 to 32 carbon atoms in total. When more than one R32 and R33 is present, they may be the same or different.

The preferred coupling-off groups for the 2-equivalent yellow couplers are those of general formulae (II), (III), and (IV).

The substituent on the coupling-off group or on the coupler nucleus may be either a divalent group to form a dimer or a group connecting a high molecular weight backbone to the coupler nucleus.

Typical examples of the coupler nuclei of the 2-equivalent magenta couplers are described in U.S. Pat. Nos. 2,600,788; 2,369,489; 2,343,703; 2,311,082; 3,152,896; 3,519,429; 3,062,653; 2,908,573; and 3,733,335; and British Pat. No. 1,334,515. Preferred among these magneta couplers are pyrazolones and pyrazoloazoles including pyrazolopyrazole, pyrazoloimidazole, pyrazolotriazole, and pyrazolotetrazole. Then preferred magenta coupler residues (Cp) are those represented by the following formula (XII), (XIII), and (XIV).

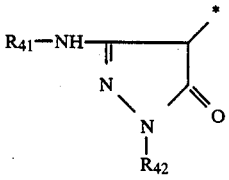

(XII)

-continued

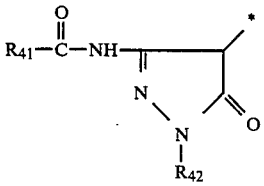

(XIII)

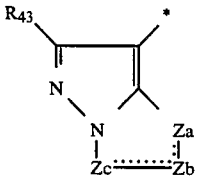

(XIV)

In the formulae, R41 represents a nondiffusing group having 8 to 32 carbon atoms in total when the coupling-off group is free of a nondiffusing group. R41 represents a substituted or unsubstituted lower alkyl group, a substituted or unsubstituted lower alkoxy group, a substituted or unsubstituted aryl group, or a nondiffusing group having 8 to 32 carbon atoms in total when the coupling-off group has a nondiffusing group attached thereto (in the case of couplers as disclosed in British Pat. No. 2,083,640). R42 represents a substituted or unsubstituted lower alkyl group, a substituted or unsubstituted lower alkoxy group, a substituted or unsubstituted aryl group, or a nondiffusing group having 8 to 32 carbon atoms in total. R43 will be defined later. Za, Zb, and Zc represent a methine, substituted methine, =N—, or —NH—. One of Za—Zb and Zb—Zc linkages is a double bond and the other is a single bond. The Zb—Zc linkage may be a carbon-to-carbon double bond which may be a part of an aromatic ring.

The compounds of formula (XIV) are 5-membered ring-5-membered ring fused nitrogeneous hetero couplers (to be referred to as 5,5N-heterocyclic couplers, hereinafter) whose color developing nucleus has an aromatic nature isoelectronic to naphthalene and is of a chemical structure generally designed azapentalene. Preferred among the couplers of general formula (XIV) are those of general formulae (XIV-1) to (XIV-5) shown below.

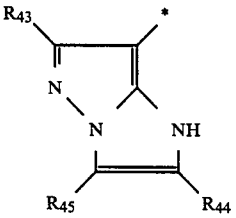

(XIV-1)

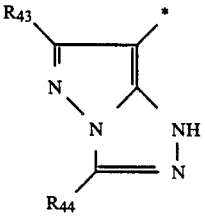

(XIV-2)

-continued

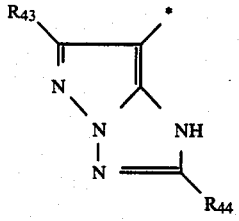

(XIV-3)

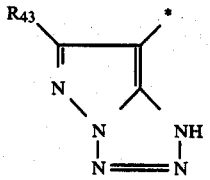

(XIV-4)

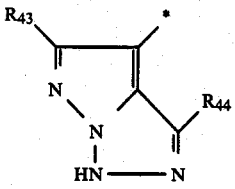

(XIV-5)

The substituents involved in the general formulae (XIV-1) to (XIV-5) are described below. R43, R44, and R45 are independently selected from hydrogen atom, halogen atom, cyano, substituted or unsubstituted alkyl, aryl, and heterocyclic groups, $R_{51}O-$, $R_{51}\underset{\underset{O}{\|}}{C}-$, $R_{51}\underset{\underset{O}{\|}}{C}O-$, $R_{51}SO-$, $R_{51}SO_2-$, $R_{51}SO_2NH-$, $R_{51}\underset{\underset{O}{\|}}{C}NH-$, $R_{51}NH-$, $R_{51}S-$, $R_{51}\underset{H}{N}-\underset{\underset{O}{\|}}{C}-NH-$, $R_{51}\diagup N-\underset{\underset{O}{\|}}{C}-NH-$, $R_{51}O\underset{\underset{O}{\|}}{C}NH-$
$R_{51}\diagdown$ (wherein R51 is independently selected from substituted or unsubstituted alkyl, aryl, and heterocyclic groups), silyl, silyloxy, silylamino, and imide groups. In addition to the above-listed groups, R43, R44, and R45 may be carbamoyl, sulfamoyl, ureido and sulfamoylamino groups wherein the nitrogen atom may have attached such a substituent as an alkyl, aryl, alkoxy, aryloxy, halo, sulfonamide, and acylamino group.

Preferred coupling-off groups for the 2-equivalent magenta couplers are those of general formula (I), (II), and (IV).

The substituent on the coupling-off group or on the coupler nucleus may be either a divalent group to form a dimer or a group connecting a high molecular weight backbone to the coupler nucleus.

Typical examples of the coupler nuclei of the 2-equivalent cyan couplers are described in U.S. Pat. Nos. 2,772,162; 2,895,826; 3,002,836; 3,034,892; 2,474,293; 2,423,730; 2,367,531; and 3,041,236. Preferred among these cyan couplers are phenols and naphthols. Then preferred cyan coupler residues (Cp) are those of general formulae (XV), (XVI), (XVII), and (XVIII) shown below.

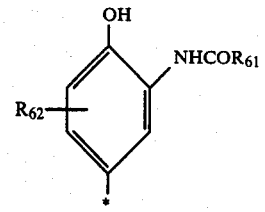

(XV)

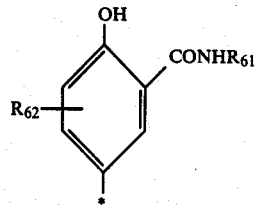

(XVI)

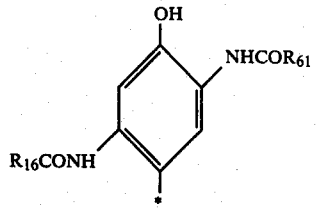

(XVII)

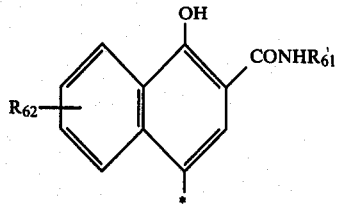

(XVIII)

In the formulae, asterisk (*) represents the position at which the coupling-off group of the 2-equivalent cyan coupler is attached. R61 represents a nondiffusing group having 8 to 32 carbon atoms in total when the coupling-off group is free of a nondiffusing group. R61 represents a hydrogen atom, a substituted or unsubstituted lower alkyl group, a substituted or unsubstituted lower alkoxy group, an aryl group, or a nondiffusing group having 8 to 32 carbon atoms in total when the coupling-off group has a nondiffusing group attached thereto (in the case of couplers as disclosed in British Pat. No. 2,083,640). R62 represents a hydrogen atom, a halogen atom or halogen atoms, a substituted or unsubstituted lower alkyl group, a substituted or unsubstituted lower alkoxy group, or a nondiffusing group having 8 to 32 carbon atoms in total. When more than one R62 is present, they may be the same or different.

The preferred coupling-off groups for the 2-equivalent cyan couplers are those of general formula (I), (II), and (IV).

The substituent on the coupling-off group or on the coupler nucleus may be either a divalent group to form a dimer or a group connecting a high molecular weight backbone to the coupler nucleus.

In the foregoing couplers, the nondiffusing groups may be those illustrated in the following patent publications.

| Japanese Patent Application Kokai Nos. | | |
|---|---|---|
| 47-4481 | 47-37636 | 48-71640 |

-continued
| | | |
|---|---|---|
| 49-8228 | 49-29639 | 49-53437 |
| 49-110344 | 50-19435 | 50-20723 |
| 50-48922 | 50-134644 | 51-126831 |
| 52-47728 | 52-119323 | 53-76834 |
| 53-82411 | 53-141622 | 55-7702 |
| 55-38599 | 55-93153 | 56-30126 |
| 59-45442 | 59-124341 | 59-174836 |
| 59-177553 | 59-177554 | 59-177555 |
| 59-177556 | 59-177557 | 60-41042 |
| 60-55340 | 60-185951 | |
Japanese Patent Publication Nos.
| | | |
|---|---|---|
| 42-23902 | 43-16190 | 43-22900 |
| 43-29417 | 44-3660 | 44-6992 |
| 45-41474 | 46-19025 | 46-19026 |
| 46-19032 | 47-9314 | 48-25932 |
| 49-16056 | 59-46384 | |
-continued
U.S. Pat. Nos.
| | | |
|---|---|---|
| 2,186,719 | 2,688,544 | 2,698,795 |
| 2,772,161 | 2,895,826 | 2,908,573 |
| 2,920,961 | 3,133,815 | 3,161,512 |
| 3,183,095 | 3,285,747 | 3,488,193 |
| 3,519,429 | 3,547,944 | 4,124,396 |
| 4,443,536 | 4,458,011 | |
German Offenlegungsschrift No. 2,707,488
French Pat. No. 1,202,940
British Pat. No. 1,128,037
Examples of the 2-equivalent couplers are illustrated below.
Two equivalent yellow couplers
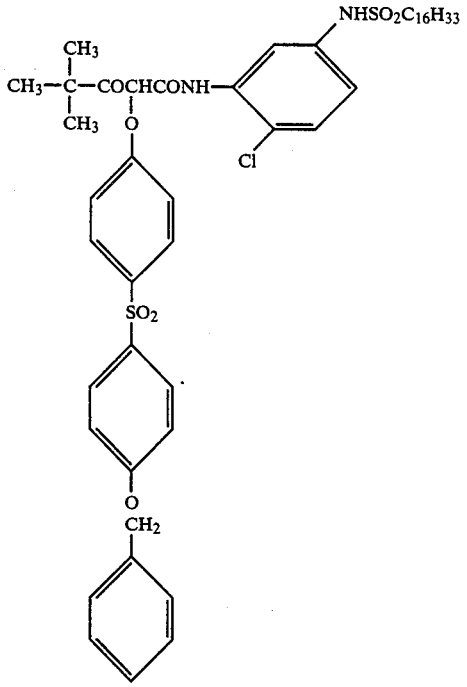
Y-1
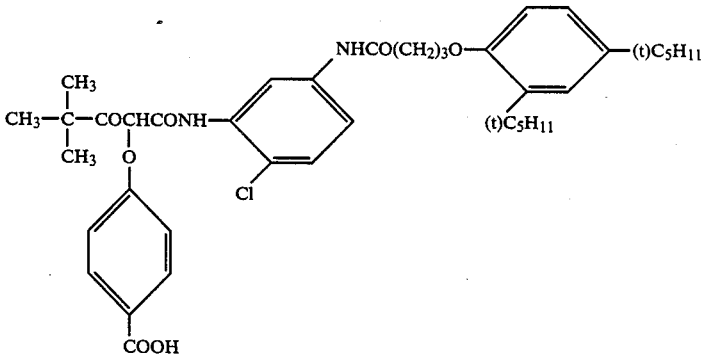
Y-2

-continued
Y-3
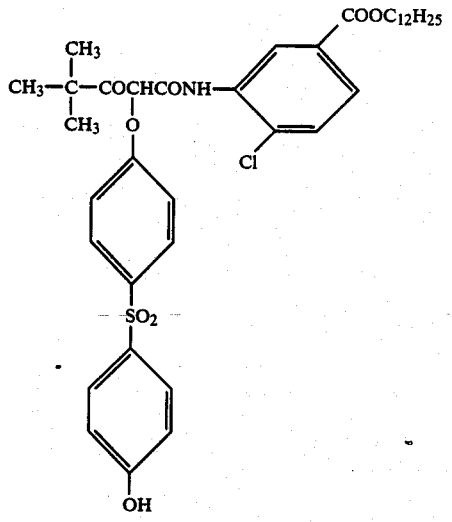
Y-4
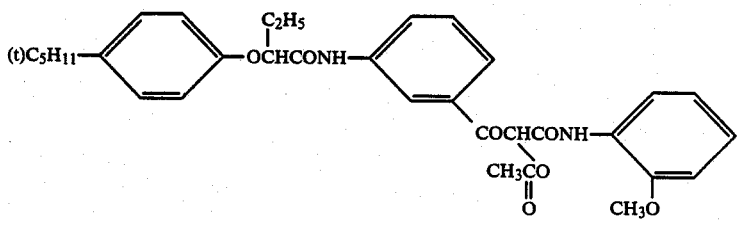
Y-5
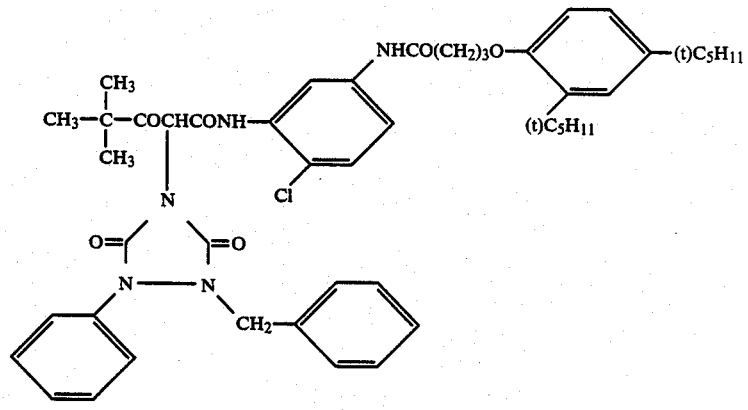
Y-6
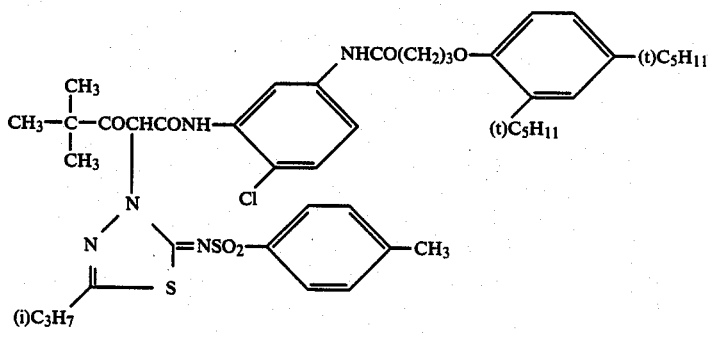

-continued
Y-7
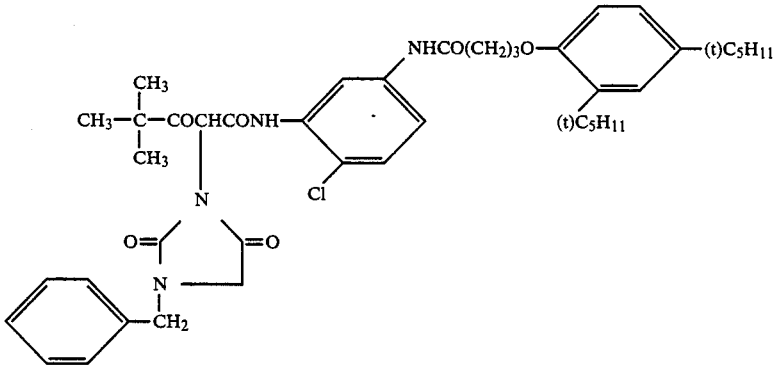
Y-8
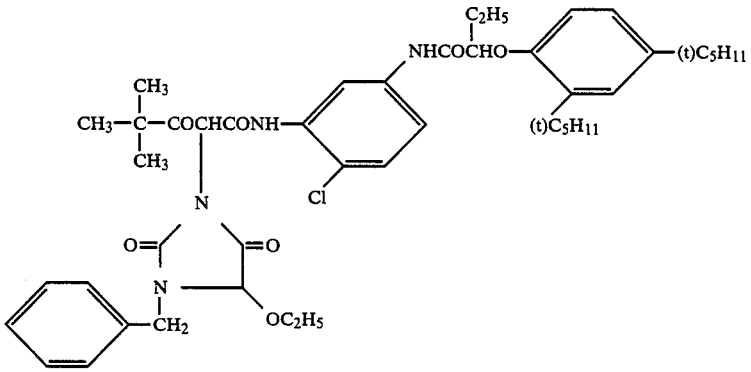
Y-9
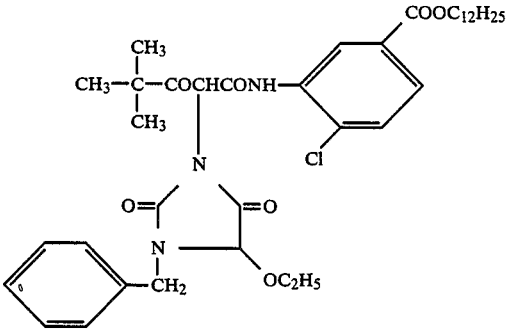
Y-10
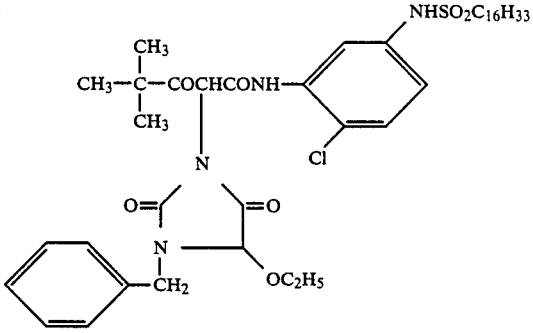
Y-11
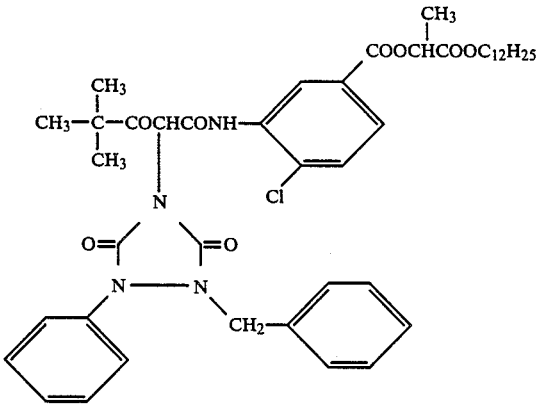

-continued
Y-12
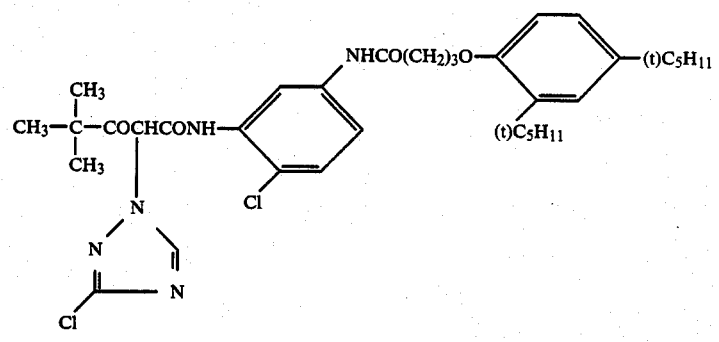
Y-13
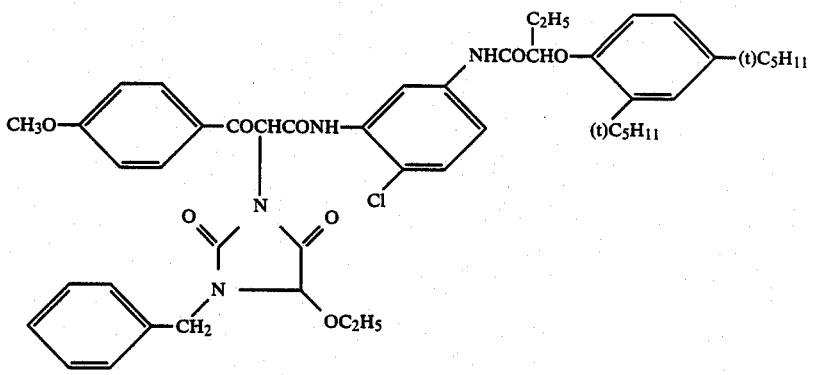
Y-14
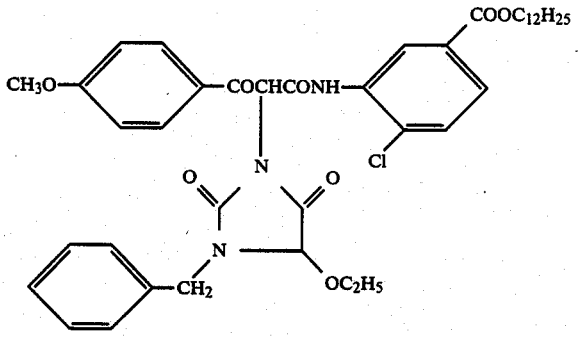
Y-15
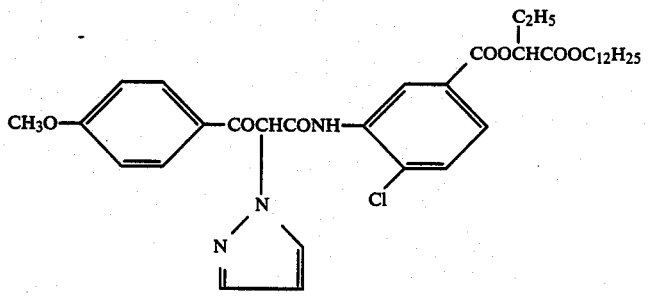
Y-16
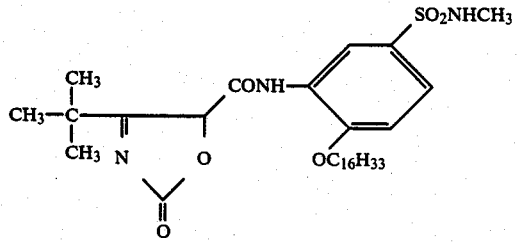

-continued
Y-17
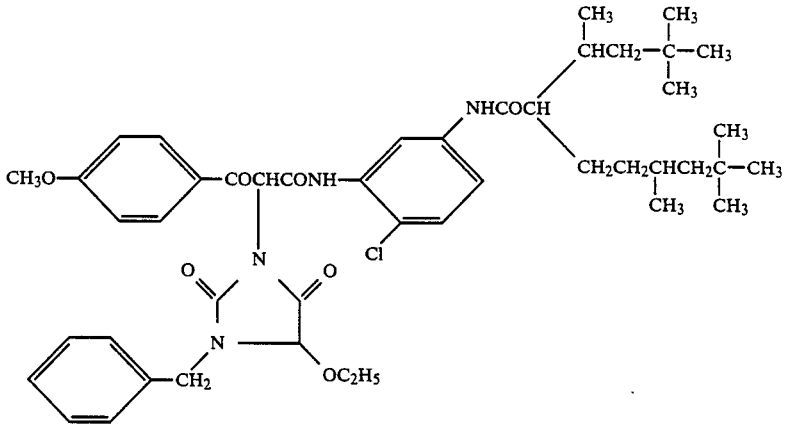
Y-18
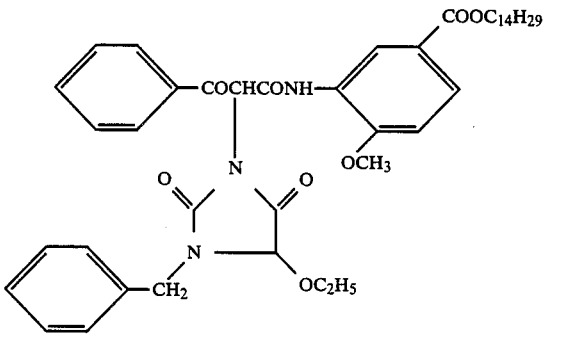
Y-19
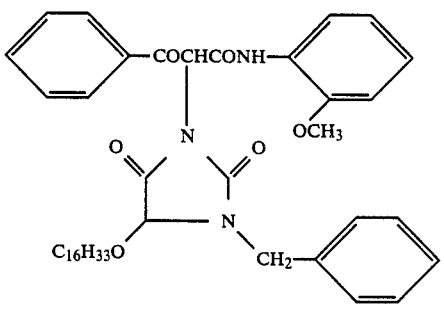
Y-20
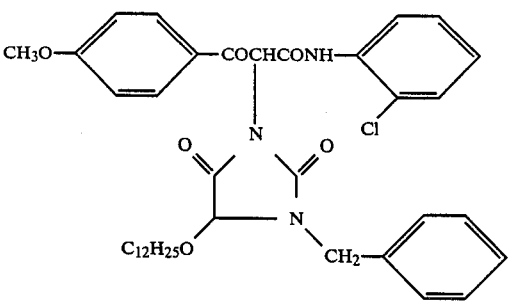
Y-21
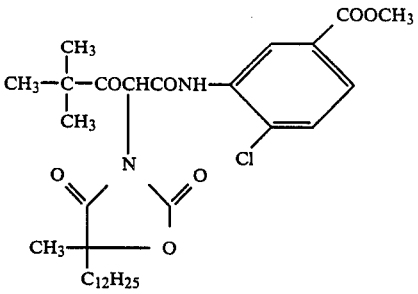
Y-22
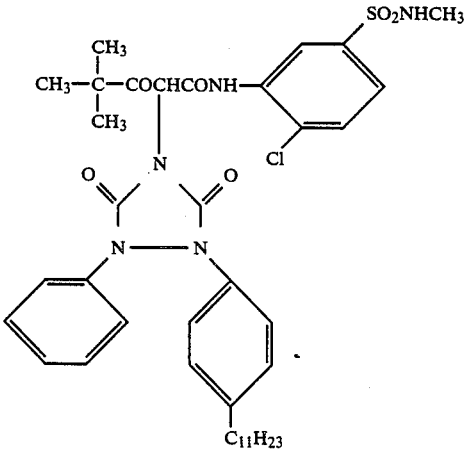

-continued
Y-23
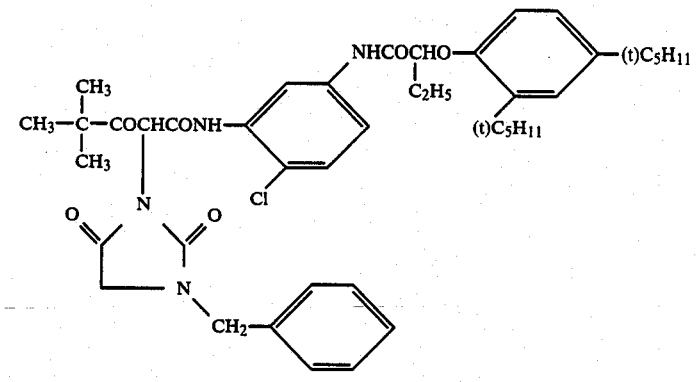
Y-24
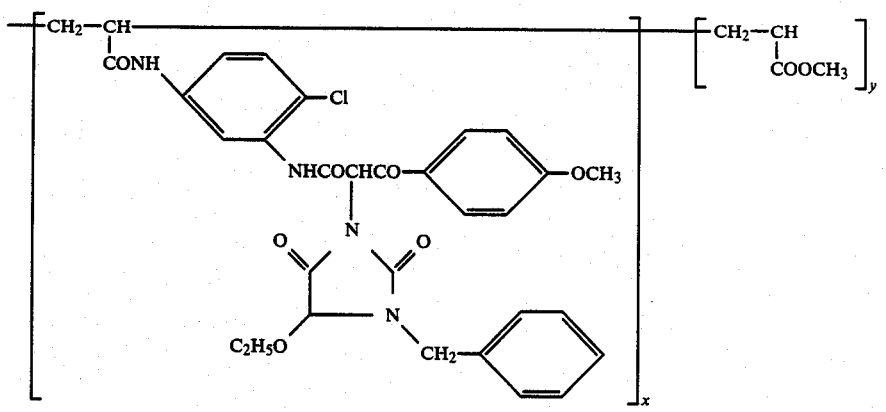
x:y = 30:70
Y-25
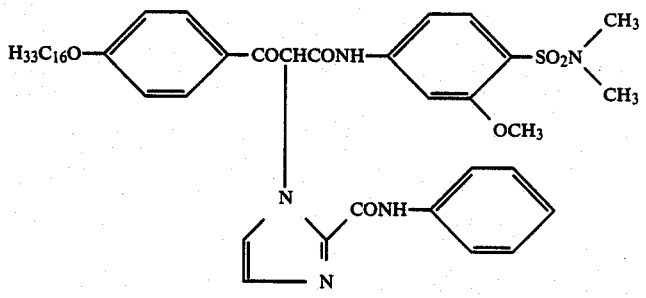
Y-26
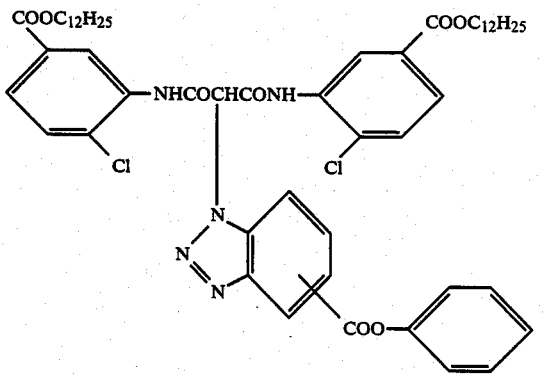

-continued
Y-27
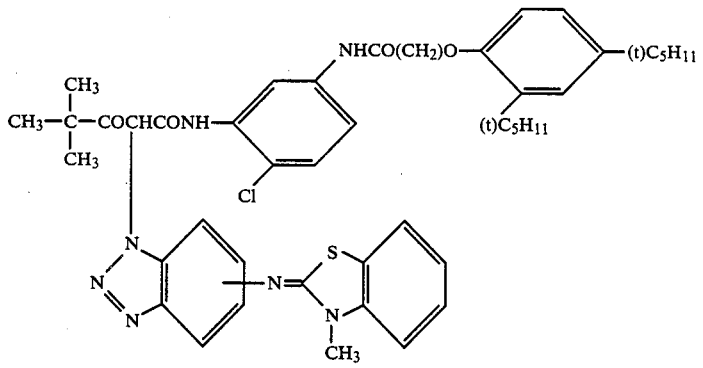
Y-28
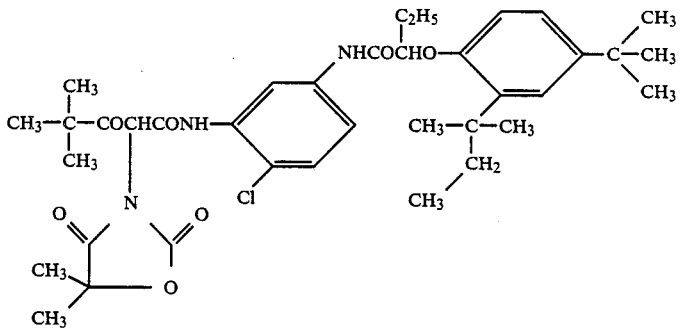
Two equivalent magenta couplers
M-1
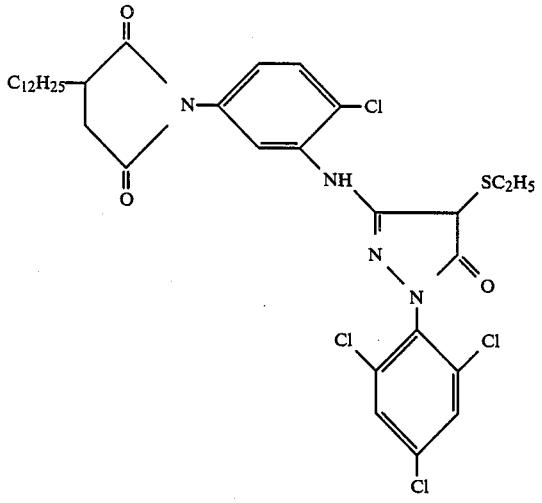

-continued
M-2
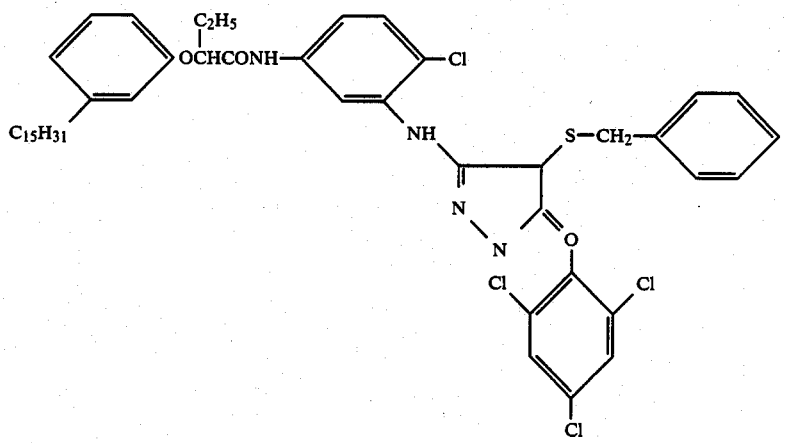
M-3
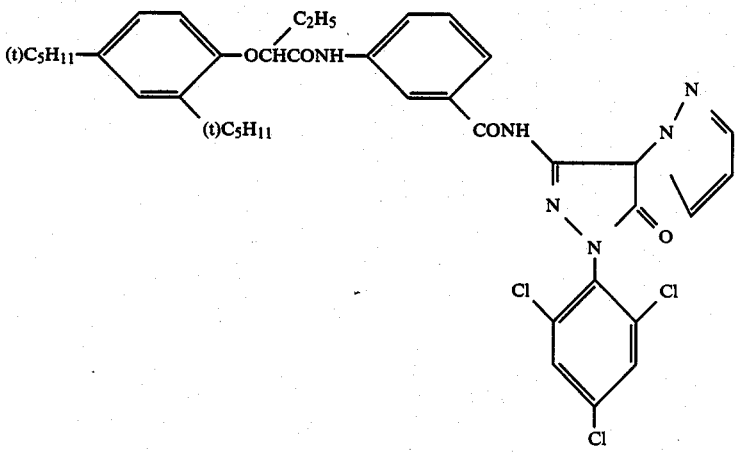
M-4
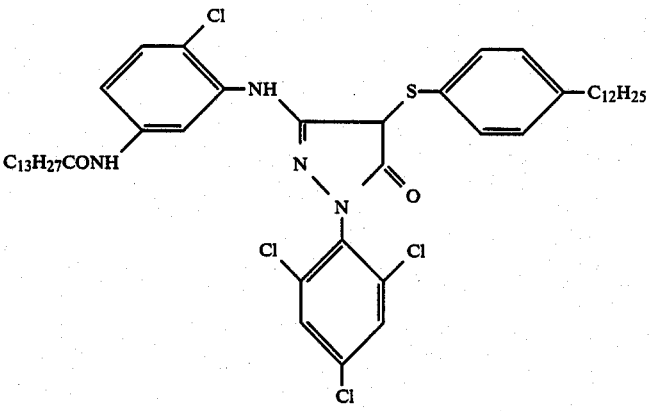
M-5
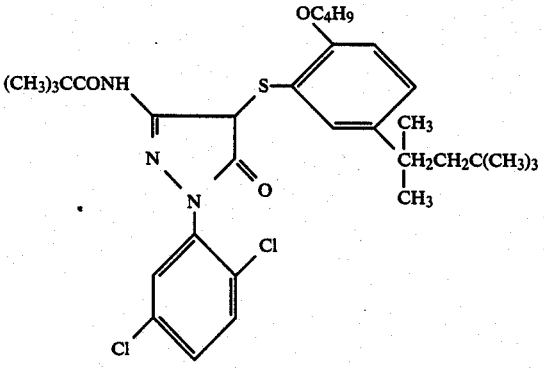

-continued
M-6
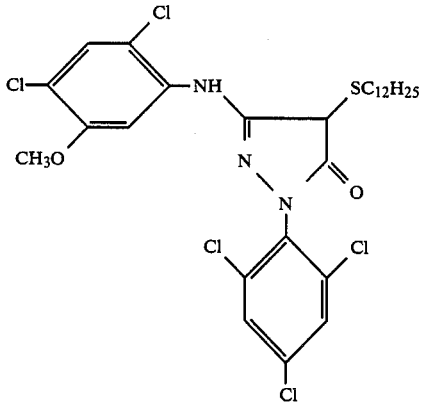
M-7
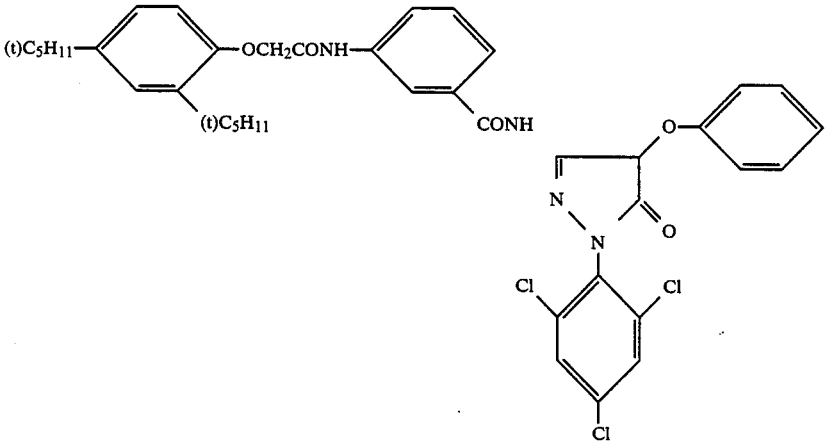
M-8
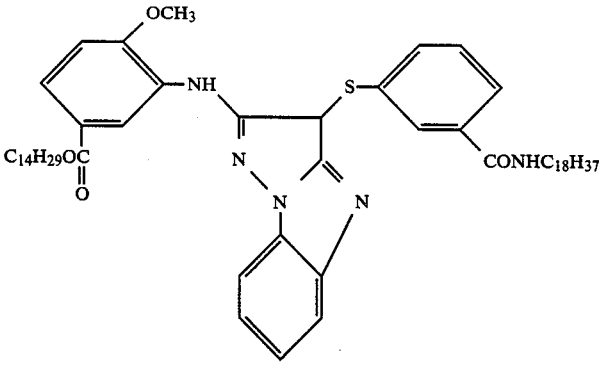
M-9
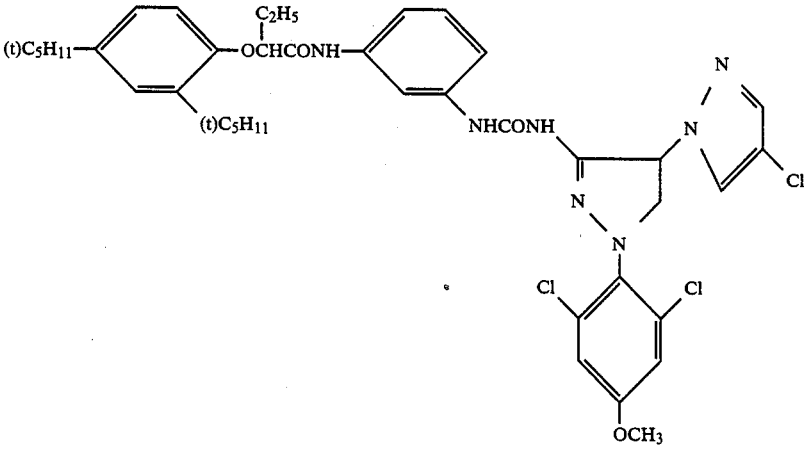

-continued
M-10
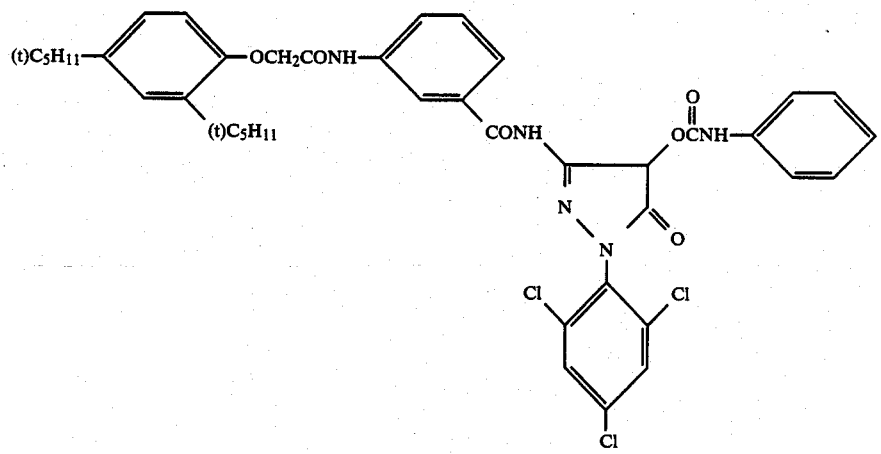
M-11
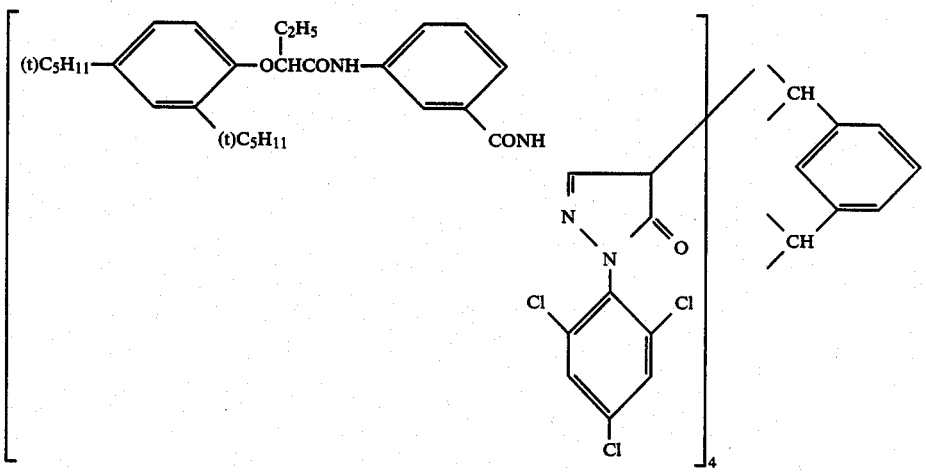
M-12
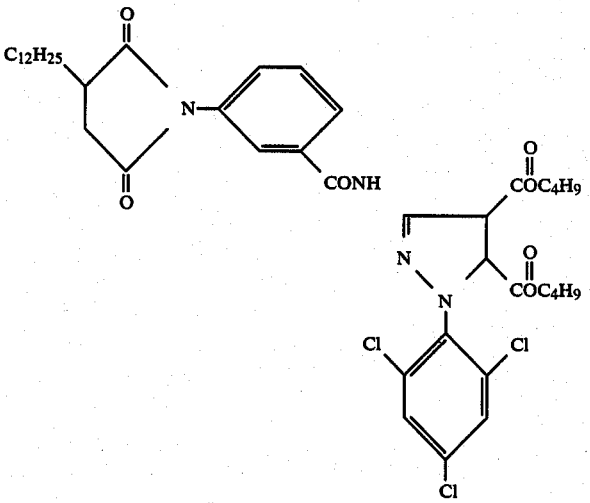

-continued
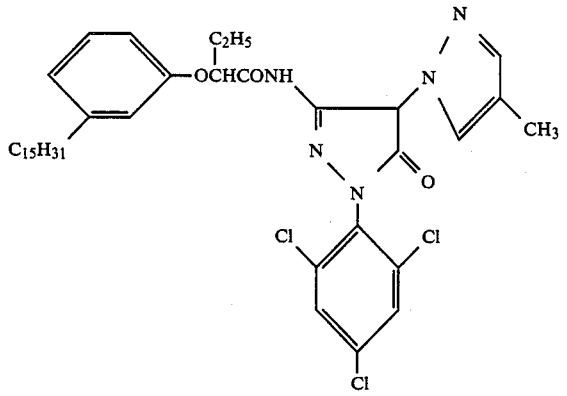
M-13
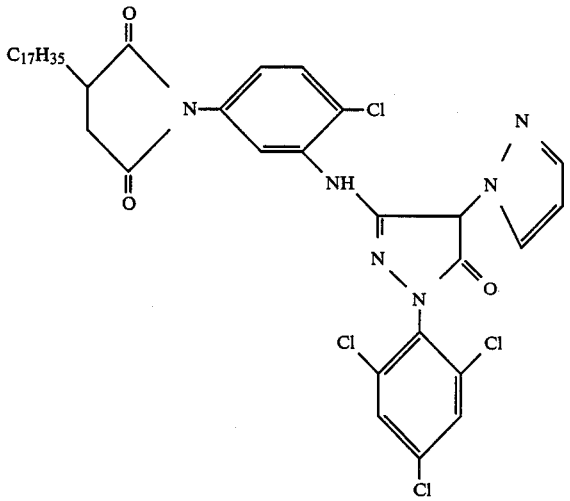
M-14
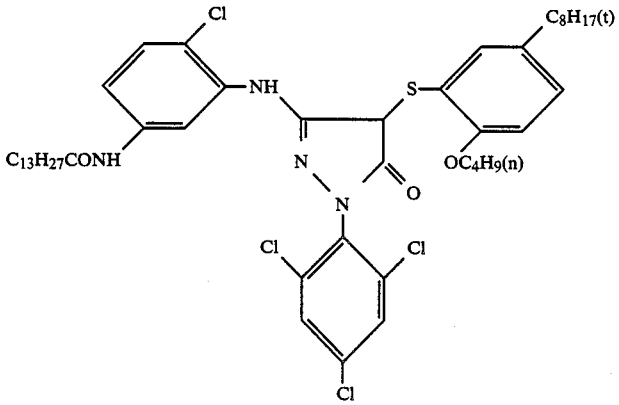
M-15

-continued
M-16
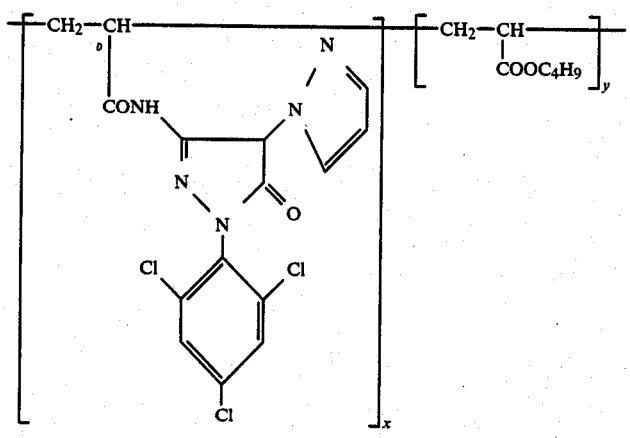
x:y = 45:55
M-17
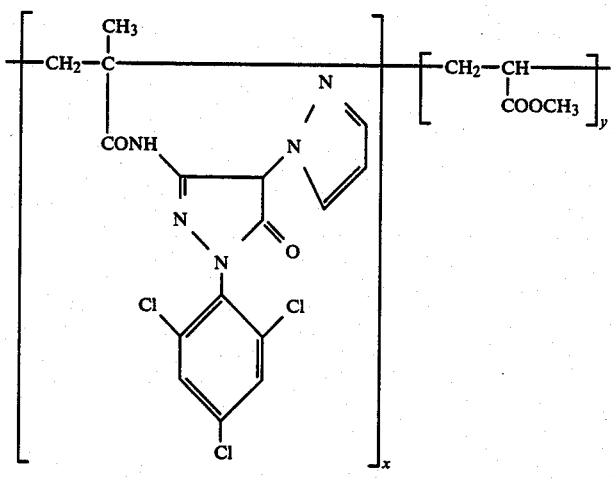
x:y = 50:50
M-18
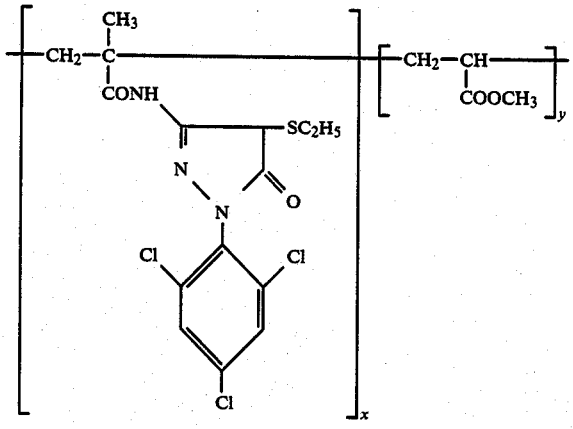
x:y = 30:70

-continued
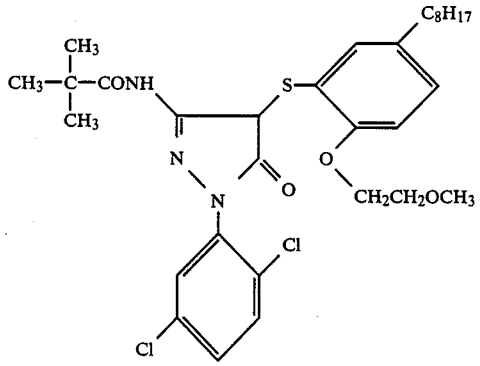
M-19
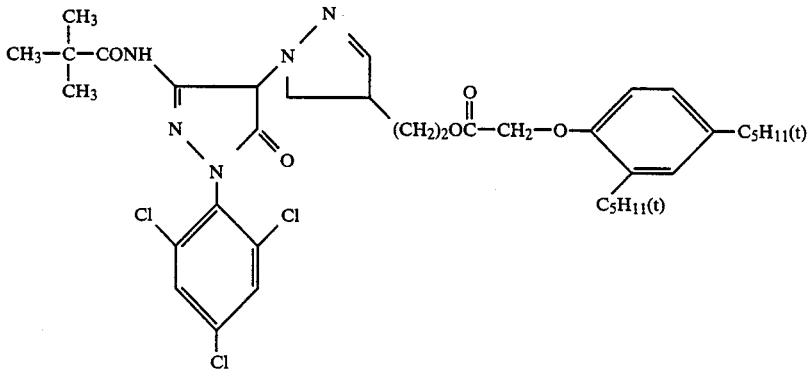
M-20
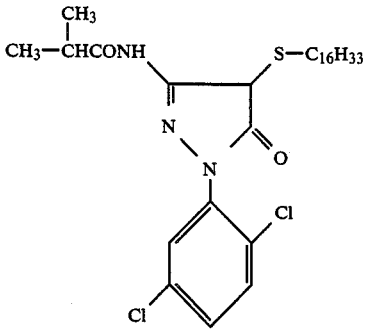
M-21
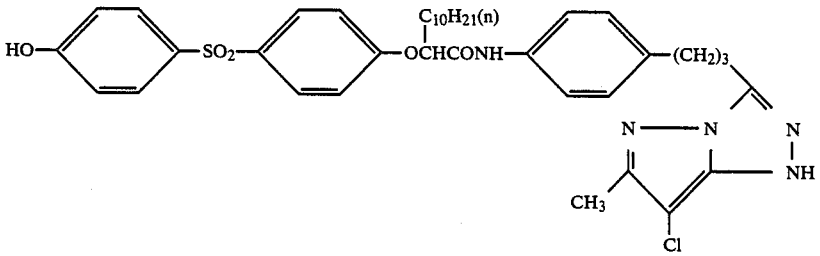
M-22

-continued
M-23
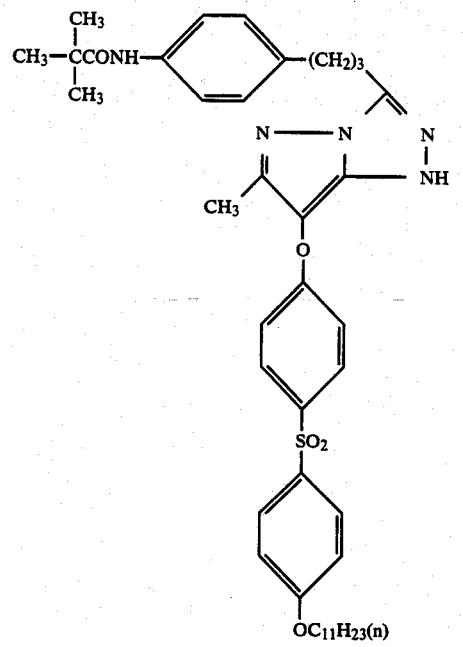
M-24
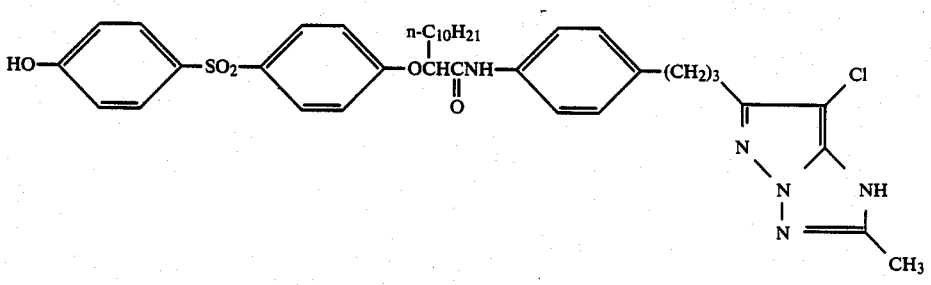
M-25
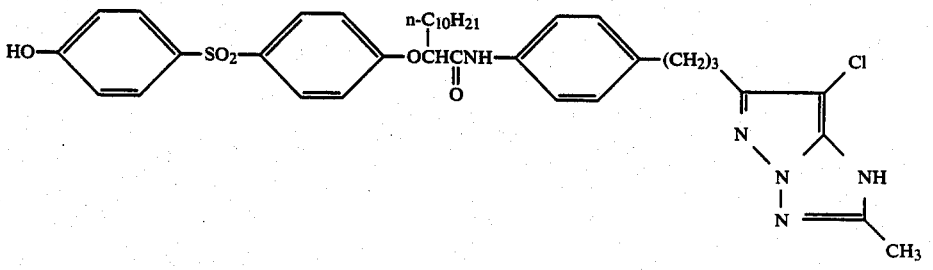
M-26
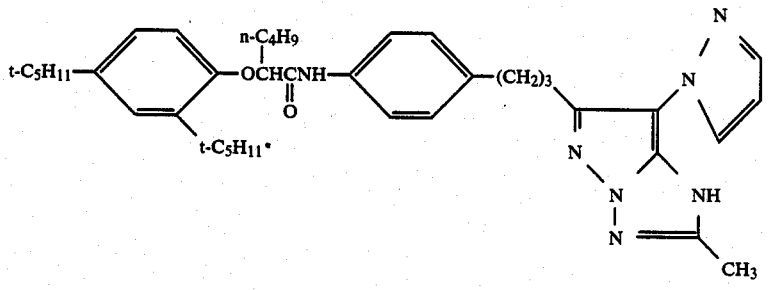

-continued
M-27
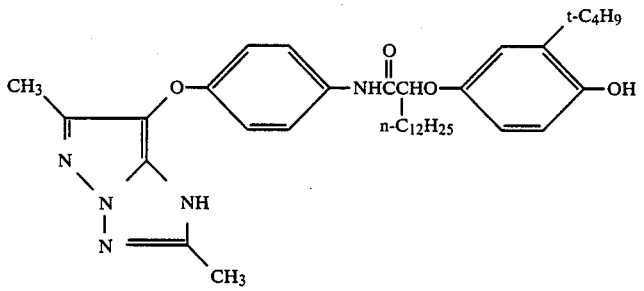
M-28
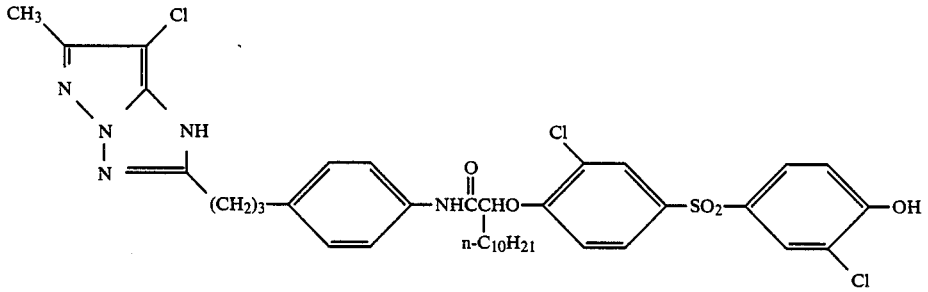
M-29
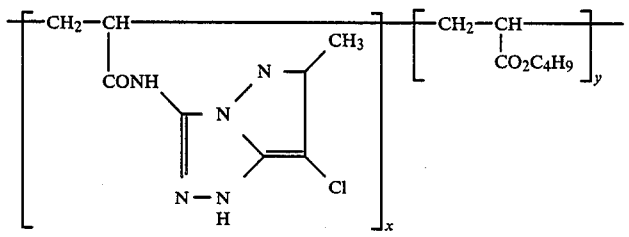
x:y = 50:50
M-30
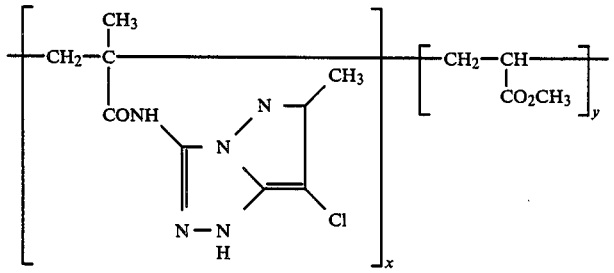
x:y = 40:60
M-31
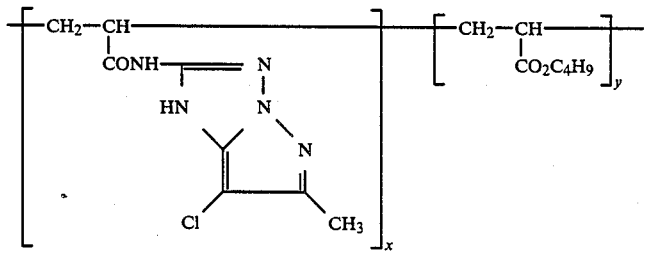
x:y = 50:50

-continued
M-32
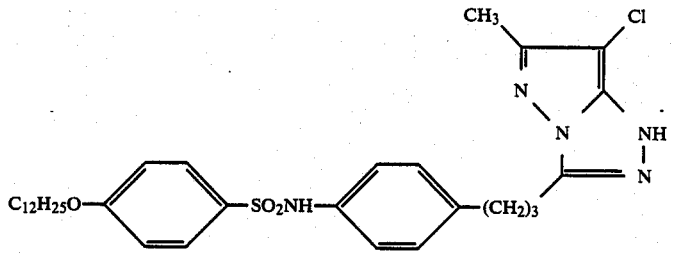
M-33
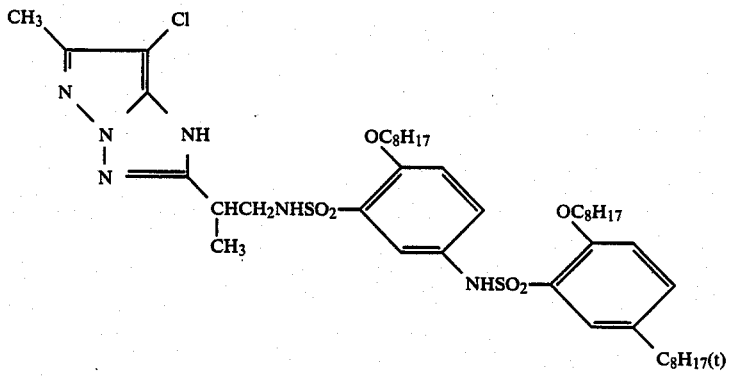
M-34
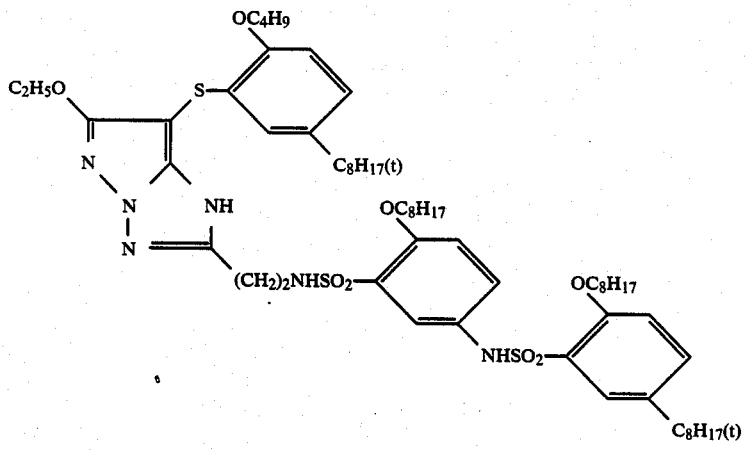
M-35
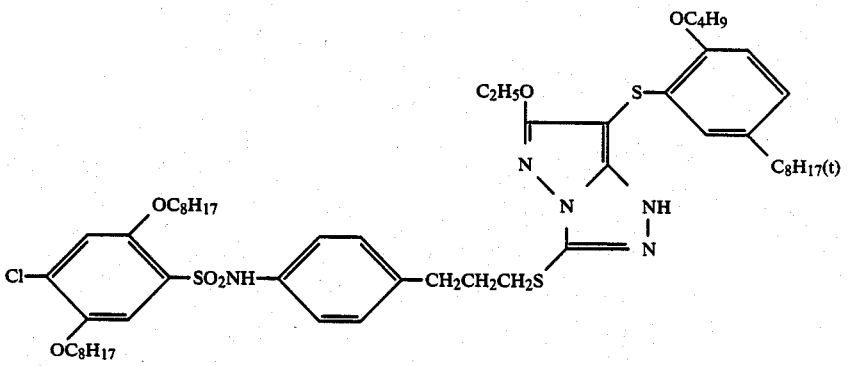

-continued
M-36
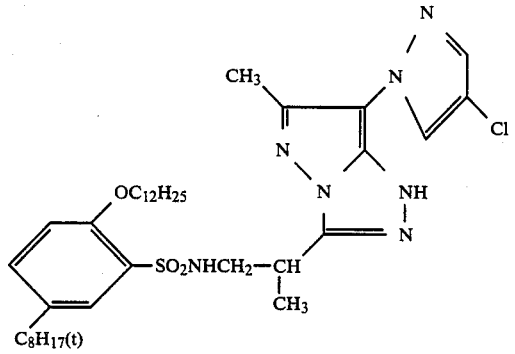
M-37
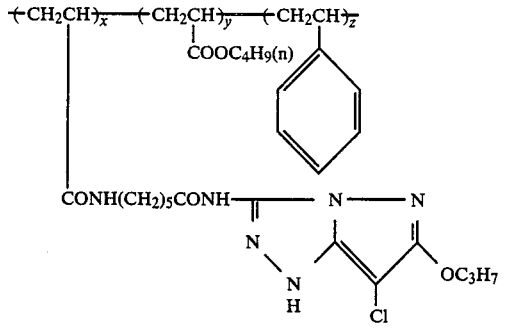
x/y/z = 45/50/5
M-38
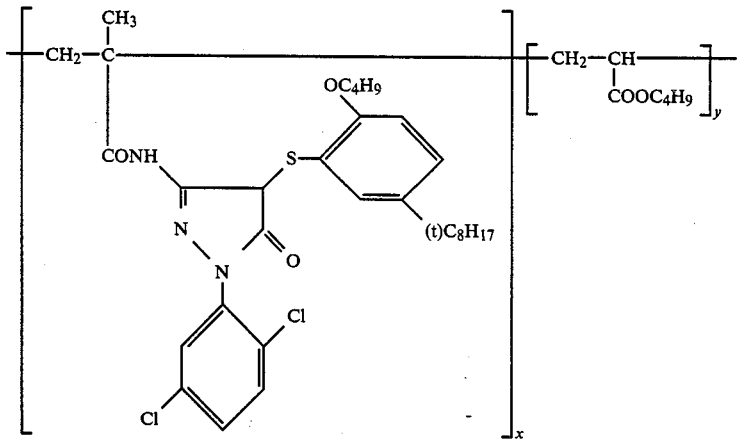
x/y = 50/50
M-39
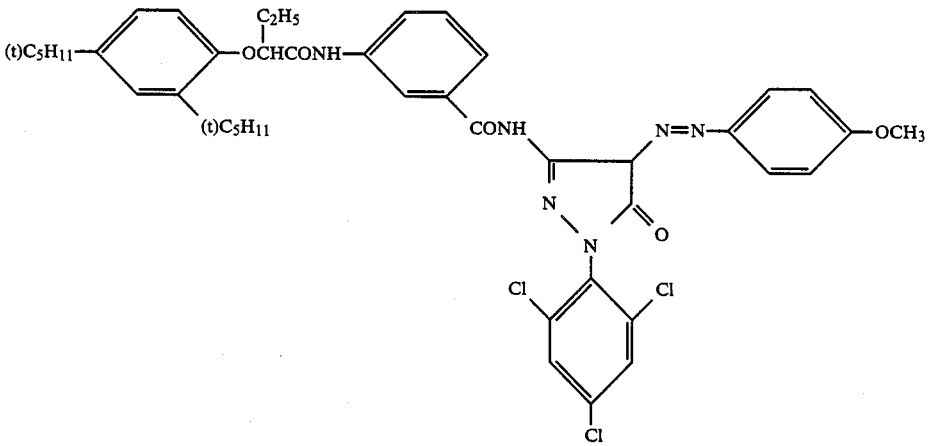

-continued
M-40
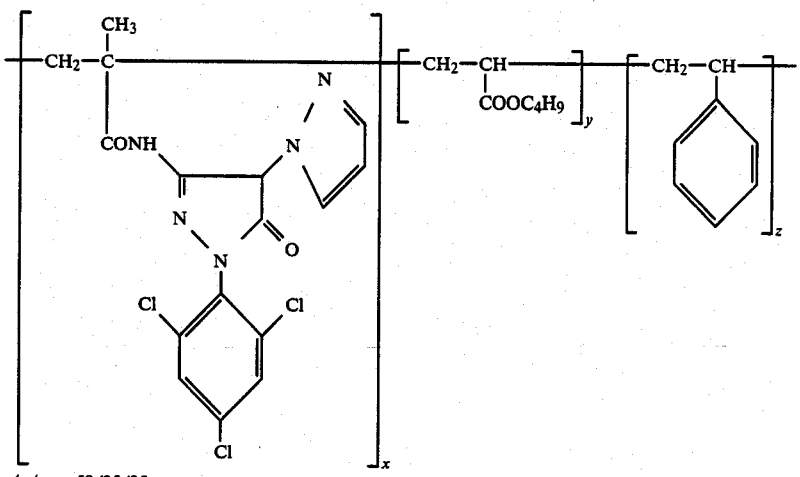
x/y/z = 50/25/25
M-41
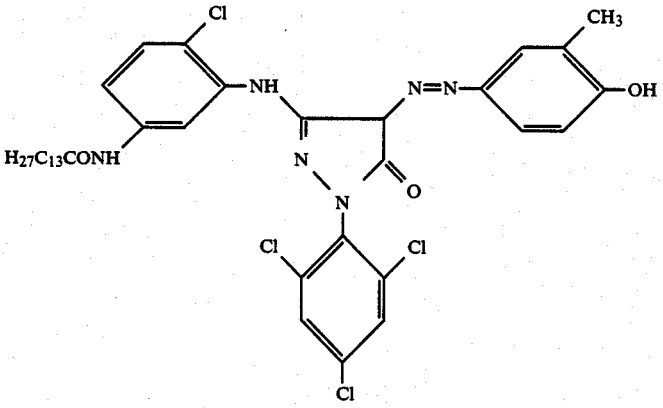
Two equivalent cyan couplers
C-1
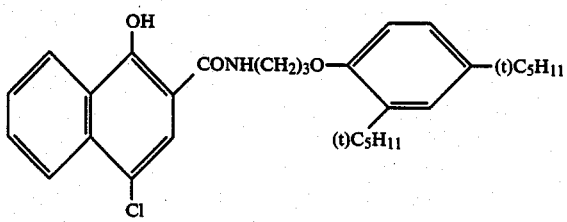
C-2
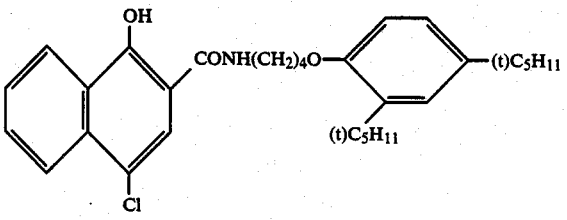
C-3
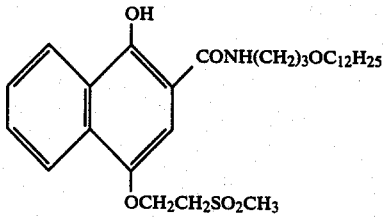
C-4
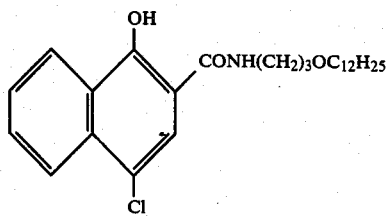

-continued
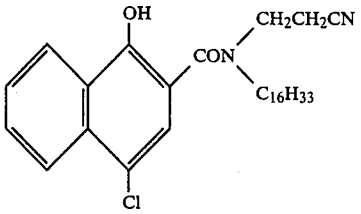
C-5
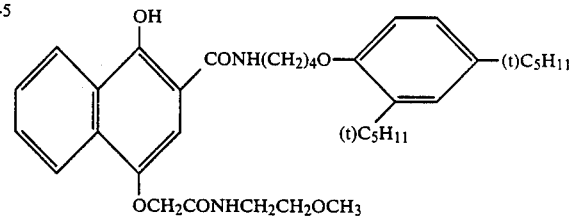
C-6
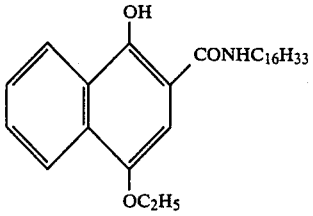
C-7
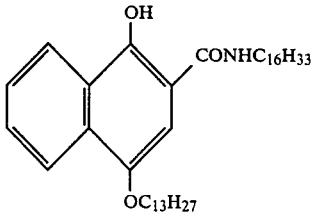
C-8
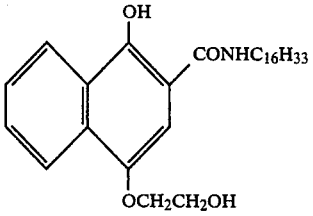
C-9
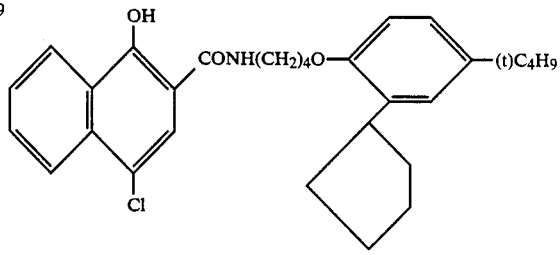
C-10
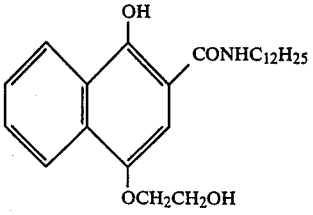
C-11
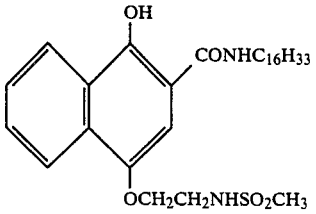
C-12
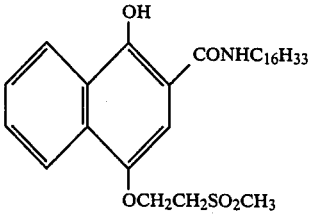
C-13
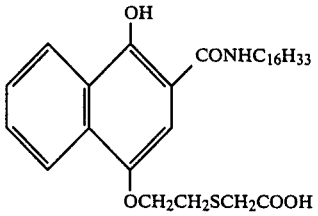
C-14
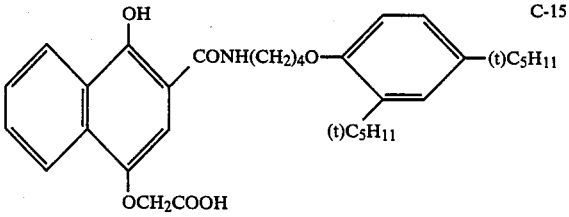
C-15
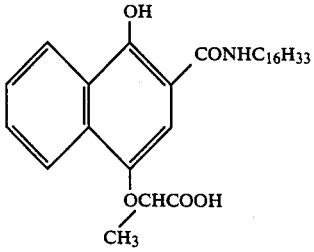
C-16
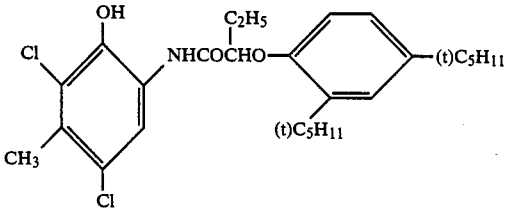
C-17

-continued
C-18
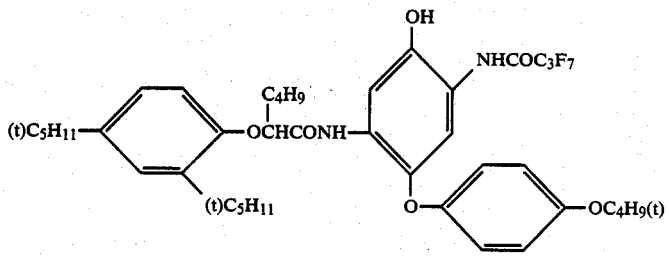
C-19
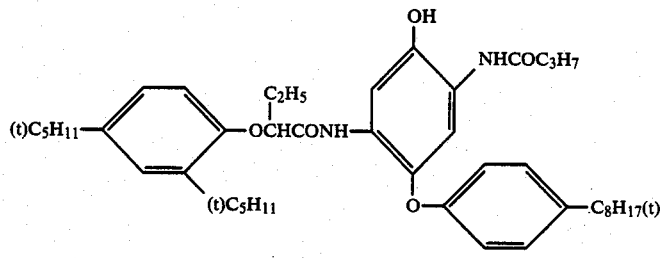
C-20
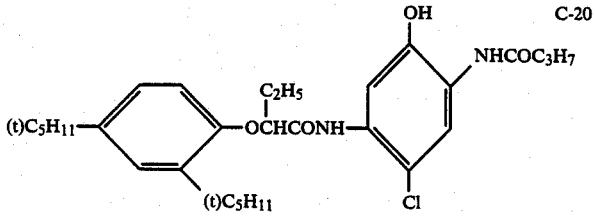
C-21
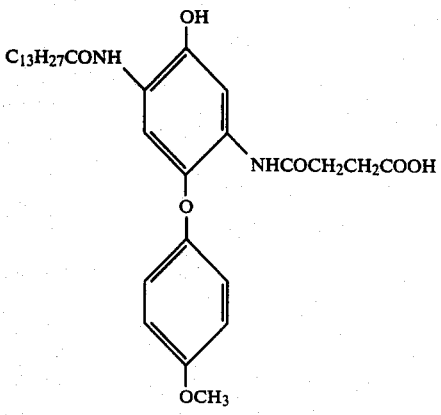
C-22
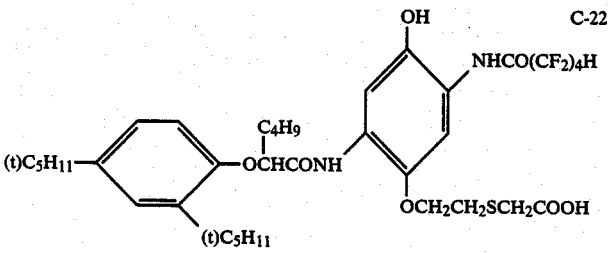
C-23
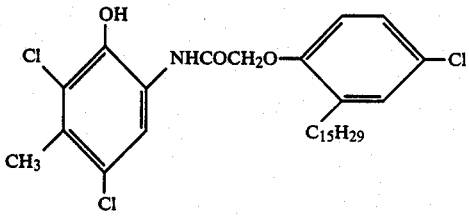
C-24
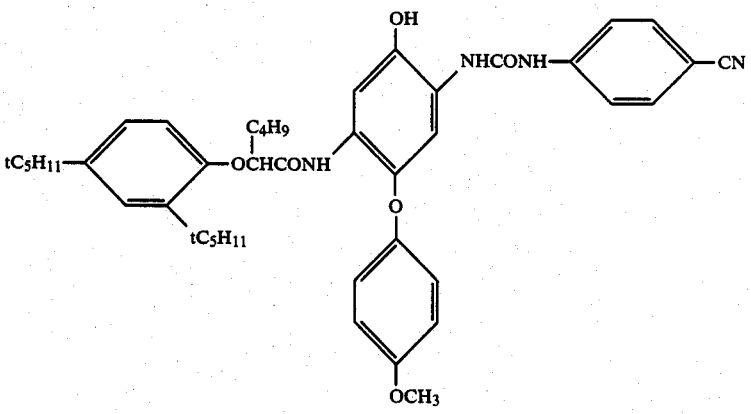

-continued
C-25
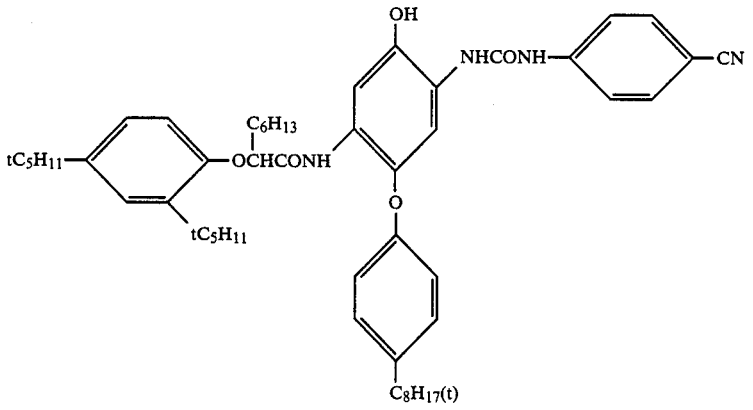
C-26
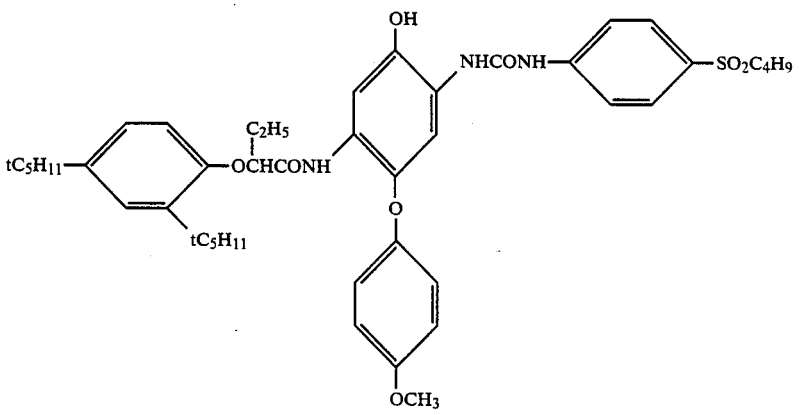
C-27
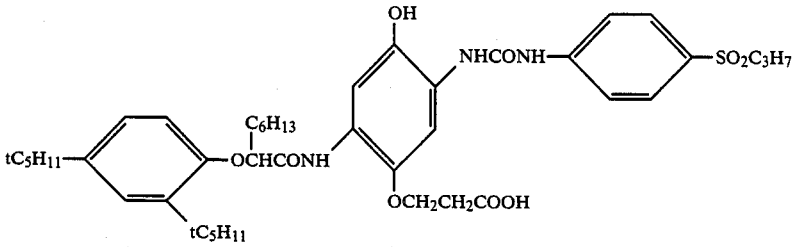
C-28
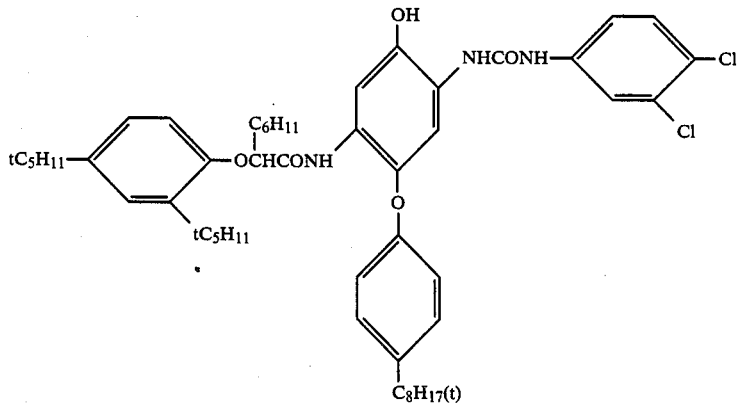

-continued
C-29
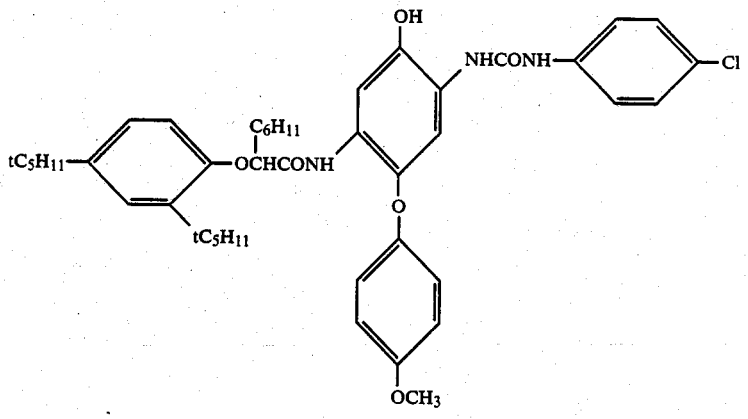
C-30
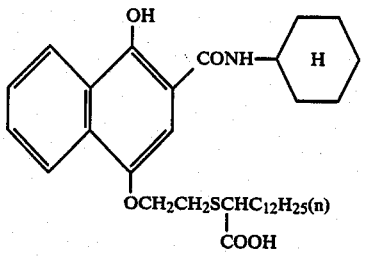
C-31
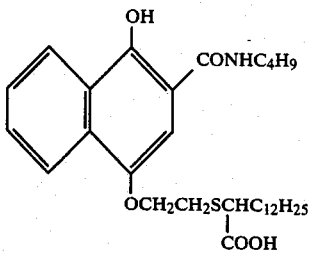
C-32
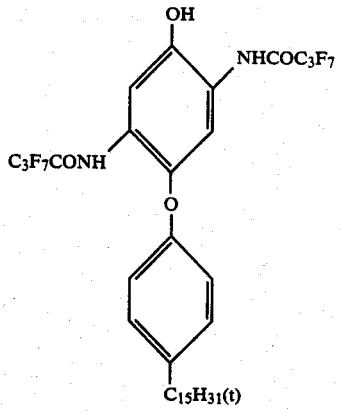
C-33
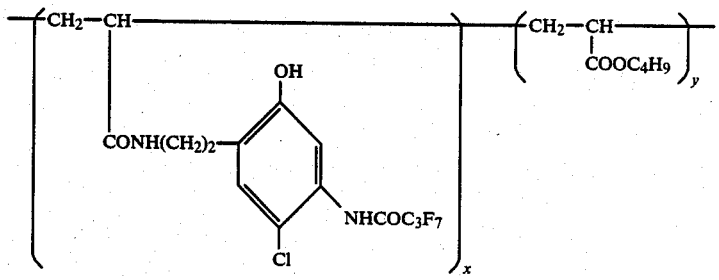
x:y = 40:60
C-34
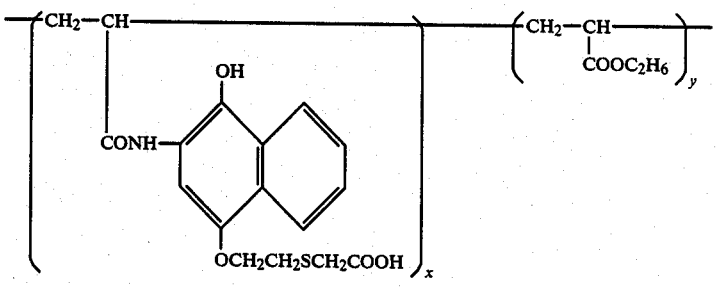

-continued
x:y = 45:55
C-35
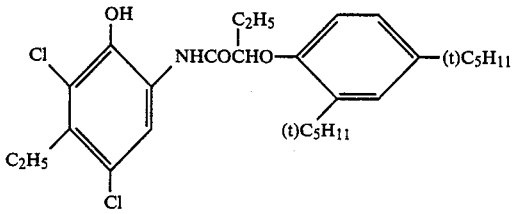
C-36
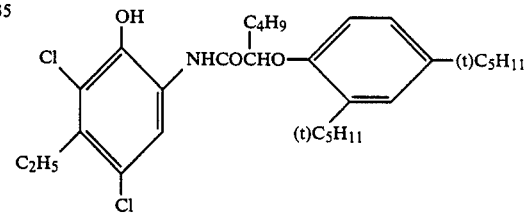
C-37
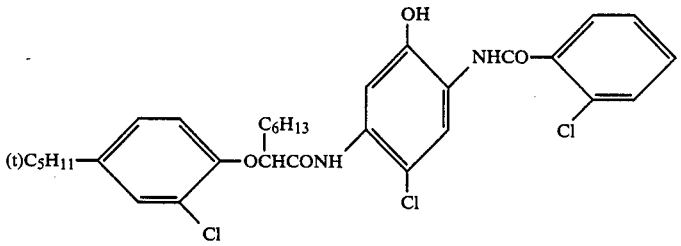
C-38
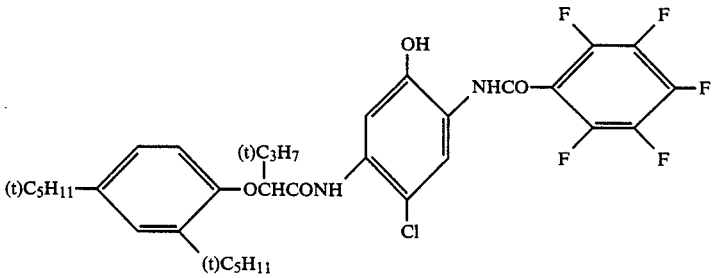
C-39
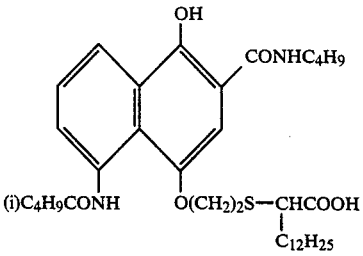
C-40
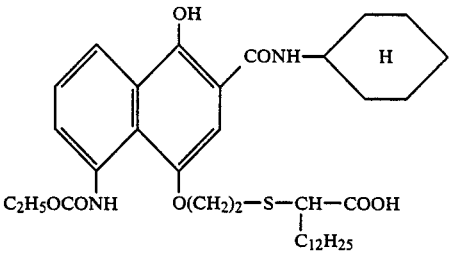
C-41
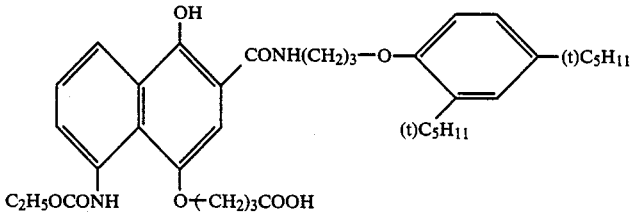
C-42
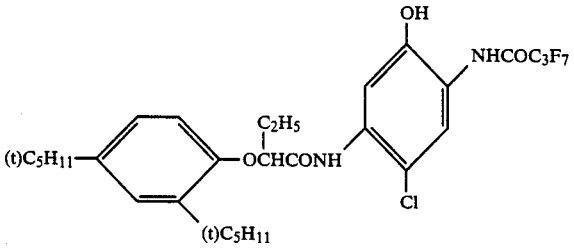

-continued

C-43

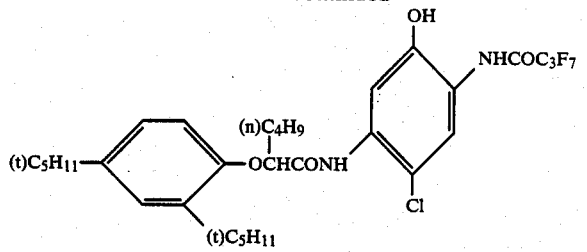

C-44

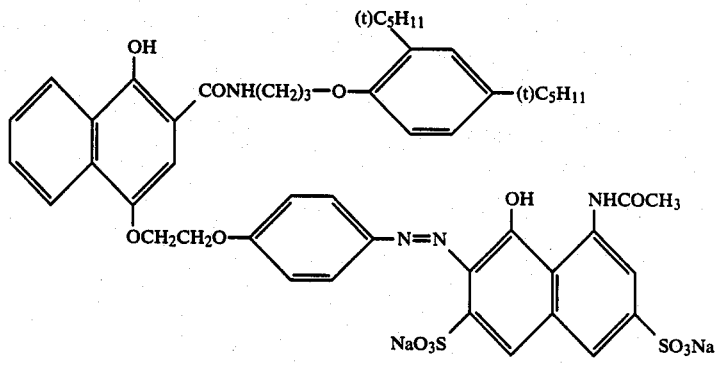

C-45

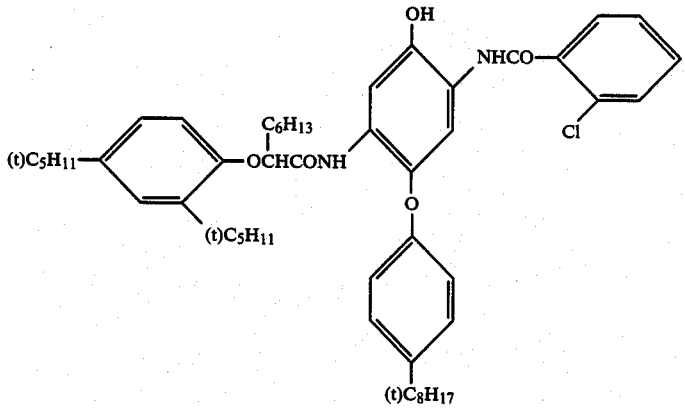

The processing solution which contains the complexing compound according to the present invention may be a mother liquid to be first admitted into a developing tank and/or a reprenisher.

In the practice of the present invention, a color developing solution is used in the development of a photosensitive material.

The color developing solution is preferably an aqueous solution containing an aromatic primary amine color developing agent as a main active ingredient. Preferred color developing agents are p-phenylenediamines although aminophenols are also useful. Typical of the p-phenylenediamine color developing agents are 3-methyl-4-amino-N,N-diethylaniline, 3-methyl-4-amino-N-ethyl-N-β-hydroxyethylaniline, 3-methyl-4-amino-N-ethyl-N-β-methanesulfonamide ethylaniline, 3-methyl-4-amino-N-ethyl-N-β-methoxyethylaniline, and their salts with sulfuric acid, hydrochloric acid, phosphoric acid, p-toluenesulfonic acid, tetraphenylboric acid, p-(tert.-octyl)benzenesulfonic acid, etc. These diamine salts are preferred because they are generally more stable than in free form.

Typical of the aminophenol color developing agents are o-aminophenyl, p-aminophenol, 4-amino-2-methylphenol, 2-amino-3-methylphenol, 2-oxy-3-amino-1,4-dimethylbenzene, etc.

Also useful are those color developing agents disclosed in L. F. A. Mason, "Photographic Processing Chemistry", Focal Press (1966), pages 226–229, U.S. Pat. Nos. 2,193,015 and 2,592,364, Japanese Patent Application Kokai No. 48-64933 and the like. More than one color developing agent may be used in combination if desired.

The developing agent is generally employed at a concentration of about 0.1 to about 30 grams per liter of the developing solution, preferably at a concentration of about 1 to about 15 grams per liter of the developing solution. The developing solution is used in the present invention at a pH of about 5 to about 13, desirably about 6 to about 11. A pH buffer agent if any may be present at a low concentration, but it may be absent.

The development of a color reversal photosensitive material generally involves black-and-white development followed by color development. Then, the complexing compound may be added to a black-and-white developing solution and/or a color developing solution.

The developing solution used in the practice of the present invention may further contain any of known compounds commonly employed in conventional developing solutions. For example, caustic soda, caustic potash, sodium carbonate, potassium carbonate, sodium tertiary phosphate, potassium secondary phosphate, potassium metaborate, borax, and the like may be used alone or in combination as an alkaline agent also serving as a pH buffer agent. Also various salts are used for the purposes of imparting buffering ability or increasing ionic strength, or for convenience of preparation, for example, disodium or dipotassium hydrogen phosphate, sodium or potassium dihydrogen phosphate, sodium or potassium bicarbonate, boric acid, alkali nitrates, and alkali sulfates.

Further, the developing solution may contain any desired chelating agent in order to prevent precipitation of calcium or magnesium. Examples of the chelating agents are polyphosphoric acid salts, aminopolycarboxylic acid salts, phosphonocarboxylic acid salts, aminopolyphosphonic acid salts, and 1-hydroxyalkylidene-1,1-diphosphonic acid salts.

Any suitable development accelerators may be added to the developing solution, if necessary. Useful development accelerators are, for example, various pyrimidium compounds and other cationic compounds as typified in U.S. Pat. Nos. 2,648,604 and 3,171,247 and Japanese Patent Publication No. 44-9503; cationic dyes such as phenosafranine; neutral salts such as thallium nitrate and potassium nitrate; polyethylene glycol and derivatives thereof as disclosed in Japanese Patent Publication No. 44-9304 and U.S. Pat. Nos. 2,533,990, 2,531,832, 2,950,970, and 2,577,127; nonionic compounds such as polythioethers; benzyl alcohol; thioethers as disclosed in U.S. Pat. No. 3,201,242; and amines as disclosed in Japanese Patent Application Kokai Nos. 56-106244 and 54-3532.

Among others, the process for accelerating color development by adding benzyl alcohol to a color developing solution is widely used in the current processing of photographic color photosensitive material, especially color paper because of the enhanced color development acceleration. The use of benzyl alcohol, which is less soluble in water, requires a solvent like diethylene glycol and triethylene glycol. Since these compounds including benzyl alcohol, however, have high values of biological oxygen demand (BOD) and chemical oxygen demand (COD) regarded as standard requirements for environmental pollution control, it is desired to remove the benzyl alcohol for the purpose of mitigating the burden of pollution control. Removal of a benzyl alcohol development accelerator and reduced duration of developing time will naturally result in a substantial loss of developed color density.

Unexpectedly, by utilizing the base generating mechanism of the present invention, images with a sufficient density can be formed within a short time even with a developing solution free of any development accelerators of the organic solvent type like benzyl alcohol or containing a minimized amount of such development accelerators if present.

In the practice of the present invention, the developing solution may contain any conventional preservatives such as sodium sulfite, potassium sulfite, sodium bisulfite and potassium bisulfite.

The developing solution may contain any suitable antifoggants, if necessary. Exemplary antifoggants are alkali metal halides such as potassium bromide, sodium bromide, and potassium iodide as well as organic antifoggants. Examples of the organic antifoggants include nitrogeneous heterocycles such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, and hydroxyazaindolizine; mercapto-substituted heterocycles such as 1-phenyl-5-mercaptotetrazole, 2-mercaptobenzimidazole, and 2-mercaptobenzothiazole; and mercapto-substituted aromatic compounds such as thiosalicylic acid. Among them, the nitrogeneous heterocycles are most preferred. The antifoggants may be dissolved out of the photosensitive materials during the development and accumulated in the developing solutions.

The replenisher solution may contain any ingredients similar to those in the developing solution, inter alia, developing agents, complexing compounds as previously defined, antifoggants, and preservatives. Alkaline agents may be added in small amounts, if necessary.

In the practice of the present invention, the developing replenisher may have a wide pH range, generally pH 6 to 13, preferably pH 6 to 11, and more preferably pH 7 to 10.

The developing replenisher may contain the developing agent at a concentration which may be as high as the solubility limit of the agent at the particular pH of the replenisher. For example, 3-methyl-4-amino-N-ethyl-N-hydroxymethylaniline having a high solubility at a low pH level may be added to a replenisher at a concentration in excess of 100 gram/liter at pH 7. Developing solutions may contain about 1 to 50 grams per liter, which is approximately 1 to 10 times the currently available concentration.

When the complexing compound is contained in the developing replenisher, a conventionally used alkaline agent such as $K_2CO_3$, $Na_2CO_3$ and $K_3PO_4$ may be eliminated to lower the ionic strength of the solution. Then the developing agent may be present in the solution at a higher concentration, ensuring preparation of a highly concentrate developing replenisher which may be supplied in a smaller amount at one replenishment. Therefore, the present invention is amenable to a replenisher which is supplied only in a volume corresponding to a loss (reduced volume) of the processing solution in a processing tank without overflow, that is, a loss replenisher.

To enable loss replenishment, the developing agent and other agents must be present at high concentrations, which are difficult to accomplish in an aqueous solution having a high ionic strength. Conversely, the process of the present invention substantially loosens the restrictions on the pH and ionic strength of the replenisher so that the concentration of the developing agent can be increased. The process of the present invention allows for selection of a low pH level at which air oxidation of the developing agent does not proceed, offerring a great benefit in the loss replenishment process.

In the practice of the present invention, the processing solution may be used at any temperature, preferably at 10° C. to 50° C.

The present invention may be applied to an activator treatment. The activator solution may contain some or all of the above-mentioned ingredients of the developing solution other than the developing agent.

Subsequent to color development, the photographic emulsion layer is generally subjected to a bleaching treatment. The bleaching may be carried out in a bleach-fix (blix) bath simultaneous with a fixing treatment or separately. To facilitate the treatment, a bleaching treatment may be followed by a bleaching and fixing treatment. The bleaching agents used in the bleaching or combined bleaching and fixing treatment may be selected from compounds (e.g., ferricyanides), peracids, quinones, and nitroso compounds of polyvalent metals such as iron (III), cobalt (III), chromium (VI), and copper (II); dichromates; organic complex salts of iron (III) and cobalt (III), for example, complex salts with aminopolycarboxylic acids such as ethylenediamine tetraacetic acid and diethylenetriamine pentaacetic acid, and aminopolyphosphonic acid, phosphonocarboxylic acids, and organophosphonic acids; organic acids such as citric, tartaric and malic acids; persulfates; hydrogen peroxide; and permanganates. Among them, organic complex salts of iron (III) and persulfates are preferred from the standpoints of fast treatment and environmental pollution. Some illustrative, non-limiting examples of the aminopolycarboxylic acids, aminopolyphosphonic acids and salts thereof useful in forming the organic iron (III) complex salts include ethylenediamine tetraacetic acid (EDTA),
diethylenetriamine pentaacetic acid,
ethylenediamine-N-(β-oxyethyl)-N',N'-triacetic acid,
1,2-diaminopropane tetraacetate,
triethylenetetramine hexaacetic acid,
propylenediamine tetraacetic acid,
nitrilotriacetic acid,
nitrilotripropionic acid,
cyclohexanediamine tetraacetic acid,
1,3-diamino-2-propanol tetraacetic acid,
methylimino diacetic acid,
imino diacetic acid,
hydroxylimino diacetic acid,
dihydroxyethylglycine ethyl ether diamine tetraacetic acid,
glycol ether diamine tetraacetic acid,
ethylenediamine tetrapropionic acid,
ethylenediamine dipropionic acid,
phenylenediamine tetraacetic acid,
2-phosphonobutane-1,2,4-triacetic acid,
1,3-diaminopropanol-N,N,N',N'-tetramethylene phosphonic acid,
ethylenediamine-N,N,N',N'-tetramethylene phosphonic acid,
1,3-propylenediamine-N,N,N',N'-tetramethylene phosphonic acid, and
1-hydroxyethylidene-1,1'-diphosphonic acid.

Preferred among them are iron (III) complex salts of ethylenediamine tetraacetic acid, diethylenetriamine pentaacetic acid, cyclohexanediamine tetraacetic acid, 1,2-diaminopropane tetraacetic acid, and methyliminodiacetic acid because of their high bleaching power.

The iron (III) complex salt used may be either one or more preformed complex salts or produced by supplying an iron (III) salt (e.g., ferric sulfate, ferric chloride, ferric nitrate, ferric sulfate ammonium, and ferric phosphate) and a chelating agent (e.g., aminopolycarboxylic acid, aminopolyphosphonic acid, and phosphonocarboxylic acid) to a solution whereupon they react to form a ferric ion complex salt in situ. In the latter case, either or both of the ferric salt and the chelating agent may be a mixture of two or more. For both the pre-formation or in situ formation of the complex salt, the chelating agent may be used in excess of its stoichiometry. The bleaching or bleach-fix solutions containing the above-mentioned ferric ion complex may further contain any metal ions other than iron, such as calcium, magnesium, aluminum, nickel, bismuth, zinc, tungsten, cobalt, and copper or their complex salts, or hydrogen peroxide.

The persulfates which may be used in the bleaching or bleach-fix treatment in the practice of the present invention are alkali metal persulfate salts such as potassium persulfate and sodium persulfate as well as ammonium persulfate.

The bleaching or bleach-fix solution may further contain any re-halogenation agents, for example, bromides such as potassium bromide, sodium bromide, and ammonium bromide, chlorides such as potassium chloride, sodium chloride, and ammonium chloride, and iodides such as ammonium iodide. If desired, any corrosion preventive agents may be incorporated, for example, inorganic acids, organic acids and their alkali metal or ammonium salts having a pH buffering ability, including boric acid, borax, sodium metaboric acid, acetic acid, sodium acetate, sodium carbonate, potassium carbonate, phosphorous acid, sodium phosphate, citric acid, sodium citrate, and tartaric acid as well as ammonium nitrate and guanidine.

The amount of the bleaching agent may range from about 0.1 to 2 mols per liter of the bleaching solution. The preferred pH of the bleaching solution ranges from 0.5 to 8.0 for ferric ion complex salts, and especially from 4.0 to 7.0 for those ferric ion complex salts with aminopolycarboxylic acids, aminopolyphosphonic acids, phosphonocarboxylic acids, and organophosphonic acids. For persulfates at concentrations of 0.1 to 2 mols/liter, the preferred pH range is between 1 and 5.

The fixing agent used in the fixing or bleaching/fixing treatment may be any well-known fixing agents or water-soluble silver halide dissolving agents, for example, thiosulfates such as sodium thiosulfate and ammonium thiosulfate; thiocyanates such as sodium thiocyanate and ammonium thiocyanate; thioethers such as ethylenebisthioglycolic acid and 3,6-dithia-1,8-octanediol; and thioureas. They may be used alone or in admixture of two or more. Also useful in the bleach-fix treatment is a special bleach-fix solution comprising a large proportion of a halide such as potassium iodide combined with a fixing agent as disclosed in Japanese Patent Application Kokai No. 55-155354.

In the fixing or bleach-fix treatment, the concentration of the fixing agent preferably ranges from about 0.2 to 4 mols per liter of the solution. In the bleach-fix treatment, the bleach-fix solution desirably contains 0.1 to 2 mols of the ferric ion complex salt and 0.2 to 4 mols of the fixing agent per liter of the solution. The pH of the fixing or bleach-fix solution generally ranges from 4.0 to 9.0, preferably from 5.0 to 8.0.

In addition to the above-mentioned additives, the fixing or bleach-fix solution may further contain a preservative, for example, sulfites such as sodium sulfite, potassium sulfite and ammonium sulfite; bisulfites, hydroxylamines, hydrazines, and bisulfite salt addducts of aldehydes such as sodium bisulfite acetoaldehyde. Further there may be contained various brightening agents, debubbling agents, surfactants, polyvinyl pyrrolidone, and organic solvents such as methanol.

It will be understood that the above-mentioned fixing solutions may be applied to not only color photosensitive materials, but also black-and-white photosensitive materials.

The bleaching solution, bleach-fixing solution and their preceding baths may contain a bleach accelerator if necessary. Some illustrative, non-limiting bleach accelerators useful in the practice of the present invention include the compounds having a mercapto or disulfide group disclosed in U.S. Pat. No. 3,893,858, West German Pat. Nos. 1,290,812 and 2,059,988, Japanese Patent Application Kokai Nos. 53-32736, 53-57831, 53-37418, 53-65732, 53-72623, 53-95630, 53-95631, 53-104232, 53-124424, 53-141623, 53-28425, and Research Disclosure, No. 17129 (July 1978); the thiazoline derivatives disclosed in Japanese Patent Application Kokai No. 50-140129; the thiourea derivatives disclosed in Japanese Patent Publication No. 45-8506, Japanese Patent Application Kokai Nos. 52-20832 and 53-32735, and U.S. Pat. No. 3,706,561; the iodides disclosed in West German Pat. No. 1,127,715 and Japanese Patent Application Kokai No. 58-16235; the polyethylene oxides disclosed in West German Pat. Nos. 966,410 and 2,748,430; the polyamines disclosed in Japanese Patent Publication No. 45-8836; the compounds disclosed in Japanese Patent Application Kokai Nos. 49-42434, 49-59644, 53-94927, 54-35727, 55-26506, and 58-163940; as well as iodide and bromide ions. Because of their accelerating effect, the compounds having a mercapto or disulfide group are preferred among them, particularly those compounds disclosed in U.S. Pat. No. 3,893,858, West German Pat. No. 1,290,812, and Japanese Patent Application Kokai No. 53-95630. Those compounds disclosed in U.S. Pat. No. 4,552,834 are also useful. These bleaching accelerators may be added to the photosensitive materials.

The fixing or bleaching/fixing step is generally followed by such a step as washing and stabilizing steps.

The washing and stabilizing steps may utilize a variety of well-known compounds for the purpose of preventing precipitation or stabilizing rinsing water. For these purposes there may be optionally added, for example, chelating agents such as inorganic phosphoric acid, aminopolycarboxylic acids, and organophosphonic acids; antibacterial and antifungal agents for controlling generation of various bacteria, algae, and mould such as disclosed in J. Antibact. Antifung. Agents, Vol. 11, No. 5, pages 207–223 (1983) and H. Horiguchi, "Antibacterial and Antifungal Chemistry"; metal salts as typified by magnesium salts, aluminum salts and bismuth salts, alkali metal and ammonium salts; and surfactants for reducing drying load or preventing inconsistent drying. Those compounds disclosed in West, Phot. Sci. Eng., Vol. 6, pages 344–359 (1965) may also be added. The addition of the chelating agents, antibacterial agents, and antifungal agents is most effective.

The washing step is generally a multi-stage countercurrent washing using more than one tank, typically 2 to 9 tanks for saving the volume of wash water. The washing step may be replaced by a multi-stage countercurrent stabilizing treatment as disclosed in Japanese Patent Application Kokai No. 57-8543. This stabilizing bath may contain a variety of compounds effective in stabilizing images in addition to the above-mentioned additives. Typical additives added for such purposes include a variety of buffering agents for adjusting the pH of coatings, typically to pH 3–9, for example, combinations of borates, metaborates, borax, phosphates, carbonates, potassium hydroxide, sodium hydroxide, aqueous ammonia, monocarboxylic acids, dicarboxylic acids, and polycarboxylic acids; and aldehydes such as formalin. Other useful additives are chelating agents (such as inorganic phosphoric acid, aminopolycarboxylic acids, organophosphonic acids, aminopolyphosphonic acids, and phosphonocarboxylic acids), antibacterial agents and antifungal agents (such as thiazoles, isothiazoles, halophenols, sulfanylamides, and benzotriazoles), surfactants, brightening agents, and metal salt hardeners. Two or more of these compounds for the same or different purposes may be used in combination.

For improved image preservation, it is preferable to add an agent for adjusting the pH of a coating film after the treatment, which may be selected from various ammonium salts such as ammonium chloride, ammonium nitrate, ammonium sulfate, ammonium phosphate, ammonium sulfite, and ammonium thiosulfate.

In the case of taking color photosensitive materials, the washing-stabilizing step commonly used subsequent to fixing may be replaced by a stabilizing step and a washing (water saving) step as previously described. When the magenta coupler is of two equivalents, formalin may be omitted from the stabilizing bath.

The duration of the washing and stabilizing treatments generally ranges from 20 seconds to 10 minutes, preferably from 20 seconds to 5 minutes although the exact duration depends on the type of photosensitive material and the processing conditions.

In the practice of the present invention, various processing solutions are used at a temperature of 10° to 50° C. Temperatures of 25° C. to 40° C. are commonly used although higher temperatures may be used to promote the treatment to reduce the processing time or conversely, lower temperatures may be used to improve image quality or render the processing solution more stable. For silver saving of photosensitive materials, an intensifying treatment relying on cobalt or hydrogen peroxide intensifier as described in West German Pat. No. 2,226,770 and U.S. Pat. No. 3,674,499 or a combined developing/bleaching/fixing treatment as described in U.S. Pat. No. 3,923,511 may also be employed.

For quickness purposes, the duration of the respective treatments may be shorter than the standard time insofar as no problem is induced thereby.

In a continuous process, a consistent finish may be accomplished by using not only a replenisher for the developing solution in the developing step, but also replenishers for the respective processing solutions in the subsequent steps. The replenishing amount may be reduced to one-half or less of the standard replenisher amount for cost reduction purposes.

Each of the processing baths may be optionally equipped with a heater, temperature sensor, level sensor, circulating pump, filter, float cap, squeezer and other controllers.

In the practice of the present invention, a bleach-fix treatment may be employed very frequently when the photosensitive material comprises a color paper and optionally when the photosensitive material comprises a taking color photographic material.

In the practice of the present invention, a reducing agent may be used. The reducing agents used are typically the developing agents previously described and they may be added to the photosensitive materials as well as the developing solution and replenisher.

Examples of the reducing agents other than the foregoings include the dye developing agents disclosed in U.S. Pat. No. 2,983,606, the diffusible dye releasing (DDR) redox compounds described in Japanese Patent Application Kokai No. 48-33826, the developing agents capable of reacting with amidolazones described in Japanese Patent Publication No. 48-39165, reducing agents of the type which themselves oxidize to form dyes or lakes (e.g., tetrazonium salts, 2,4-diaminophenol, α-nitroso-β-naphthol leuco dyes), and the reducing agents described in Japanese Patent Application Kokai No. 47-6338, pages 9–13.

In the practice of the present invention, any of various well-known color couplers may be used in addition to the 2-equivalent couplers as previously described. Examples of the useful color couplers are described in the patents cited in Research Disclosure, RD 17643 (December 1978), VII-D, and ibid., RD 18717 (November 1979). Also useful are couplers in which a color developing dye has an appropriate degree of diffusion, colorless couplers, colored couplers having a color compensation effect, development inhibitor releasing (DIR) couplers capable of releasing a development inhibitor in response to coupling reaction, and couplers capable of releasing a development accelerator in response to coupling reaction.

These couplers may be used in such a way in the practice of the present invention as to meet the characteristics required for a particular photosensitive material. For example, two or more couplers may be used in a common layer among photosensitive layers or a single coupler may be incorporated in two or more different layers.

The couplers used in the practice of the present invention may be incorporated in the photosensitive materials by any of well-known dispersing techniques, for example, solid dispersion, alkali dispersion, preferably latex dispersion, and more preferably oil-in-water dispersion technique. The oil-in-water dispersion technique involves dissolving the coupler in a single solvent selected from high boiling organic solvents having a boiling point of at least 175° C. (e.g., alkyl phthalate esters, phosphate esters, citrate esters, benzoate esters, and alkylamides) and auxiliary solvents having a low boiling point (e.g., ethyl acetate, butyl acetate, ethyl propionate, methyl isobutyl ketone, and methyl cellosolve acetate) or a mixture of high and low boiling solvents, followed by minute dispersion in an aqueous medium such as water or aqueous gelatin solution with the aid of a surfactant. Examples of the high boiling organic solvents are described in, inter alia, U.S. Pat. No. 2,322,027.

The amount of the coupler used in ordinary practice ranges from 0.001 to 1 mol per mol of the photosensitive silver halide, preferably 0.01 to 0.5 mols for the yellow coupler, 0.003 to 0.3 mols for the magenta coupler, and 0.002 to 0.3 mols for the cyan coupler per mol of the photosensitive silver halide.

In the practice of the present invention, the photosensitive material may have incorporated therein not only a developing agent as previously described, but also its precursor for the purposes of more simple and quick processing.

For incorporation purpose, the precursor is more preferable because of stabilization of the photosensitive material. Illustrative examples of the developing agent precursors are indoanilines as described in U.S. Pat. No. 3,342,597; Schiff base type compounds as described in U.S. Pat. No. 3,342,599, Research Disclosure, No. 14850 (August 1976), and ibid, No. 15159 (November 1976); aldols as described in Research Disclosure, No. 13924; metal salt complexes as described in U.S. Pat. No. 3,719,492; and urethane compounds as described in Japanese Patent Application Kokai No. 53-135628. Also useful are precursors of various salt types as described in Japanese Patent Application Kokai Nos. 56-6235, 56-16133, 56-59232, 56-67842, 56-83734, 56-83735, 56-83736, 56-89735, 56-81837, 56-54430, 56-106241, 56-107236, 57-97531, and 57-83565.

The photosensitive materials of the present invention may further have incorporated therein any 1-phenyl-3-pyrazolidones for promoting color development. Typical compounds are described in Japanese Patent Application Kokai Nos. 56-64339, 57-14457, 57-211147, 58-50532, 58-50533, 58-50534, 58-50535, 58-50536, and 58-115438.

The silver halides used in the present invention include silver chloride, silver bromide, and combined silver halides such as silver chlorobromide, silver iodobromide, and silver chloroiodobromide, but not limited thereto. The average particle size of silver halide grains, which corresponds to a particle diameter for spherical or near spherical particles or a side length for cubic particles and represented by an average head based on projected areas, is preferably up to 2 μm, most preferably up to 0.4 μm. The particle size distribution may be either narrow or broad.

The silver halide grains may have a crystalline shape selected from cubic and octahedral and their combined crystal shape.

A silver halide emulsion is generally prepared by mixing a water-soluble silver salt (e.g., silver nitrate) solution with a water-soluble halide salt (e.g., potassium bromide) solution in the presence of a water-soluble polymeric substance (e.g., gelatin) solution. It is also possible to mix two or more separately prepared photographic silver halide emulsions.

The silver halide grains may have any crystalline structures including a homogeneous structure which is uniform from the outside to the inside, a laminar structure wherein the outside and the inside are heterogeneous, and a conversion type structure as described in British Pat. No. 635,841 and U.S. Pat. No. 3,622,318. The silver halide emulsions used in the practice of the present invention may be either of the surface latent image type wherein latent images are predominantly formed on the grain surface or of the internal latent image type wherein latent images are formed in the grain interior. These photographic emulsions are described in publications, for example, Mees, "The Theory of Photographic Process", Macmillan Press, and P. Grafkides, "Chimie Photographique", Paul Montel (1957); and may be prepared by generally accepted methods as described in P. Grafkides, "Chimie et Physique Photographique", Paul Montel (1967); G. F. Duffin, "Photographic Emulsion Chemistry", The Focal Press (1966), and V. L., Zelikman et al., "Making and Coating Photographic Emulsion", The Focal Press (1964). More particularly, any methods including acid, neutral and ammonia methods may be used, and the mode of reaction of a soluble silver salt with a soluble halide salt may be single jet mixing, double jet mixing, and a combination thereof.

Also employable is a method of forming silver halide grains in the presence of excess silver ions, which is known as a reverse mixing method. One special type of simultaneous mixing method is by maintaining constant the pAg of a liquid phase in which a silver halide is formed, which is known as a controlled double jet method. This method leads to a silver halide emulsion having a regular crystalline shape and a nearly uniform particle size.

It is possible to mix two or more separately prepared silver halide emulsions.

In the step of forming or physically ripening silver halide grains, there may coexist a cadmium salt, zinc salt, lead salt, thallium salt, iridium salt or its complex salt, rhodium salt or its complex salt, iron salt or its complex salt.

The emulsion is generally removed of soluble salts after precipitation or physical ripening. Soluble salt removal means may be a traditional Nudel rinsing method using gelled gelatin or a flocculation method using an inorganic salt of a polyvalent anion (such as sodium sulfate), an anionic surface-active agent, an anionic polymer (such as polystyrene sulfonic acid), or a gelatin derivative (such as aliphatic acylated gelatin, aromatic acylated gelatin, and aromatic carbamoylated gelatin). The soluble salt removal step may be omitted.

The silver halide emulsion may be a primitive emulsion that has not been subject to chemical sensitization, but is usually chemically sensitized. Chemical sensitization may be carried out by the methods described in the above-incorporated publications of Glafkides and Zelikman et al. as well as H. Frieser ed., "Die Grundlagen der Photographischen Prozesse mit Silverhalogeniden", Akademische Verlagsgesellschaft, 1968. For chemical sensitization purpose, there may be employed sulfur sensitization using a sulfur-containing compound capable of reacting with silver ion and active gelatin, reducing sensitization using a reducing material, noble metal sensitization using a compound of gold or another noble metal, and combinations thereof.

The amount of silver applied in the practice of the present invention generally ranges from about 0.01 grams to about 10 grams per square meter.

To impart desired development properties, image properties, and film physical properties, sometimes the photosensitive material may further contain various additives. Examples of such additives include iodides of salt type such as alkali metal iodides and organic compounds having a free mercapto group such as phenylmercaptotetrazole. However, it is desirably avoided to use large amounts of the additives.

For the purposes of increased contrast or promoted development, the photosensitive material may contain any compound selected from polyalkylene oxides or their ether, ester, or amine derivatives, thioether compounds, thiomorpholines, quaternary ammonium salts, urethane derivatives, urea derivatives, imidazole derivatives, and 3-pyrazolidone derivatives. Illustrative examples are given in, inter alia, U.S. Pat. Nos. 2,400,532, 2,423,549, 2,716,062, 3,617,280, 3,772,021, and 3,808,003, and British Pat. No. 1,488,991.

In general, an antifoggant is added to a photosensitive silver halide emulsion layer and a photoinsensitive auxiliary layer of the photosensitive material. Preferred examples of the antifoggants are tetrazoles, azaindenes, triazoles, and heterocyclic organic compounds such as aminopurine.

Other additives contained in the photosensitive material include hardeners, plasticizers, lubricants, surfacing agents, gloss agents, and other additives well known in the photographic art.

A binder or protective colloid used in the photographic emulsion is advantageously gelatin although hydrophilic colloid may be used. Examples include proteins such as gelatin, gelatin derivatives, graft polymers of gelatin with other polymers, albumin, and casein; cellulose derivatives such as hydroxyethylcellulose, carboxymethylcellulose, and cellulose sulfate, and polysaccharides such as sodium alginate and starch derivatives; and various hydrophilic synthetic polymers, for example, homopolymers and copolymers of polyvinyl alcohol, partial acetal-polyvinyl alcohol, poly-N-vinylpyrolidone, polyacrylic acid, polymethacrylic acid, polyacrylamide, polyvinyl imidazole, and polyvinyl pyrazole.

The gelatins used include a lime-treated gelatin, an acid-treated gelatin, an enzyme-treated gelatin as described in Bull. Soc. Sci. Phot. Japan, No. 16 (1966), page 30, a gelatin hydrolyzate, and an enzymatically decomposed gelatin. The gelatin derivatives may be obtained by reacting gelatin with various compounds such as acid halides, acid anhydrides, isocyanates, bromoacetic acid, alkane sultones, vinylsulfonamides, maleimides, polyalkylene oxides, and epoxy compounds.

The above-mentioned gelatin graft polymers may be obtained by grafting a homopolymer or copolymer of a vinyl monomer such as acrylic acid, methacrylic acid, their ester or amide derivatives, acrylonitrile, and styrene to gelatin. Preferred among them are graft polymers of gelatin with somewhat compatible polymers such as acrylic acid, methacrylic acid, acrylamide, methacrylamide, hydroxyalkyl methacrylate polymers. Their examples are described in U.S. Pat. Nos. 2,763,625, 2,831,767, and 2,956,884.

The photographic emulsion may be optionally spectrally sensitized if desired, using a cyanine dye including cyanine, merocyanine, and carbocyanine dyes alone or in admixture or a mixture thereof with another dye like a styryl dye.

In order to provide a wide range of color within the chromaticity diagram using the three primary colors, yellow, magenta and cyan, the photosensitive materials of the present invention should include at least three silver halide emulsion layers having sensitivity in different spectra.

Typical combinations of at least three silver halide emulsion layers having sensitivity in different spectra are a combination of blue-sensitive emulsion layer/green-sensitive emulsion layer/red-sensitive emulsion layer, a combination of green-sensitive emulsion layer/red-sensitive emulsion layer/infrared-sensitive emulsion layer, a combination of blue-sensitive emulsion layer/green-sensitive emulsion layer/infrared-sensitive emulsion layer, and a combination of blue-sensitive emulsion layer/red-sensitive emulsion layer/infrared-sensitive emulsion layer. By the infrared-sensitive emulsion layer used herein it is meant that the emulsion layer is sensitive to light having a wavelength of more than 700 nm, particularly more than 740 nm.

The photosensitive materials of the present invention may have two or more emulsion layers having sensitivity in the same spectrum, but different in emulsion sensitivity.

The photosensitive material may contain a water-soluble dyestuff in a hydrophilic colloid layer thereof as a filter dyestuff or various other purposes like irradiation prevention. Some examples of the dyestuffs include oxonol, hemioxonol, styryl, merocyanine, cyanine, and azo dyestuffs. Preferred among them are oxonol, hemioxonol and merocyanine dyestuffs.

The photosensitive material may contain a ultraviolet (UV) radiation absorber in a hydrophilic colloid layer thereof. Useful for this purpose are benzotriazoles having an aryl substituent, 4-thiazolidones, benzophenones, cinnamic esters, butadienes, benzoxazoles, and other UV-absorbing polymers. These UV absorbers may be fixed within the hydrophilic colloid layer.

The photosensitive material may contain a brightener in a photographic emulsion layer or another hydrophilic colloid layer thereof. The brighteners include stilbene, triazine, oxazole, and coumarin derivatives. They may be either soluble or insoluble in water, with water-insoluble ones being used as a dispersion.

When the photosensitive material contains a dyestuff or a UV absorber in a hydrophilic colloid layer thereof, the agents may be mordanted with cationic polymers or other mordants.

The photosensitive material may contain an agent for preventing color fog or color mixing, including hydroquinone derivatives, aminophenol derivatives, amines, gallic acid derivatives, catechol derivatives, ascorbic acid derivatives, colorless couplers, and sulfonamide phenol derivatives.

The photosensitive material may contain any well-known discoloration inhibitor. Typical examples are hindered phenols (including hydroquinones, 6-hydroxychromans, 5-hydroxycoumarans, spirochromans, p-alkoxyphenols, and bisphenols), gallic acid derivatives, methylenedioxybenzenes, aminophenols, hindered amines, and ether or esters derivatives of these compounds whose phenolic hydroxyl group is silylated or alkylated. Also useful are metal complexes as typified by (bissalicylaldoximato) nickel complex and (bis-N,N-dialkyldithiocarbamato) nickel complex.

For preventing deterioration of yellow dye images by heat, moisture and light, good results are achieved with compounds having both partial structures of hindered amine and hindered phenol within a molecule as disclosed in U.S. Pat. No. 4,268,593. For preventing deterioration of magenta dye images, particularly by light, good results are achieved with the spiroindanes described in Japanese Patent Application Kokai No. 56-159644 and the hydroquinone diethers or chromans having a monoether substituted thereon described in Japanese Patent Application Kokai No. 55-89835.

The photosensitive material may contain any surfactants in a photographic emulsion layer or another hydrophilic colloid layer thereof for various purposes including coating aid, antistatic, lubrication, emulsifying dispersion, anti-adhesion, and improvements in photographic properties (e.g., development acceleration, contrast enhancement, and sensitization). Useful examples of the surfactants include nonionic surfactants, for example, saponins of steroid series, alkyleneoxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkyl amines or amides, polyethylene oxide adducts of silicones), glycidol derivatives (e.g., alkenyl succinic acid polyglycerides and alkylphenol polyglycerides), fatty acid esters of polyhydric alcohols, and alkyl esters of saccharides; anionic surfactants having an acidic group such as a carboxy, sulfo, phospho, sulfate ester, and phosphate ester group, for example, alkyl carboxylates, alkyl sulfonates, alkylbenzene sulfonates, alkylnaphthalene sulfonates, alkyl sulfates, alkyl phosphates, N-acyl-N-alkyltaurines, sulfosuccinate esters, sulfoalkyl polyoxyethylene alkylphenyl ethers, and polyoxyethylene alkylphosphate esters; and amphoteric surfactants, for example, amino acids, aminoalkyl sulfonic acids, aminoalkyl sulfates or phosphates, alkylbetains, and amine oxides; cationic surfactants, for example, alkylamine salts, aliphatic or aromatic quaternary ammonium salts, salts of heterocyclic quaternary ammoniums like pyridinium and imidazolium, and aliphatic or heterocyclic phosphonium or sulfonium salts.

The photosensitive material may contain an inorganic or organic hardener in a photographic emulsion layer or another hydrophilic colloid layer thereof. Examples of the hardeners include chromium salts (e.g., chromium alum and chromium acetate), aldehydes (e.g., formaldehyde glyoxal and glycolaldehyde), N-methylols (e.g., dimethylol urea and methylol dimethylhydantoin), dioxanes (e.g., 2,3-dihydroxydioxane), active vinyl compounds (e.g., 1,3,5-triacryloylhexahydro-s-triazine and 1,3-vinylsulfonyl-2-propanol), active halides (e.g., 2,4-dichloro-6-hydroxy-s-triazine), and mucohalogenic acids (e.g., mucochloric acid and mucophenoxychloric acid) alone or in admixture.

The photosensitive material may contain a dispersion of a water-insoluble or difficultly water-soluble synthetic polymer in a photographic emulsion layer or another hydrophilic colloid layer thereof for purposes of dimensional stability and other improvements. These polymers may be polymers having a monomeric unit selected from alkyl (meth)acrylates, alkoxyalkyl (meth)acrylates, glycidyl (meth)acrylates, (meth)acrylamides, vinyl esters (e.g., vinyl acetate), acrylonitrile, olefins, and styrene alone or mixtures thereof, or combinations thereof with another monomeric unit selected from acrylic acid, methacrylic acid, $\alpha,\beta$-unsaturated dicarboxylic acids, hydroxyalkyl (meth)acrylates, sulfoalkyl (meth)acrylates, and styrene sulfonic acid.

The photosensitive material may preferably comprise a composition which requires as low a base consumption as possible. Those components that consume a base are most of the organic additives including ester oils, reducing agents, UV aborbers, and hardeners, and binders like gelatin as well as the couplers previously described. It is desired to use these base-consuming compounds in necessary minimal amounts. For example, the ester oils is preferably used in an amount of up to 0.5 cc, more preferably up to 0.3 cc per gram of the binder and in a weight ratio of up to 200% based on the coupler. The binder like gelatin is preferably used in an amount of up to 30 grams/m$^2$, more preferably up to 15 grams/m$^2$. The amount of the hardener used preferably ranges from 0.1% to 5% based on the weight of gelatin.

The base that forms within a coating of the photosensitive material diffuses into the processing solution during the treatment so that the concentration of base in the coating diminishes with time. For accelerating development, it is critical to minimize dissipation of the base within the coating as low as possible. It is very advantageous to use a support in the form of a water impermeable sheet of paper having cellulose triacetate, polyethylene terephthalate or polyethylene laminated thereon.

The present invention is also applicable to multi-layer color photographic materials having at least two different spectral sensitivities on a support. In general, the multi-layer color photographic materials have red-, green-, and blue-sensitive emulsion layers on a support, at least one layer for each emulsion. The sequence of disposition of these layers may be suitably chosen so as to meet a particular application. Usually, the color photographic material contains a cyan-forming coupler in a red-sensitive emulsion layer, a magenta-forming coupler in a green-sensitive emulsion layer, and a yellow-forming coupler in a blue-sensitive emulsion layer, although another different combination may occur in some cases.

The present invention is also applicable to a color image transfer process and an absorption transfer process.

According to the color image forming process of the present invention, a silver halide photosensitive material comprising at least a photosensitive silver halide, a 2-equivalent coupler, a binder, and a substantially water-insoluble basic metal compound on a support is subjected to a development with a processing solution comprising a complexing compound capable of water-mediated complexing reaction with the metal ion of the substantially water-insoluble basic metal compound to release a base. The present invention provides a color image forming process capable of accomplishing a sufficient image density within a reduced period of processing time while the processing solution, particularly developing solution exhibits improved aging stability and safety. An additional advantage is removal of such organic solvents as benzyl alcohol from the processing solution.

EXAMPLES

Examples of the present invention are given below by way of illustration and not by way of limitation.

Example 1

Photosensitive material No. 101 was prepared by coating first (or lower) and second (or upper) layers, as formulated below, on a paper support laminated with a polyethylene coating having titanium dioxide dispersed therein. In the following formulation, the coating weight is reported in parentheses.

Second layer
- gelatin (550 mg/m$^2$)
- zinc hydroxide having average particle size 0.3 μm (580 mg/m$^2$)
- hardener, 1,2-bis(vinylsulfonylacetamide)ethane (20 mg/m$^2$)

First layer
- silver chlorobromide emulsion having 30 mol% silver bromide and average particle size 0.3 μm (silver 250 mg/m$^2$)
- yellow coupler, Y-23 (0.67 millimol/m$^2$)
- gelatin (1000 mg/m$^2$)
- dispersing oil, dibutyl phthalate (280 mg/m$^2$)

Support

Photosensitive material Nos. 102 to 107 were prepared by the same procedure as above except that the yellow coupler Y-23 was replaced by an equimolar amount of couplers (A), M-15, (B), C-37, C-19, and (C), respectively. Couplers (A), (B), and (C) have the following chemical structures.

Yellow coupler (A)

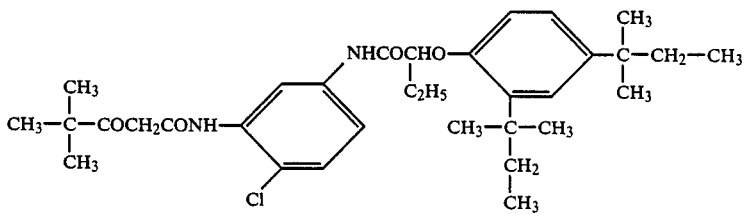

(B)

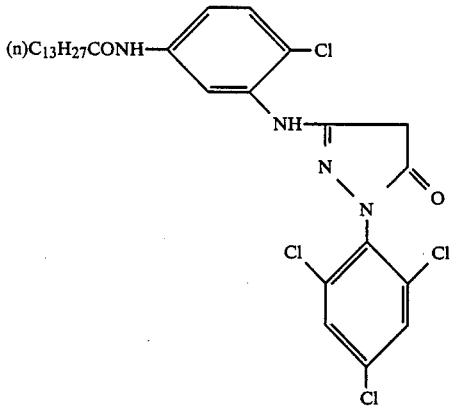

Cyan coupler (C)

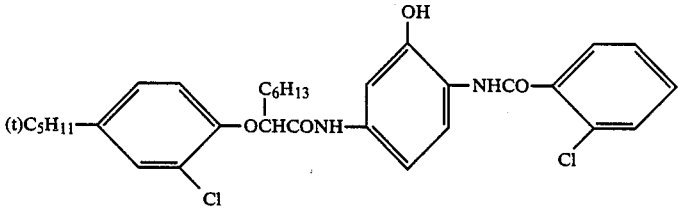

Each of the photosensitive materials was imagewise exposed and then developed by the following developing procedure using the following solutions.

| Processing step | Temperature | Time |
|---|---|---|
| Color development | 33° C. | 3'30" |
| Bleaching/fixing | 33° C. | 1'30" |
| Washing | 25° C. | 3' |

| | A | B |
|---|---|---|
| Color developing solution | | |
| Water | 800 ml | 800 ml |
| 3-Na nitrilotriacetate | 1.4 g | 1.4 g |
| Benzyl alcohol | 15 ml | 15 ml |
| Diethylene glycol | 10 ml | 10 ml |
| Sodium sulfite | 1.7 g | 1.7 g |
| Hydroxylamine hydrogensulfate | 3.0 g | 3.0 g |
| Potassium carbonate | 31.0 g | — |
| Potassium picolinate | — | 50 g |
| N—ethyl-N—(β-methanesulfonamido-ethyl)-3-methyl-4-aminoaniline hydrogensulfate | 4.5 g | 4.5 g |
| Water totaling to | 1000 ml | 1000 ml |
| | pH 10.3 | pH 8.0 |
| Bleach-fix solution | | |
| Water | 400 ml | |
| Ammonium thiosulfate (70% solution) | 150 ml | |
| Sodium sulfite | 18 g | |
| Iron EDTA ammonium | 55 g | |
| 2Na-EDTA | 5 g | |
| Water totaling to | 1000 ml | |

Each of the resulting yellow, magenta, and cyan color images was measured for maximum and minimum densities (Dmax and Dmin) and fog through the corresponding one of filters B, G, and R. The results are shown below.

TABLE 1-1

Treatment with Developing Solution A (pH 10.3)

| Photosensitive Material No. | Color image | Dmax | Dmin |
|---|---|---|---|
| 101 (2-equivalent) | yellow | 2.0 | 0.12 |
| 102 (4-equivalent) | yellow | 1.8 | 0.10 |
| 103 (2-equivalent) | magenta | 2.4 | 0.11 |
| 104 (4-equivalent) | magenta | 2.0 | 0.10 |
| 105 (2-equivalent) | cyan | 2.2 | 0.11 |
| 106 (2-equivalent) | cyan | 2.3 | 0.11 |
| 107 (4-equivalent) | cyan | 1.7 | 0.11 |

TABLE 1-2

Treatment with Developing Solution B (pH 8.0)

| Photosensitive Material No. | Color image | Dmax | Dmin |
|---|---|---|---|
| 101 (2-equivalent) | yellow | 2.0 | 0.11 |
| 102 (4-equivalent) | yellow | 1.2 | 0.09 |
| 103 (2-equivalent) | magenta | 2.3 | 0.11 |
| 104 (4-equivalent) | magenta | 1.5 | 0.10 |
| 105 (2-equivalent) | cyan | 2.1 | 0.10 |
| 106 (2-equivalent) | cyan | 2.3 | 0.11 |
| 107 (4-equivalent) | cyan | 1.2 | 0.09 |

The data in Tables 1-1 and 1-2 show that in the process of carrying out development in the presence of a substantially water-insoluble metal compound and a complexing compound (developing solution B, pH 8.0), the photosensitive materials using 2-equivalent couplers produce a significantly higher image density than the photosensitive materials using 4-equivalent couplers. This difference is quite unexpected because it is outstanding as compared with the difference in image density created between the the photosensitive materials using 4-equivalent couplers and 2-equivalent couplers when they are developed with the conventional developing solution A (pH 10.3). The same tendency was observed when the type of 2-equivalent coupler was changed.

Next, color developing solutions A and B were admitted into plastic containers and stored for one month with the caps kept open. After replenishing water in the evaporated volume, the solutions were used in the same treatment. For color developing solution A, a reduction in Dmax and an increase in Dmin were observed. For color developing solution B, no significant change in photographic properties was recognized as compared with the results obtained immediately after preparation.

Additionally, photosensitive material Nos. 101, 103, 105, and 106 were stored for 4 days at 50° C. and relative humidity (RH) 60% and thereafter, processed with color developing solution B by the same procedure, finding no significant change in photographic properties as compared with the results obtained immediately after coating.

It was thus found that the image forming process of the present invention can produce a sufficiently dense image even with a developing solution having a low pH level and hence, improved shelf stability.

It was also found that a photosensitive material containing a substantially water-insoluble basic metal compound can be processed with a conventional developing solution.

Example 2

Photosensitive material sample Nos. 201 to 205 were prepared by the same procedure as in Example 1, that is, using the same composition as Sample No. 101 except that the zinc hydroxide contained in the second layer in Example 1 was replaced by the compounds reported in Table 2. Except the color developing solution, the processing solution used had the same composition as in Example 1. The color developing solutions used substantially corresponded to color developing solution B except that the sodium picolinate was replaced by the compounds reported in Table 2 and the pH was adjusted to 8.0. They were used to treat the corresponding photosensitive materials as shown in Table 2.

A development was carried out in the same manner as in Example 1, with the photographic results shown in Table 3.

TABLE 2

| Sample No. | Compound added to first layer: Type | Average particle size | Amount |
|---|---|---|---|
| 201 | Basic zinc carbonate | 0.1 μm | 770 mg/m$^2$ |
| 202 | Zinc oxide | 0.2 μm | 580 mg/m$^2$ |
| 203 | Basic zinc carbonate | 0.1 μm | 770 mg/m$^2$ |
| 204 | Basic zinc carbonate | 0.1 μm | 770 mg/m$^2$ |
| 205 | Calcium carbonate | 0.1 μm | 1160 mg/m$^2$ |

| Processed sample No. | Compound added to color developing solution: Type | Amount |
|---|---|---|
| 201 | Potassium picolinate | 50 g |
| 202 | Potassium picolinate | 50 g |
| 203 | Potassium dipicolinate | 40 g |
| 204 | Guanidine 2-aminobenzoate | 70 g |
| 205 | Potassium oxalate | 40 g |

TABLE 3

| Sample No. | Dmin (yellow) | Dmax (yellow) |
|---|---|---|
| 201 | 0.11 | 1.9 |
| 202 | 0.10 | 2.0 |
| 203 | 0.11 | 2.0 |

TABLE 3-continued

| Sample No. | Dmin (yellow) | Dmax (yellow) |
|---|---|---|
| 204 | 0.11 | 2.0 |
| 205 | 0.10 | 2.0 |

The data in Table 3 show that a sufficient image density is achieved even when a different combination of a substantially water-insoluble metal compound with a complexing compound is used.

Example 3

A silver halide based color photosensitive material of multi-layer structure designated Sample No. 301 was prepared by coating a paper support having polyethylene laminated on both the surfaces, with first (lowermost) to seventh (uppermost) layers as formulated below.

Similarly, Sample No. 302 was prepared using the same formulations as Sample No. 301 except that no zinc hydroxide was added to the second, fourth, and sixth layers.

| Layer | Main ingredient | Amount ($g/m^2$) |
|---|---|---|
| 7th (protective layer) | Gelatin | 1.62 |
| 6th (UV absorbing layer) | Gelatin | 1.06 |
| | Zinc hydroxide (average particle size 0.2–0.3 μm) | 0.30 |
| | UV absorber*1 | 0.35 |
| | UV absorber solvent*2 | 0.12 |
| 5th (red-sensitive layer) | Silver chlorobromide emulsion (50 mol % silver bromide) | 0.25 (Ag) |
| | Gelatin | 1.26 |
| | Cyan coupler C-37 | 0.50 |
| | Coupler solvent*2 | 0.25 |
| 4th (UV absorbing layer) | Gelatin | 1.60 |
| | Zinc hydroxide (average particle size 0.2–0.3 μm) | 0.30 |
| | UV absorber*1 | 0.70 |
| | Color mixing inhibitor*3 | 0.20 |
| | Inhibitor solvent*2 | 0.30 |
| 3rd (green-sensitive layer) | Silver chlorobromide emulsion (70 mol % silver bromide) | 0.17 (Ag) |
| | Gelatin | 1.40 |
| | Magenta coupler M-15 | 0.40 |
| | Coupler solvent*4 | 0.20 |
| 2nd (intermediate layer) | Gelatin | 1.10 |
| | Zinc hydroxide (average particle size 0.2–0.3 μm) | 0.40 |
| | Color mixing inhibitor*3 | 0.20 |
| | Inhibitor solvent*2 | 0.10 |
| 1st (blue-sensitive layer) | Silver chlorobromide emulsion (80 mol % silver bromide) | 0.35 (Ag) |
| | Gelatin | 1.54 |
| | Yellow coupler Y-28 | 0.50 |
| | Coupler solvent*2 | 0.50 |
| Support | Polyethylene laminated paper containing a polyethylene white pigment (typically, $TiO_2$) and a blue dyestuff (ultramarine) on the first layer side. | |

*1 2-(2-hydroxy-3-sec.-butyl-5-tert.-butylphenyl)-benzotriazole
*2 dibutyl phthalate
*3 2,5-di-tert.-octylhydroquinone
*4 trioctyl phosphate It should be noted that sodium 1-hydroxy-3,5-dichloro-s-triazine salt was used as the gelatin hardener for each layer.

The photosensitive materials were imagewise exposed and developed by the same developing procedure as in Example 1.

| | A | B | C |
|---|---|---|---|
| Color developing solution | | | |
| Water | 800 ml | 800 ml | 800 ml |
| 3-Na nitrilotriacetate | 2.0 g | 2.0 g | 2.0 g |
| Benzyl alcohol | 14 ml | — | — |
| Diethylene glycol | 10 ml | — | — |
| Sodium sulfite | 2.0 g | 2.0 g | 2.0 g |
| Hydroxylamine hydrogensulfate | 3.0 g | 3.0 g | 3.0 g |
| Potassium bromide | 1.0 g | 1.0 g | 1.0 g |
| Sodium carbonate | 30 g | 30 g | — |
| Potassium picolinate | — | — | 50 g |
| N—ethyl-N—(β-methanesulfonamidoethyl)-3-methyl-4-aminoaniline hydrogensulfate | 5.0 g | 5.0 g | 5.0 g |
| Water totaling to | 1000 ml | 1000 ml | 1000 ml |
| pH | 10.15 | 10.15 | 8.0 |
| Bleach-fix solution | | | |
| Water | | 400 ml | |
| Ammonium thiosulfate (70% solution) | | 150 ml | |
| Sodium sulfite | | 18 g | |
| Iron EDTA ammonium | | 55 g | |
| 2Na-EDTA | | 5 g | |
| Water totaling to | | 1000 ml | |
| pH | | 6.70 | |

The resulting photographic properties are shown in Table 4-1.

TABLE 4-1

| Sample No. | Bath* | Yellow Dmin | Yellow Dmax | Magenta Dmin | Magenta Dmax | Cyan Dmin | Cyan Dmax | |
|---|---|---|---|---|---|---|---|---|
| 301 | A | 0.12 | 2.1 | 0.11 | 2.3 | 0.11 | 2.5 | Comparison |
| 301 | B | 0.09 | 1.6 | 0.10 | 2.1 | 0.10 | 2.3 | Comparison |
| 301 | C | 0.10 | 2.0 | 0.11 | 2.3 | 0.11 | 2.5 | Invention |
| 302 | A | 0.10 | 2.2 | 0.10 | 2.3 | 0.10 | 2.5 | Comparison |
| 302 | B | 0.09 | 1.5 | 0.09 | 2.0 | 0.10 | 2.3 | Comparison |
| 302 | C | 0.08 | 0.6 | 0.07 | 1.0 | 0.07 | 1.0 | Comparison |

*Color developing solution

The data of Table 4-1 indicate that the image forming process of the present invention can produce a sufficiently dense image with the use of a low pH developing solution which is improved in shelf stability. It was also found that organic solvents such as benzyl alcohol and diethylene glycol can be removed from the developing solution.

Another photosensitive material designated Sample No. 303 was prepaed by the same procedure as Sample No. 301 except that the cyan coupler C-37 in the fifth layer was replaced by an equimolar amount of cyan coupler C-45 and the amount of the coupler solvent was reduced to 0.15 $g/m^2$.

The photosensitive materials, Sample Nos. 301 to 303 were exposed to light through a pattern for measuring sharpness, and then processed with color developing solution C for Sample Nos. 301 and 303 and with color developing solution A for Sample No. 302. The results of evaluation of sharpness are shown in Table 4-2.

TABLE 4-2

| Sample No. | Hue | Dmax | Dmin | Sharpness |
|---|---|---|---|---|
| 301 | Cyan | 2.5 | 0.11 | lower than standard |
| 302 | Cyan | 2.5 | 0.10 | standard |
| 303 | Cyan | 2.7 | 0.11 | equal to standard |

The data of Table 4-2 indicate that the use of a coupler having a group other than a halogen atom as the coupling-off group leads to an image having a higher density and improved sharpness.

Example 4

After imagewise exposure, Sample No. 301 of Example 3 was processed for color development with color developing solution D as formulated below, and Sample No. 302 of Example 3 was processed for color development with color developing solution A as previously formulated, each at 33° C. for 1 minute and 30 seconds. Thereafter, they were subjected to a bleaching/fixing treatment and a water rinsing treatment in the same manner as in Example 3.

| Color developing solution | D |
|---|---|
| Water | 800 ml |
| 3-Na nitrilotriacetate | 2.0 g |
| Benzyl alcohol | 14 ml |
| Diethylene glycol | 10 ml |
| Sodium sulfite | 2.0 g |
| Hydroxylamine hydrogensulfate | 3.0 g |
| Potassium bromide | 1.0 g |
| Potassium picolinate | 30 g |
| N—ethyl-N—(β-methanesulfonamido-ethyl)-3-methyl-4-aminoaniline hydrogensulfate | 5.0 g |
| Water totaling to | 1000 ml |
| NaOH adjusting pH to | 10.15 |

The resulting photographic properties are shown in Table 5.

TABLE 5

| Sample | | Yellow | | Magenta | | Cyan | | |
|---|---|---|---|---|---|---|---|---|
| No. | Bath* | Dmin | Dmax | Dmin | Dmax | Dmin | Dmax | |
| 301 | D | 0.10 | 2.2 | 0.10 | 2.3 | 0.09 | 2.5 | Invention |
| 302 | A | 0.07 | 1.5 | 0.08 | 1.6 | 0.08 | 1.9 | Comparison |

*Color developing solution

The data of Table 5 indicate that the image forming process of the present invention can produce a sufficiently dense image within a short time.

Example 5

A multi-layer color photosensitive material designated Sample No. 401 was prepared by coating multiple layers of the following compositions on a primed cellulose triacetate film support. Similarly, a multi-layer color photosensitive material having the same formulations as Sample No. 401 except that no zinc hydroxide was added to the first, second, fifth, eighth, ninth, and twelfth layers was prepared and designated Sample No. 402.

1st layer: Anti-halation layer

Gelatin layer containing

| | |
|---|---|
| Black colloidal silver | 0.25 g/m² |

-continued

| | |
|---|---|
| UV absorber U-1 | 0.04 g/m² |
| UV absorber U-2 | 0.1 g/m² |
| UV absorber U-3 | 0.1 g/m² |
| Zinc hydroxide (average particle size 0.3 μm) | 0.5 g/m² |
| High-boiling organic solvent 0-1 | 0.1 cc/m² |

2nd layer: Intermediate layer

Gelatin layer containing

| | |
|---|---|
| Zinc hydroxide (average particle size 0.3 μm) | 0.3 g/m² |
| Compound H-1 | 0.05 g/m² |
| High-boiling organic solvent 0-2 | 0.05 cc/m² |

3rd layer: First red-sensitive emulsion layer

Gelatin layer containing

| | |
|---|---|
| Silver iodobromide emulsion spectrally sensitized with sensitizing dyes S-1 and S-2 (iodine content 4 mol %, average particle size 0.3 μm) | 0.5 g/m² (Ag) |
| Coupler C-42 | 0.2 g/m² |
| Coupler C-43 | 0.05 g/m² |
| High-boiling organic solvent 0-2 | 0.12 cc/m² |

4th layer: Second red-sensitive emulsion layer

Gelatin layer containing

| | |
|---|---|
| Silver iodobromide emulsion spectrally sensitized with sensitizing dyes S-1 and S-2 (iodine content 2.5 mol %, average particle size 0.55 μm) | 0.8 g/m² (Ag) |
| Coupler C-42 | 0.55 g/m² |
| Coupler C-43 | 0.14 g/m² |
| High-boiling organic solvent 0-2 | 0.33 cc/m² |

5th layer: Intermediate layer

Gelatin layer containing

| | |
|---|---|
| Zinc hydroxide (average particle size 0.3 μm) | 0.3 g/m² |
| Compound H-1 | 0.1 g/m² |
| High-boiling organic solvent 0-2 | 0.1 cc/m² |

6th layer: First green-sensitive emulsion layer

Gelatin layer containing

| | |
|---|---|
| Silver iodobromide emulsion spectrally sensitized with sensitizingdyes S-3 and S-4 (iodine content 3 mol %, average particle size 0.3 μm) | 0.7 g/m² (Ag) |
| Coupler M-3 | 0.35 g/m² |
| High-boiling organic solvent 0-2 | 0.26 cc/m² |

7th layer: Second green-sensitive emulsion layer

Gelatin layer containing

| | |
|---|---|
| Silver iodobromide emulsion spectrally sensitized with sensitizing dyes S-3 and S-4 (iodine content 2.5 mol %, average particle size 0.8 μm) | 0.7 g/m² (Ag) |
| Coupler M-38 | 0.25 g/m² |
| High-boiling organic solvent 0-2 | 0.05 cc/m² |

8th layer: Intermediate layer

Gelatin layer containing

| | |
|---|---|
| Zinc hydroxide (average particle size 0.3 μm) | 0.3 g/m² |
| Compound H-1 | 0.05 g/m² |
| High-boiling organic solvent 0-2 | 0.1 cc/m² |

9th layer: Yellow filtering layer

Gelatin layer containing

| | |
|---|---|
| Zinc hydroxide (average particle size 0.3 μm) | 0.3 g/m² |
| Yellow colloidal silver | 0.1 g/m² |
| Compound H-1 | 0.02 g/m² |
| Compound H-2 | 0.03 g/m² |

-continued

| | |
|---|---|
| High-boiling organic solvent 0–2 | 0.04 cc/m$^2$ |
| 10th layer: First blue-sensitive emulsion layer | |
| Gelatin layer containing | |
| Silver iodobromide emulsion spectrally sensitized with sensitizing dye S-5 (iodine content 2.5 mol %, average particle size 0.7 μm) | 0.6 g/m$^2$ (Ag) |
| Coupler Y-9 | 0.5 g/m$^2$ |
| High-boiling organic solvent 0–2 | 0.1 cc/m$^2$ |
| 11th layer: Second blue-sensitive emulsion layer | |
| Gelatin layer containing | |
| Silver iodobromide emulsion spectrally sensitized with sensitizing dye S-5 (iodine content 2.5 mol %, average particle size 1.2 μm) | 1.1 g/m$^2$ (Ag) |
| Coupler Y-9 | 1.2 g/m$^2$ |
| High-boiling organic solvent 0–2 | 0.23 cc/m$^2$ |
| 12th layer: First protective layer | |
| Gelatin layer containing | |

-continued

| | |
|---|---|
| Zinc hydroxide (average particle size 0.3 μm) | 0.3 g/m$^2$ |
| UV absorber U-1 | 0.02 g/m$^2$ |
| UV absorber U-2 | 0.03 g/m$^2$ |
| UV absorber U-3 | 0.03 g/m$^2$ |
| UV absorber U-4 | 0.29 g/m$^2$ |
| High-boiling organic solvent 0–1 | 0.28 cc/m$^2$ |
| 13th layer: Second protective layer | |
| Gelatin layer containing | |
| Emulsion of finely divided silver iodobromide having fogged surface (iodine content 1 mol %, average particle size 0.06 μm) | 0.1 g/m$^2$ |
| Polymethyl methacrylate particles (average particle size 1.5 μm) | 0.2 g/m$^2$ |

For each of the layers, a gelatin hardener H-3 and a surfactant were added to the above-described composition.

The compounds used in preparing these samples are shown below.

U-1

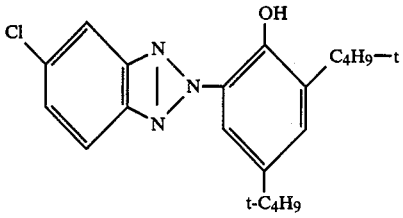

U-2

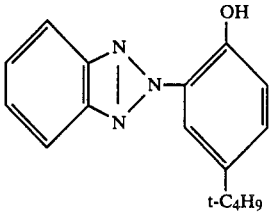

U-3

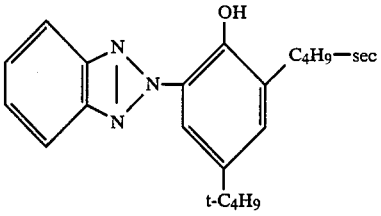

U-4

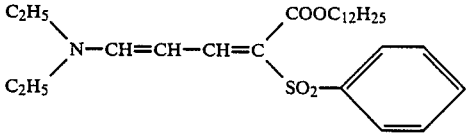

H-1

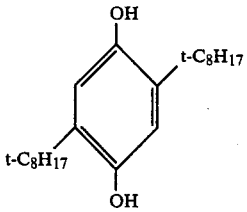

H-2

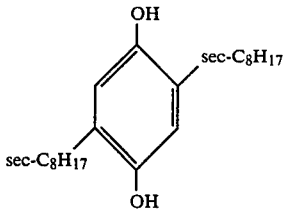

H-3

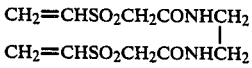

O-1

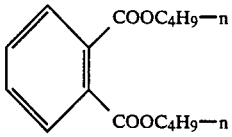

O-2

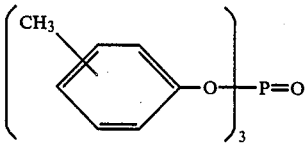

S-1

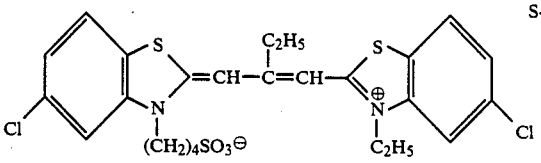

-continued

S-2

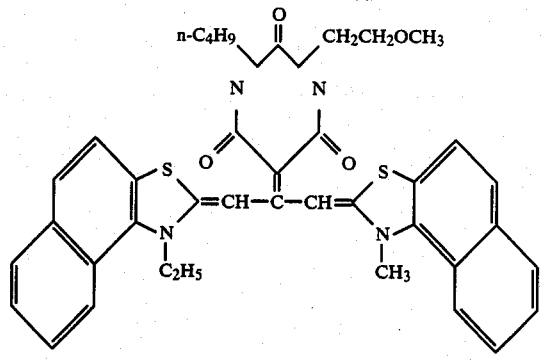

S-3

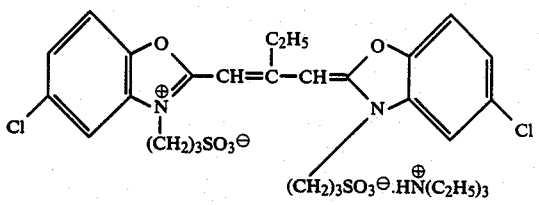

S-4

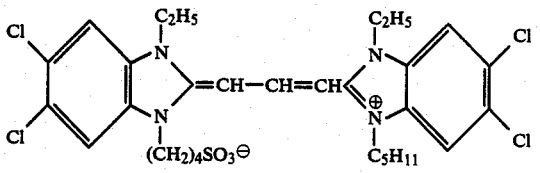

S-5

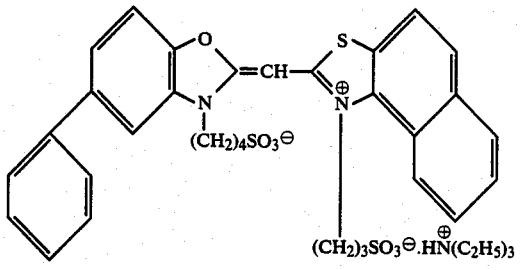

Photosensitive materials, sample Nos. 401 and 402 were exposed to light (red+green+blue light) through a white wedge. The exposed materials were subjected to a developing process consisting of the following sequence of steps.

| Processing steps | | |
|---|---|---|
| Step | Time | Temperature |
| First development | 6 min. | 38° C. |
| Washing | 2 min. | 38° C. |
| Reversal | 2 min. | 38° C. |
| Color development | 6 min. | 38° C. |
| Compensating | 2 min. | 38° C. |
| Bleaching | 6 min. | 38° C. |
| Fixing | 4 min. | 38° C. |
| Washing | 4 min. | 38° C. |
| Stabilizing | 1 min. | room temp. |
| Drying | | |

The processing solutions used in these steps had the following compositions.

| | A | B |
|---|---|---|
| First developing solution | | |
| Water | 700 ml | 700 ml |

-continued

| | | |
|---|---|---|
| Pentasodium nitrilo-N,N,N—trimethylenephosphonate | 3 g | 3 g |
| Sodium sulfite | 20 g | 20 g |
| Hydroquinone monosulfonate | 30 g | 30 g |
| Sodium carbonate (monohydrate) | 30 g | — |
| Sodium picolinate | — | 35 g |
| 1-phenyl-4-methyl-4-hydroxymethyl-3-pyrazolidone | 2 g | 2 g |
| Potassium bromide | 2.5 g | 2.5 g |
| Potassium thiocyanate | 1.2 g | 1.2 g |
| Potassium iodide (0.1% solution) | 2 ml | 2 ml |
| Water totaling to | 1000 ml | 1000 ml |
| pH adjusted to | 10.3 | 8.0 |
| Reversal solution | | |
| Water | 700 ml | |
| Pentasodium nitrilo-N,N,N—trimethylenephosphonate | 3 g | |
| Stannous chloride (dihydrate) | 1 g | |
| p-Aminophenol | 0.1 g | |
| Sodium hydroxide | 8 g | |
| Glacial acetic acid | 15 ml | |
| Water totaling to | 1000 ml | |

| | C | D |
|---|---|---|
| Color developing solution | | |
| Water | 700 ml | 700 ml |
| Pentasodium nitrilo-N,N,N—trimethylenephosphonate | 3 g | 3 g |
| Sodium sulfite | 7 g | 7 g |

-continued

| | | |
|---|---|---|
| Sodium tertiary phosphate (dodecahydrate) | 36 g | — |
| Sodium picolinate | — | 50 g |
| Potassium bromide | 1 g | 1 g |
| Potassium iodide (0.1% solution) | 90 ml | 90 ml |
| Sodium hydroxide | 3 g | — |
| Citrazinic acid | 1.5 g | 1.5 g |
| N—ethyl-N—(β-methanesulfonamido-ethyl)-3-methyl-4-aminoaniline hydrogensulfate | 11 g | 11 g |
| Ethylenediamine | 3 g | 3 g |
| Water totaling to | 1000 ml | 1000 ml |
| pH adjusted to | 11.5 | 9.0 |
| Compensating solution | | |
| Water | 700 ml | |
| Sodium sulfite | 12 g | |
| Sodium EDTA (dihydrate | 8 g | |
| Thioglycerin | 0.4 ml | |
| Glacial acetic acid | 3 ml | |
| Water totaling to | 1000 ml | |
| Bleaching solution | | |
| Water | 800 ml | |
| Sodium EDTA (dihydrate) | 2 g | |
| EDTA iron (III) ammonium (dihydrate) | 120 g | |
| Potassium bromide | 100 g | |
| Water totaling to | 1000 ml | |
| Fixing solution | | |
| Water | 800 ml | |
| Sodium thiosulfate | 80.0 g | |
| Sodium sulfite | 5.0 g | |
| Sodium bisulfite | 5.0 g | |
| Water totaling to | 1000 ml | |
| Stabilizing solution | | |
| Water | 800 ml | |
| Formalin (37 wt %) | 5.0 ml | |
| Fuji Drywell ® (surfactant manufactured by Fuji Photo Film Co. Ltd.) | 5.0 ml | |
| Water totaling to | 1000 ml | |

First developing solutions A and B and color developing solutions C and D were suitably selected depending on the photosensitive material processed therewith, as shown in Table 6.

The density of the resulting yellow, magenta, and cyan images was measured, with the results shown in Table 6.

TABLE 6

| Sample No. | First developing solution | Color developing solution | | Dmax | Dmin |
|---|---|---|---|---|---|
| 401 | A (pH 10.3) | D (pH 9.0) | yellow | 3.1 | 0.22 |
| | | | magenta | 3.2 | 0.22 |
| | | | cyan | 3.2 | 0.23 |
| 401 | B (pH 8.0) | C (pH 11.5) | yellow | 2.9 | 0.20 |
| | | | magenta | 3.0 | 0.21 |
| | | | cyan | 3.0 | 0.20 |
| 402 | A (pH 10.3) | C (pH 11.5) | yellow | 3.0 | 0.21 |
| | | | magenta | 3.1 | 0.21 |
| | | | cyan | 3.2 | 0.22 |

The data of Table 6 indicate that the effect of the present invention is achieved when the processing solution containing a complexing compound is used not only as a first processing solution, but also as an intermediate processing solution.

Example 6

Another photosensitive material, sample No. 501 was prepared by repeating the procedure of Example 5, Sample No. 401 except that the compositions of the third and fourth layers were changed as follows.

| | |
|---|---|
| 3rd layer: First red-sensitive emulsion layer | |
| Gelatin layer containing | |
| Silver iodobromide emulsion spectrally sensitized with sensitizing dyes S-1 and S-2 (iodine content 4 mol %, average particle size 0.3 μm) | 0.5 g/m² (Ag) |
| Coupler C-19 | 0.2 g/m² |
| Coupler C-18 | 0.05 g/m² |
| High-boiling organic solvent O-2 | 0.06 cc/m² |
| 4th layer: Second red-sensitive emulsion layer | |
| Gelatin layer containing | |
| Silver iodobromide emulsion spectrally sensitized with sensitizing dyes S-1 and S-2 (iodine content 2.5 mol %, average particle size 0.55 μm) | 0.8 g/m² (Ag) |
| Coupler C-19 | 0.55 g/m² |
| Coupler C-18 | 0.14 g/m² |
| High-boiling organic solvent O-2 | 0.16 cc/m² |

The photosensitive materials, Sample Nos. 401 and 501 were exposed to light through a pattern for measuring sharpness, processed by the same procedure as in Example 4 using first developing solution A and color developing solution D, and evaluated for sharpness. The reference was the photosensitive material designated Sample No. 402 of Example 4 which was processed with first developing solution A and color developing solution C. The results are shown in the following Table.

TABLE 7

| Sample No. | Cyan image | | |
|---|---|---|---|
| | Dmax | Dmin | Sharpness |
| 402 | 3.0 | 0.20 | reference |
| 401 | 3.1 | 0.21 | poorer than reference |
| 501 | 3.4 | 0.22 | equal to reference |

The data of Table 7 indicate that among 2-equivalent couplers, the coupler having a coupling-off group other than a halogen atom can produce a higher image density and improved sharpness in the processing method according to the present invention. It was found that a similar tendency appeared when C-3 and C-22 were used as the 2-equivalent couplers.

Example 7

A multi-layer color photosensitive material designated Sample No. 601 was prepared by coating multiple layers of the following compositions on a primed cellulose triacetate film support.

In the following compositions of the photosensitive layers, the coating amount is expressed in gram/m² of silver for silver halide and colloidal silver, in gram/m² for coupler, additives, and gelatin, and in mols per mol of silver halide in the same layer for sensitizing dyes.

| | |
|---|---|
| 1st layer: Anti-halation layer | |
| Black colloidal silver | 0.2 |
| Gelatin | 1.3 |
| Colored coupler M-39 | 0.06 |
| UV absorber UV-1 | 0.1 |
| UV absorber UV-2 | 0.2 |
| Dispersing oil Oil-1 | 0.01 |
| Dispersing oil Oil-2 | 0.01 |
| Zinc hydroxide (average particle size 0.2–0.3 μm) | 1.5 |
| 2nd layer: Intermediate layer | |
| Finely divided silver bromide | 0.15 |

-continued

| | |
|---|---|
| (average particle size 0.07 μm) | |
| Gelatin | 1.0 |
| Colored coupler C-44 | 0.02 |
| Dispersing oil Oil-1 | 0.1 |
| 3rd layer: First red-sensitive emulsion layer | |
| Silver iodobromide emulsion (silver iodide 2 mol %, average particle size 0.3 μm) | 0.4 (Ag) |
| Gelatin | 0.6 |
| Sensitizing dye I | $1.0 \times 10^{-4}$ |
| Sensitizing dye II | $3.0 \times 10^{-4}$ |
| Sensitizing dye III | $1.0 \times 10^{-5}$ |
| Coupler C-100 | 0.06 |
| Coupler C-101 | 0.06 |
| Coupler C-102 | 0.04 |
| Colored coupler C-44 | 0.03 |
| Dispersing oil Oil-1 | 0.03 |
| Dispersing oil Oil-3 | 0.012 |
| 4th layer: Second red-sensitive emulsion layer | |
| Silver iodobromide emulsion (silver iodide 5 mol %, average particle size 0.5 μm) | 0.7 (Ag) |
| Sensitizing dye I | $1 \times 10^{-4}$ |
| Sensitizing dye II | $3 \times 10^{-4}$ |
| Sensitizing dye III | $1 \times 10^{-5}$ |
| Coupler C-100 | 0.24 |
| Coupler C-101 | 0.24 |
| Coupler C-102 | 0.04 |
| Colored coupler C-44 | 0.04 |
| Dispersing oil Oil-1 | 0.15 |
| Dispersing oil Oil-3 | 0.02 |
| 5th layer: Third red-sensitive emulsion layer | |
| Silver iodobromide emulsion (silver iodide 10 mol %, average particle size 0.7 μm) | 1.0 (Ag) |
| Gelatin | 1.0 |
| Sensitizing dye I | $1 \times 10^{-4}$ |
| Sensitizing dye II | $3 \times 10^{-4}$ |
| Sensitizing dye III | $1 \times 10^{-5}$ |
| Coupler C-25 | 0.05 |
| Coupler C-14 | 0.1 |
| Dispersing oil Oil-1 | 0.01 |
| Dispersing oil Oil-2 | 0.05 |
| 6th layer: Intermediate layer | |
| Gelatin | 1.0 |
| Compound Cpd-A | 0.03 |
| Dispersing oil Oil-1 | 0.05 |
| 7th layer: First green-sensitive emulsion layer | |
| Silver iodobromide emulsion (silver iodide 4 mol %, average particle size 0.3 μm) | 0.30 (Ag) |
| Sensitizing dye IV | $5 \times 10^{-4}$ |
| Sensitizing dye VI | $0.3 \times 10^{-4}$ |
| Sensitizing dye V | $2 \times 10^{-4}$ |
| Gelatin | 1.0 |
| Coupler M-40 | 0.2 |
| Coupler Y-26 | 0.03 |
| Colored coupler M-39 | 0.03 |
| Dispersing oil Oil-1 | 0.5 |
| 8th layer: Second green-sensitive emulsion layer | |
| Silver iodobromide emulsion (silver iodide 5 mol %, average particle size 0.5 μm) | 0.4 (Ag) |
| Sensitizing dye IV | $5 \times 10^{-4}$ |
| Sensitizing dye V | $2 \times 10^{-4}$ |
| Sensitizing dye VI | $0.3 \times 10^{-4}$ |
| Coupler M-40 | 0.25 |
| Colored coupler M-39 | 0.03 |

-continued

| | |
|---|---|
| Colored coupler M-41 | 0.015 |
| Coupler Y-26 | 0.01 |
| Dispersing oil Oil-1 | 0.2 |
| 9th layer: Third green-sensitive emulsion layer | |
| Silver iodobromide emulsion (silver iodide 6 mol %, average particle size 0.7 μm) | 0.85 (Ag) |
| Gelatin | 1.0 |
| Sensitizing dye VII | $3.5 \times 10^{-4}$ |
| Sensitizing dye VIII | $1.4 \times 10^{-4}$ |
| Coupler M-5 | 0.01 |
| Coupler C-103 | 0.03 |
| Coupler M-3 | 0.20 |
| Colored coupler M-39 | 0.02 |
| Colored coupler Y-28 | 0.02 |
| Dispersing oil Oil-1 | 0.20 |
| Dispersing oil Oil-2 | 0.05 |
| 10th layer: Yellow filter layer | |
| Gelatin | 1.2 |
| Yellow colloidal silver | 0.08 |
| Compound Cpd-B | 0.1 |
| Dispersing oil Oil-1 | 0.3 |
| 11th layer: First blue-sensitive emulsion layer | |
| Monodispersed silver iodobromide emulsion (silver iodide 4 mol %, average particle size 0.3 μm) | 0.4 (Ag) |
| Gelatin | 1.0 |
| Sensitizing dye IX | $2 \times 10^{-4}$ |
| Coupler Y-14 | 0.9 |
| Coupler Y-26 | 0.07 |
| Dispersing oil Oil-1 | 0.2 |
| 12th layer: Second blue-sensitive emulsion layer | |
| Silver iodobromide emulsion (silver iodide 10 mol %, average particle size 1.5 μm) | 0.5 (Ag) |
| Gelatin | 0.6 |
| Sensitizing dye IX | $1 \times 10^{-4}$ |
| Coupler Y-14 | 0.25 |
| Dispersing oil Oil-1 | 0.07 |
| 13th layer: First protective layer | |
| Gelatin | 0.8 |
| UV absorber UV-1 | 0.1 |
| UV absorber UV-2 | 0.2 |
| Dispersing oil Oil-1 | 0.01 |
| Dispersing oil Oil-2 | 0.01 |
| 14th layer: Second protective layer | |
| Finely divided silver bromide (average particle size 0.07 μm) | 0.5 |
| Gelatin | 0.45 |
| Polymethyl methacrylate particles (diameter 1.5 μm) | 0.2 |
| Hardener H-1 | 0.4 |
| Formaldehyde scavenger S-1 | 0.5 |
| Formaldehyde scavenger S-2 | 0.5 |

For each of the layers, a surfactant was added to the above-described composition as a coating aid. The thus prepared photosensitive material is designated Sample No. 601.

For comparison purposes, another photosensitive material designated Sample No. 602 was prepared using the same compositions as Sample No. 601 except that the zinc hydroxide was removed from the first layer.

The compounds used in preparing these samples are shown below by their chemical structures or chemical names.

UV-1
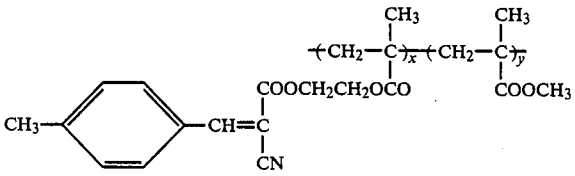
x/y = 7/3 (weight ratio)
UV-2
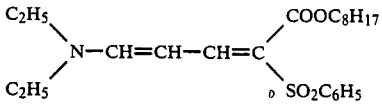
Oil 1: tricresyl phosphate
Oil 2: dibutyl phthalate
Oil 3: bis(2-ethylhexyl) phthalate
C-100
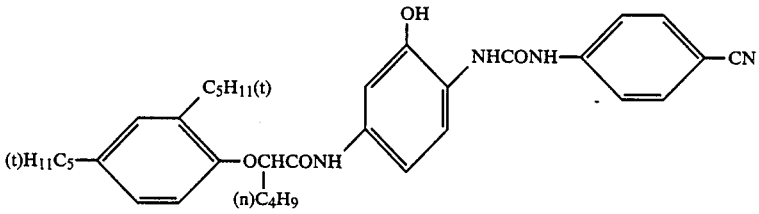
C-101
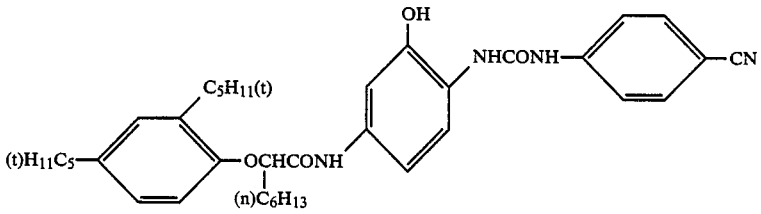
C-102
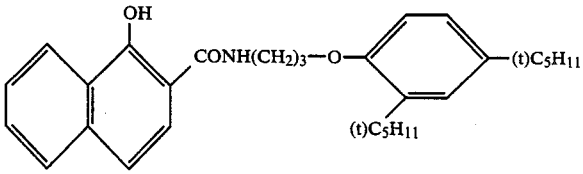
C-103
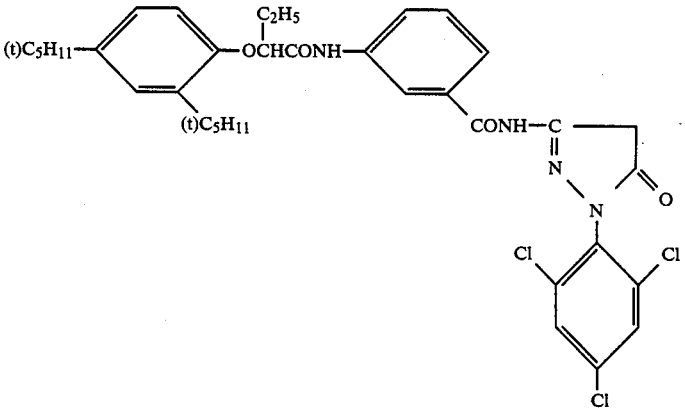
Cpd A
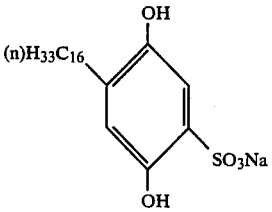
Cpd B
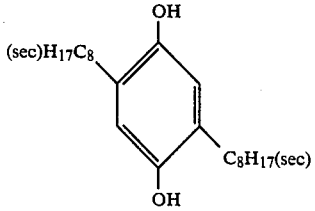

-continued
Sensitizing dye I
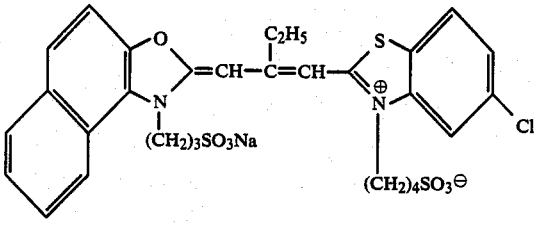
Sensitizing dye II
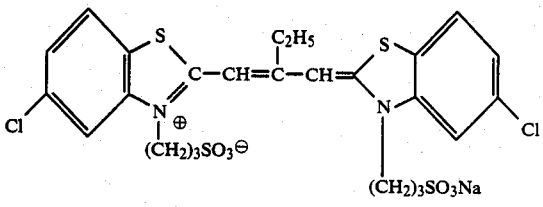
Sensitizing dye III
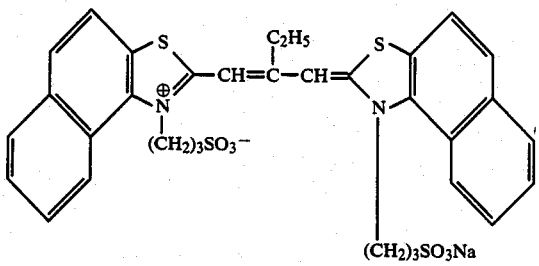
Sensitizing dye IV
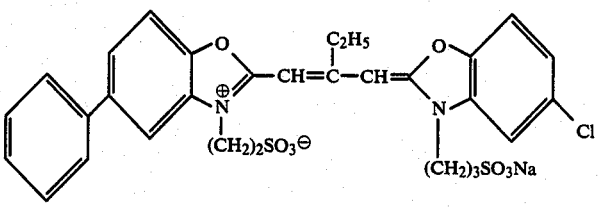
Sensitizing dye V
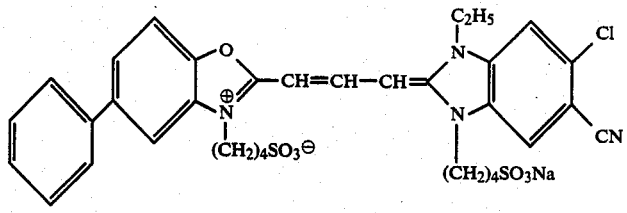
Sensitizing dye VI
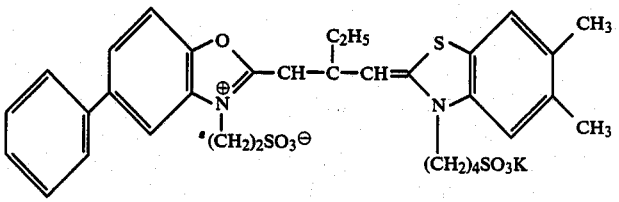
Sensitizing dye VII
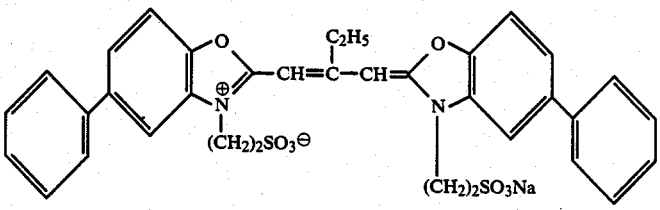

-continued

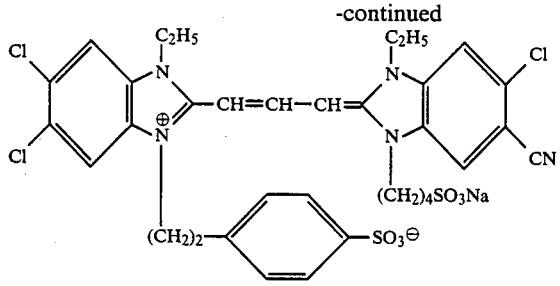

Sensitizing dye VIII

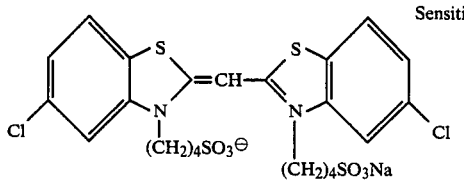

Sensitizing dye IX

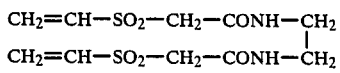

H-1

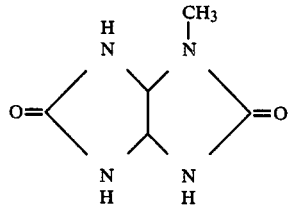

S-1

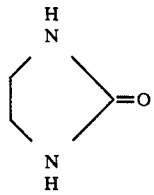

S-2

The thus obtained color negative films, sample Nos. 601 and 602 were exposed to light through an optical wedge. The exposed materials were subjected to a developing process consisting of the following sequence of steps.

| Step | Processing steps Time | Temperature |
|---|---|---|
| Color development | 3 min. | 38° C. |
| Bleaching | 1 min. 30 sec. | 38° C. |
| Fixing | 3 min. | 38° C. |
| Washing | 3 min. | 38° C. |
| Stabilizing | 1 min. | 38° C. |

The processing solutions used in these steps had the following compositions.

| | A | B |
|---|---|---|
| Color developing solution | | |
| Sodium nitrilotriacetate | 1.0 g | 1.0 g |
| Sodium sulfite | 4.0 g | 4.0 g |
| Sodium carbonate | 30.0 g | — |
| Sodium picolinate | — | 30.0 g |
| Potassium bromide | 1.4 g | 1.4 g |
| Hydroxylamine hydrogensulfate | 2.4 g | 2.4 g |
| 4-(N—ethyl-N—β-hydroxyethylamino)-2-methylaniline hydrogensulfate | 4.5 g | 4.5 g |
| Water totaling to | 1000 ml | 1000 ml |
| pH | 10.1 | 8.0 |
| Bleaching solution | | |

-continued

| | A | B |
|---|---|---|
| Ammonium bromide | 160.0 g | |
| Aqueous ammonia (28%) | 25.0 ml | |
| Sodium iron EDTA | 130.0 g | |
| Glacial acetic acid | 14.0 ml | |
| Water totaling to | 1000 ml | |
| Fixing solution | | |
| Sodium tetrapolyphosphate | 2.0 g | |
| Sodium sulfite | 4.0 g | |
| Ammonium thiosulfate (70%) | 175.0 g | |
| Sodium bisulfite | 4.6 g | |
| Water totaling to | 1000 ml | |
| Stabilizing solution | | |
| Formalin | 8.0 ml | |
| Water totaling to | 1000 ml | |

Sample Nos. 601 and 602 each were processed with color developing solutions A and B in the color developing step for comparison purposes. The bleaching and subsequent steps utilized common processing solutions.

The results of photographic properties are shown in Table 8.

TABLE 8

| Sample No. | Color developing solution | Yellow Dmin | Yellow Dmax | Magenta Dmin | Magenta Dmax | Cyan Dmin | Cyan Dmax | |
|---|---|---|---|---|---|---|---|---|
| 601 | A | 0.87 | 2.8 | 0.52 | 2.3 | 0.16 | 2.0 | Comp. |
| 601 | B | 0.88 | 2.8 | 0.53 | 2.4 | 0.17 | 2.0 | Inv. |
| 602 | A | 0.86 | 2.8 | 0.52 | 2.3 | 0.16 | 1.9 | Comp. |
| 602 | B | 0.84 | 1.0 | 0.50 | 0.7 | 0.15 | 0.3 | Comp. |

The combination of Sample No. 601 with developing solution B is within the scope of the invention and labelled "Inv." while the remaining combinations are outside the scope of the invention and labelled "Comp.".

Example 8

The photosensitive materials, sample Nos. 601 and 602 of Example 7 were exposed to light through an optical wedge. The exposed materials were subjected to a developing process consisting of the following sequence of steps.

| Step | Processing steps Time | Temperature |
|---|---|---|
| Color development | 3 min. | 38° C. |
| Bleaching | 1 min. 30 sec. | 38° C. |
| Fixing | 3 min. | 38° C. |
| Washing | 3 min. | 38° C. |
| Stabilizing | 1 min. | 38° C. |

The processing solutions used in these steps had the following compositions. Each developing step was initiated with 2 liters of a mother liquid of the following composition and 1 $m^2$ of color negative film was continuously processed while the solution was replenished with a 50-ml portion of a replenisher of the following composition (the replenisher for the color developing solution was replenisher B for sample No. 601 and replenisher A for sample No. 602) every 350 $cm^2$ of the color negative film.

| Color developing solution | Mother liquid | Replenisher A | Replenisher B |
|---|---|---|---|
| Sodium nitrilotriacetate | 1.0 g | 1.1 g | 1.1 g |
| Sodium sulfite | 4.0 g | 4.4 g | 4.4 g |
| Sodium bicarbonate | — | — | 16.0 g |
| Sodium carbonate | 30.0 g | 32.0 g | — |
| Sodium picolinate | — | — | 16.0 g |
| Potassium bromide | 1.4 g | 0.7 g | 0.7 g |
| Hydroxylamine hydrogensulfate | 2.4 g | 2.6 g | 2.6 g |
| 4-(N—ethyl-N—β-hydroxyethyl-amino)-2-methylaniline hydrogensulfate | 4.5 g | 5.0 g | 5.0 g |
| Water totaling to | 1000 ml | 1000 ml | 1000 ml |
| pH | 10.10 | 10.50 | 9.00 |

| | Mother | Replenisher |
|---|---|---|
| Bleaching solution | | |
| Ammonium bromide | 160.0 g | 176.0 g |
| Aqueous ammonia (28%) | 25.0 ml | 15 ml |
| Sodium iron EDTA | 130.0 g | 143.0 g |
| Glacial acetic acid | 14.0 ml | 14.0 ml |
| Water totaling to | 1000 ml | 1000 ml |
| Fixing solution | | |
| Sodium tetrapolyphosphate | 2.0 g | 2.2 g |
| Sodium sulfite | 4.0 g | 4.4 g |
| Ammonium thiosulfate (70%) | 175.0 g | 193.0 g |
| Sodium bisulfite | 4.6 g | 5.1 g |
| Water totaling to | 1000 ml | 1000 ml |
| Stabilizing solution | | |
| Formalin | 8.0 ml | 9.0 ml |
| Water totaling to | 1000 ml | 1000 ml |

The results of photographic properties are shown in Table 9.

TABLE 9

| Sample No. | 601 (Invention) | 602 (Comparison) |
|---|---|---|
| Initial | | |
| Dmin | | |
| Yellow | 0.86 | 0.87 |
| Magenta | 0.52 | 0.52 |
| Cyan | 0.16 | 0.16 |
| Dmax | | |
| Yellow | 2.8 | 2.8 |
| Magenta | 2.3 | 2.3 |

TABLE 9-continued

| Sample No. | 601 (Invention) | 602 (Comparison) |
|---|---|---|
| Cyan | 1.9 | 1.9 |
| End of 1 $m^2$ processing | | |
| Dmin | | |
| Yellow | 0.87 | 0.88 |
| Magenta | 0.53 | 0.52 |
| Cyan | 0.17 | 0.17 |
| Dmax | | |
| Yellow | 2.8 | 2.9 |
| Magenta | 2.3 | 2.3 |
| Cyan | 2.0 | 2.1 |

The replenishers A and B for the color developing solution were admitted into plastic tanks and allowed to stand for one month with their caps kept open. Using the aged replenishers to which water was added in the evaporated volume, the above-mentioned processing was carried out.

The results of photographic properties obtained at the end of 1 $m^2$ processing are shown in Table 10.

TABLE 10

| Sample No. | Dmin Yellow | Dmin Magenta | Dmin Cyan | Dmax Yellow | Dmax Magenta | Dmax Cyan |
|---|---|---|---|---|---|---|
| 601 (invention) | 0.92 | 0.59 | 0.20 | 2.9 | 2.2 | 1.9 |
| 602 (comparison) | 1.02 | 0.84 | 0.25 | 2.6 | 2.0 | 1.7 |

The data of Table 10 indicate that the process of the present invention enables the use of a replenisher having improved aging stability and hence, exhibiting little variation in photographic performance.

Example 9

The photosensitive materials, Sample Nos. 301 and 302 of Example 3 were imagewise exposed and then continuously processed by the following sequence of steps using a Fuji Color Roll Processor FMPP-1000 (manufactured by Fuji Photo Film Co. Ltd.). The washing was three-stage countercurrent water washing from washing step (3) to washing step (1). The amount of processing solution entrained with color paper from one tank to a subsequent tank was about 60 ml per square meter of the color paper. The tank or mother solutions and their replenishers had the following recipes.

| Color developing solution | Tank solution | Replenisher A | Replenisher B |
|---|---|---|---|
| Water | 800 ml | 800 ml | 800 ml |
| 3Na nitrilotriacetate | 2.0 g | 2.0 g | 2.0 g |
| Benzyl alcohol | 14 ml | 18 ml | 18 ml |
| Diethylene glycol | 10 ml | 10 ml | 10 ml |
| Sodium sulfite | 2.0 g | 2.5 g | 2.5 g |
| Hydroxylamine hydrogensulfate | 3.0 g | 3.5 g | 3.5 g |
| Potassium bromide | 1.0 g | — | — |
| Sodium bicarbonate | — | — | 16 g |
| Sodium carbonate | 30 g | 35 g | — |
| Potassium picolinate | — | — | 20 g |
| N—ethyl-N—(β-methanesulfonamidoethyl)-3-methyl-4-aminoaniline hydrogensulfate | 5.0 g | 8.0 g | 8.0 g |
| Water totaling to | 1000 ml | 1000 ml | 1000 ml |
| pH | 10.15 | 10.65 | 8.85 |

| Bleach/fix solution | Tank solution | Replenisher |
|---|---|---|
| Water | 400 ml | 400 ml |
| Ammonium thiosulfate (70% solution) | 150 ml | 300 ml |
| Sodium sulfite | 18 g | 36 g |
| Iron ammonium EDTA | 55 g | 110 g |

-continued

| | | |
|---|---|---|
| 2Na EDTA | 5 g | 10 g |
| Water totaling to | 1000 ml | 1000 ml |
| pH | 6.70 | 6.50 |

Under the foregoing conditions, the color papers each were processed to a total area of 5 $m^2$.

The replenisher used in the developing process was replenisher B for Sample No. 301 and replenisher B for Sample No. 302. The replenisher was added in a volume of 350 ml per square meter of color paper processed during the developing process, and the replenisher was added in a volume of 30 ml per square meter of color paper processed during the bleaching/fixing process.

Separately, replenishers A and B were allowed to stand in open containers. Using the aged replenishers to which water was added in the evaporated volume, the color papers each were processed in the same manner to a total area of 5 $m^2$.

The results of photographic properties are shown in Table 11.

TABLE 11

| Sample No. | 301 (Invention) | 302 (Comparison) |
|---|---|---|
| Initial | | |
| Dmin, | | |
| Yellow | 0.11 | 0.11 |
| Magenta | 0.10 | 0.10 |
| Cyan | 0.09 | 0.09 |
| Dmax, | | |
| Yellow | 2.0 | 2.0 |
| Magenta | 2.3 | 2.3 |
| Cyan | 2.3 | 2.5 |
| Processing using fresh replenisher | | |
| Dmin, | | |
| Yellow | 0.11 | 0.11 |
| Magenta | 0.10 | 0.10 |
| Cyan | 0.10 | 0.10 |
| Dmax, | | |
| Yellow | 2.1 | 2.0 |
| Magenta | 2.3 | 2.3 |
| Cyan | 2.3 | 2.3 |
| Processing using aged replenisher | | |
| Dmin, | | |
| Yellow | 0.14 | 0.22 |
| Magenta | 0.13 | 0.24 |
| Cyan | 0.14 | 0.26 |
| Dmax, | | |
| Yellow | 1.9 | 1.7 |
| Magenta | 2.0 | 1.8 |
| Cyan | 2.0 | 1.8 |

Example 10

A low silver color photosensitive material was prepared by coating first (lowermost) to sixth (uppermost) layers of the following compositions to a paper support laminated with polyethylene having titanium dioxide dispersed therein. In the following formulation, figures expressed in mg/$m^2$ in parentheses represent coating weights.

[Formulation]

6th layer:
- Gelatin (1000 mg/$m^2$)

5th layer: Red-sensitive layer
- Silver chlorobromide (AgBrCl) emulsion having 30 mol% of silver bromide and an average grain size of 0.3 μm (200 mg/$m^2$ of Ag)
- Gelatin (1000 mg/$m^2$)
- Cyan coupler C-17 (400 mg/$m^2$)
- Coupler solvent*1 (200 mg/$m^2$)

4th layer:
- Gelatin (1200 mg/$m^2$)
- Zinc hydroxide dispersion (45 mg/$m^2$ of $Zn(OH)_2$)
- UV absorber*2 (1000 mg/$m^2$)
- Dioctyl hydroquinone (50 mg/$m^2$)

3rd layer: Green-sensitive layer
- Silver chlorobromide (AgBrCl) emulsion having 30 mol% of silver bromide and an average grain size of 0.3 μm (250 mg/$m^2$ of Ag)
- Gelatin (1000 mg/$m^2$)
- Magenta coupler M-4 (300 mg/$m^2$)
- Coupler solvent*3 (300 mg/$m^2$)

2nd layer:
- Gelatin (1000 mg/$m^2$)
- Zinc hydroxide dispersion (95 mg/$m^2$ of $Zn(OH)_2$)

1st layer: Blue-sensitive layer
- Silver chlorobromide (AgBrCl) emulsion having 80 mol% of silver bromide and an average grain size of 0.7 μm (350 mg/$m^2$ of Ag)
- Gelatin (1200 mg/$m^2$)
- Yellow coupler Y-23 (300 mg/$m^2$)
- Coupler solvent*1 (150 mg/$m^2$)

Support

*1 Coupler solvent: n-butyl phthalate

*2 UV absorber: 2-(2-hydroxy-3-sec.-butyl-5-tert.-butylphenyl)benzotriazole

*3 Coupler solvent: o-cresyl phosphate

The photosensitive material was exposed to light using a sensitometer and then processed as follows.

The color paper thus prepared was printed and then processed by means of an automatic developing machine being continuously replenished (running process). The sequence of processing steps and processing solutions used therein are presented below.

| Standard processing steps | | |
|---|---|---|
| (1) Color development | 33° C. | 3 min. 30 sec. |
| (2) Bleaching/fixing | 33° C. | 1 min. 30 sec. |
| (3) Washing | 25–30° C. | 3 min. |
| (4) Drying | 75–80° C. | approx. 2 min. |

Compositions of processing solutions

| | |
|---|---|
| Color developing tank solution | |
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine hydrogensulfate | 3.0 g |
| Hydroxyethoxyiminodiacetic acid | 2 g |
| 1-Hydroxyethylidene-1,1'-diphosphonic acid | 1 g |
| 3-Methyl-4-amino-N—ethyl-N—(β-methanesulfonamidoethyl)aniline hydrogensulfate | 5.5 g |
| Brightener, 4,4'-diaminostilbene-disulfonic acid derivative | 1.0 g |
| Potassium hydroxide | 2.0 g |
| Water totaling to | 1 liter |
| Color developing replenisher | |
| Benzyl alcohol | 20 ml |
| Ethylene glycol | 20 ml |
| Potassium sulfite | 3.0 g |
| Sodium bicarbonate | 18.0 g |
| Hydroxylamine hydrogensulfate | 4.0 g |
| Hydroxyethoxyiminodiacetic acid | 2 g |

-continued

| | |
|---|---|
| Sodium picolinate | 16 g |
| 1-Hydroxyethylidene-1,1'-diphosphonic acid | 1.0 g |
| 3-Methyl-4-amino-N—ethyl-N—(β-methanesulfonamidoethyl)aniline hydrogensulfate | 7.0 g |
| Brightener, 4,4'-diaminostilbene-disulfonic acid derivative | 1.0 g |
| Potassium hydroxide amount to adjust | pH to 8.0 |
| Water totaling to | 1 liter |
| Bleaching/fixing tank solution | |
| Ferric ammonium EDTA dihydrate | 60 g |
| EDTA | 3 g |
| Ammonium thiosulfate (70% solution) | 100 ml |
| Ammonium sulfite (40% solution) | 27.5 ml |
| Potassium carbonate or glacial acetic acid amount to adjust | pH to 7.1 |
| Water totaling to | 1 liter |
| Bleaching/fixing replenisher A | |
| Ferric ammonium EDTA dihydrate | 260 g |
| Potassium carbonate | 42 g |
| Water totaling to | 1 liter |
| pH | 6.7 ± 0.1 |
| Bleaching/fixing replenisher B | |
| Ammonium thiosulfate (70% solution) | 500 ml |
| Ammonium sulfite (40% solution) | 250 ml |
| EDTA | 17 g |
| Glacial acetic acid | 85 ml |
| Water totaling to | 1 liter |
| pH | 4.6 ± 0.1 |

The tanks of the automatic developing machine were respectively filled with the color developing tank solution and the bleaching/fixing tank solution both as formulated above. The running test was carried out in which the color paper was processed while the tanks were replenished with the color developing replenisher and the bleaching/fixing replenishers A and B. The amount of replenisher added to the tank per square meter of the color paper was 324 ml for the color developing replenisher and 25 ml for each of the bleaching-/fixing replenishers A and B.

The development was substantially continuously carried out until the total amount of the developing replenisher added reached 2 times the volume of the developing tank. It was found that changes in photographic properties (color developing density (Dmax), sensitivity, and stain) between the samples developed at the start and the end of the running test fell within a normal variation range, ensuring that the quality of processed samples was fully controlled.

Example 11

Subsequent to the end of the running test of Example 10, development was continued by increasing the amount of the developing replenisher added to 356 ml per $m^2$ of the color paper (that is, 10% increase) until the total amount of the developing replenisher added reached one half the volume of the developing tank. The contrast of the sample obtained at the end of the additional running test was somewhat high, but still within the range of the control diagram, indicating that the process of the present invention is little affected by processing variations.

Subsequent to the additional running test, the replenishers according to the present invention were allowed to stand for one month in open containers. Using the aged replenisher to which water was added in the evaporated volume, the running test was further continued until the total amount of the developing replenisher added reached one half the volume of the developing tank. The result was within the range of the control diagram, indicating that the process of the present invention is relatively free of aging deterioration.

Example 12

The color paper prepared in Example 10 was printed and then processed by means of an automatic developing machine being continuously replenished (running processing). The sequence of processing steps and processing solutions used therein (bleaching/fixing tank solution, and bleaching/fixing replenishers A and B) are the same as in Example 10 except the color developing tank solution.

| Color developing tank solution | |
|---|---|
| Benzyl alcohol | 20 ml |
| Ethylene glycol | 20 ml |
| Potassium sulfite | 3.0 g |
| Sodium bicarbonate | 18.0 g |
| Hydroxylamine hydrogensulfate | 4.0 g |
| Hydroxyethoxyiminodiacetic acid | 2 g |
| Sodium picolinate | 16 g |
| 1-Hydroxyethylidene-1,1'-diphosphonic acid | 1.0 g |
| 3-Methyl-4-amino-N—ethyl-N—(β-methanesulfonamidoethyl)aniline hydrogensulfate | 12.5 g |
| Brightener, 4,4'-diaminostilbene-disulfonic acid derivative | 1.0 g |
| Potassium hydroxide in amount to adjust | pH to 7.0 |
| Water totaling to | 1 liter |

The tanks of the automatic developing machine were respectively filled with the color developing tank solution and the bleaching/fixing tank solution as previously formulated. The running test was carried out in which the color paper was processed while the tanks were replenished with the color developing replenisher and the bleaching/fixing replenishers A and B as previously formulated. The amount of replenisher added to the tank per square meter of the color paper was 100 ml for the color developing replenisher and 25 ml for each of the bleaching/fixing tank replenishers A and B.

The development was substantially continuously carried out until the total amount of the developing replenisher added reached 2 times the volume of the developing tank. It was found that changes in photographic properties (color developing density (Dmax), sensitivity, and stain) between the samples developed at the start and the end of the running test fell within a normal variation range, ensuring that the quality of processed samples was fully controlled.

Example 13

A continuous developing process was carried out using the same photosensitive material and automatic developing machine as used in Example 12. The processing solutions and steps used were the same as in Example 12 except the washing step. Instead of the washing step, the fourth tank of the four stage countercurrent system was replenished with a rinsing solution having the following composition whereby the overflowing solution was sequentially fed to the third, the second, and then the first tank as opposed to the movement of the photosensitive material.

| Rinsing solution | |
|---|---|
| 2Na—EDTA.$2H_2O$ | 0.4 g |
| Water totaling to | 1000 ml |

-continued

| Rinsing solution | |
|---|---|
| pH | 7.0 |

The amount of the rinsing solution added was 250 ml per square meter of the color paper.

The development was substantially continuously carried out until the total amount of the developing replenisher added reached 2 times the volume of the developing tank. It was found that changes in photographic properties (sensitivity, color developing density, and fog) between the samples developed at the start and the end of the running test fell within a normal variation range, ensuring consistent quality.

The spent solutions to be disposed of in this processing are only those overflowing from the bleaching/fixing tank and the first rinsing tank, leading to the additional advantage of minimizing the amount of spent solution to be disposed of.

Although some preferred embodiments of the present invention are described, modifications and changes may be made thereto within the scope of the present invention.

What is claimed:

1. A process for forming a color image, comprising subjecting a silver halide photosensitive material comprising at least a photosensitive silver halide, a two equivalent coupler, a binder, and a substantially water-insoluble basic metal compound on a support, to development with a processing solution comprising a complexing compound capable of water-mediated complexing reaction with the metal ion of said substantially water-insoluble basic metal compound to release a base.

2. The image forming process of claim 1 wherein said two equivalent coupler has a coupling-off group selected from the class consisting of fluorine, chlorine, bromine, alkoxy groups, aryloxy groups, acyloxy group, aliphatic or aromatic sulfonyloxy groups, acylamino groups, aliphatic or aromatic sulfonamide groups, alkoxycarbonyloxy groups, aryloxycarbonyloxy groups, aliphatic, aromatic or heterocyclic thio groups, carbamoylamino groups, 5- or 6-membered nitrogeneous heterocyclic groups, imide groups and aromatic azo groups.

3. The image forming process of claim 1 wherein said substantially water-insoluble metal compound is selected from the group consisting of carbonate salts, phosphate salts, silicate salts, borate salts, aluminate salts, hydroxides, oxides, and double salts thereof, provided that they have a solubility in water at 20° C. of 0.5 or less as expressed in grams of the compound dissolved in 100 grams of water.

4. The image forming process of claim 1 wherein said complexing compound is selected from the class consisting of salts of an aminocarboxylic acid, an iminodiacetic acid, an anilinecarboxylic acid, a pyridinecarboxylic acid, an aminophosphoric acid, a carboxylic acid, a hydroxamic acid, a polyacrylic acid, and a polyphosphoric acid with an alkali metal, a guanidine, an amidine, and quaternary ammonium.

5. The image forming process of claim 1 wherein said complexing compound is selected from aromatic heterocyclic compounds having at least one —COOM and containing one nitrogen atom in their ring wherein M is selected from the class consisting of an alkali metal, a guanidine, an amidine, and quaternary ammonium.

6. The image forming process of claim 5 wherein the aromatic heterocyclic compound contains a pyridine or quinoline ring.

7. The image forming process of claim 5 wherein —COOM is attached to the ring at the α-position thereof relative to the N atom.

8. The image forming process of claim 5 wherein said complexing compound is selected from compounds having the general formula:

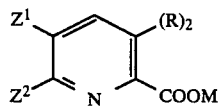

wherein

R represents an electron donative radical selected from the class consisting of hydrogen, an aryl radical, a halogen atom, an alkoxy radical, —COOM, a hydroxycarbonyl radical, an amino or substituted amino radical, and an alkyl radical, the two R's may be the same or different, $Z^1$ and $Z^2$ are as defined for R and may be combined together to form a ring fused to the pyridine ring, and M is selected from the class consisting of an alkali metal, a guanidine, an amidine, and quaternary ammonium.

9. The image forming process of claim 1 wherein said substantially water-insoluble basic metal compound is present in an amount of 0.01 to 20 grams/$m^2$.

10. The image forming process of claim 1 wherein said complexing compound is present in an amount of 0.01 to 5 mols per liter of the solution.

11. The image forming process of claim 1 wherein said processing solution is a color developing solution.

12. The image forming process of claim 1 wherein said processing solution is a replenishing solution.

13. The image forming process of claim 12 wherein the replenisher is added only in a volume corresponding to a loss of the processing solution in a processing tank without overflowing.

* * * * *